US006761606B2

(12) United States Patent
Ito et al.

(10) Patent No.: US 6,761,606 B2
(45) Date of Patent: Jul. 13, 2004

(54) METHOD OF PRODUCING SPACER AND METHOD OF MANUFACTURING IMAGE FORMING APPARATUS

(75) Inventors: Nobuhiro Ito, Kanagawa (JP); Masahiro Fushimi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 328 days.

(21) Appl. No.: 09/946,534

(22) Filed: Sep. 6, 2001

(65) Prior Publication Data

US 2002/0031974 A1 Mar. 14, 2002

(30) Foreign Application Priority Data

Sep. 8, 2000 (JP) ..... 2000-273708
Aug. 30, 2001 (JP) ..... 2001-261910

(51) Int. Cl.[7] ..... H01J 9/00; B05D 5/00

(52) U.S. Cl. ..... 445/24; 427/77; 427/126.5; 427/154; 427/282

(58) Field of Search ..... 445/24, 14, 58; 313/422; 427/77, 123, 125, 126.1, 126.3, 126.5, 154, 282, 430.1, 431, 433

(56) References Cited

U.S. PATENT DOCUMENTS

| | | | | |
|---|---|---|---|---|
| 4,769,575 | A | 9/1988 | Murata et al. | 313/495 |
| 4,904,895 | A | 2/1990 | Tsukamoto et al. | 313/336 |
| 4,923,421 | A | 5/1990 | Brodie et al. | 445/24 |
| 5,063,327 | A | 11/1991 | Brodie et al. | 313/482 |
| 5,066,883 | A | 11/1991 | Yoshioka et al. | 313/309 |
| 5,205,770 | A | 4/1993 | Lowrey et al. | 445/24 |
| 5,232,549 | A | 8/1993 | Cathey et al. | 456/633 |
| 5,486,126 | A | 1/1996 | Cathey et al. | 445/25 |
| 5,509,840 | A | 4/1996 | Huang et al. | 445/24 |
| 5,561,343 | A | 10/1996 | Lowe | 313/482 |

(List continued on next page.)

FOREIGN PATENT DOCUMENTS

| | | |
|---|---|---|
| EP | 0 725 416 A1 | 8/1996 |
| EP | 0 725 417 A1 | 8/1996 |
| EP | 0 725 418 A1 | 8/1996 |
| EP | 0 725 419 a1 | 8/1996 |
| JP | 57-118355 | 7/1982 |
| JP | 61-124031 | 6/1986 |
| JP | 64-31332 | 2/1989 |
| JP | 2-257551 | 10/1990 |
| JP | 3-55738 | 3/1991 |
| JP | 4-28137 | 1/1992 |
| JP | 8-180821 | 7/1996 |
| WO | WO 94/18694 | 8/1994 |
| WO | WO 96/30926 | 10/1996 |
| WO | WO 9802899 | 1/1998 |
| WO | WO 98/03986 | 1/1998 |
| WO | WO 98/28774 | 7/1998 |

OTHER PUBLICATIONS

R. Meyer et al., *Recent Development on "Microtips" Display at Leti*, Technical Digest of IVMC 91, Nagahama 1991, pp. 6–9.

(List continued on next page.)

*Primary Examiner*—Dean A. Reichard
*Assistant Examiner*—Adolfo Nino
(74) *Attorney, Agent, or Firm*—Fitzpatrick, Cella, Harper & Scinto

(57) ABSTRACT

The present invention provides a method of producing a spacer provided between a first substrate and a second substrate on which an electron emitting device is arranged, the method including the step of forming a film on at least a portion of at least one surface of the spacer. The film forming step includes the step of preparing a bundle of a plurality of spacer base members, and the step of coating a film material on the bundle, and wherein the bundle on which the film material is coated has a mask layer for covering at least a film non-formation portion near the film formation portion of each of the plurality of spacer base members of the bundle.

20 Claims, 32 Drawing Sheets

U.S. PATENT DOCUMENTS

| | | | | | |
|---|---|---|---|---|---|
| 5,569,974 | A | | 10/1996 | Morikawa et al. | 313/310 |
| 5,614,781 | A | | 3/1997 | Spindt et al. | 313/422 |
| 5,675,212 | A | | 10/1997 | Schmid et al. | 313/422 |
| 5,682,085 | A | | 10/1997 | Suzuki et al. | 315/169.1 |
| 5,721,050 | A | | 2/1998 | Roman et al. | 428/397 |
| 5,742,117 | A | | 4/1998 | Spindt et al. | 313/422 |
| 5,746,635 | A | | 5/1998 | Spindt et al. | 445/24 |
| 5,760,538 | A | | 6/1998 | Mitsutake et al. | 313/422 |
| 5,777,421 | A | | 7/1998 | Woodward, Jr. | 310/268 |
| 5,795,206 | A | * | 8/1998 | Cathey et al. | 445/24 |
| 5,811,927 | A | | 9/1998 | Anderson et al. | 313/495 |
| 5,962,969 | A | * | 10/1999 | Watkins | 445/24 |
| 6,120,339 | A | * | 9/2000 | Alwan | 445/24 |
| 6,365,237 | B1 | * | 4/2002 | Peake et al. | 427/585 |
| 6,447,354 | B1 | * | 9/2002 | Hofmann et al. | 445/24 |
| 6,491,559 | B1 | * | 12/2002 | Rasmussen et al. | 445/24 |
| 6,554,671 | B1 | * | 4/2003 | Hofmann et al. | 445/24 |
| 6,561,864 | B2 | * | 5/2003 | Hofmann et al. | 445/24 |

OTHER PUBLICATIONS

M. Hartwell et al., *Strong Electron Emission From Patterned Tin–Indium Oxide Thin Films*, International Electron Devices Meeting, 1975, Washington, D.C., pp. 519–521.

G. Dittmer, *Electrical Conduction and Electron Emission of Discontinuous Thin Films*, Thin Solid Films—Elsevier Sequoia S.A., Lausanne, Switzerland (1972) pp. 317–328.

C.A. Mead, *Operation of Tunnel–Emission Devices*, Journal of Applied Physics, vol. 32, (1961) pp. 646–652.

C.A. Spindt, et al., *Physical Properties of thin–field emission, cathodes with molybdenum cones*, J. Appl. Phys., vol. 47, No. 12, (1976) pp. 5248–5263.

H. Araki et al., *Electroforming and Electron Emission of Carbon Thin Films*, (1981) pp. 22–29 (English Abstract on p. 22).

M.L. Elinson et al., *The Emission of Hot Electrons and the Field Emission of Electrons from Tin Oxide*, Radio Engineering and Electronic Physics, (1965) pp. 1290–1296.

W.P. Dyke et al., *Field Emission*, Advances in Electronics and Electron Physics, (1956) pp. 89–185.

* cited by examiner

METHOD OF PRODUCING SPACER AND METHOD OF MANUFACTURING IMAGE FORMING APPARATUS

BACKGROUND OF THE INVENTION

1. Field of the Invention

The present invention relates to a method of producing a spacer arranged between a pair of substrates, and a method of manufacturing an image forming apparatus using the spacer.

2. Description of the Related Art

Known electron emitting devices include the two types of devices including a hot-cathode device and a cold-cathode device. Of these devices, known examples of the cold-cathode device include a surface conduction-type emission device, a field emission device (referred to as a FE type" hereinafter) and a metal/insulating layer/metal type emission device (referred to as a MIM type" hereinafter).

Examples of the surface conduction-type emission device include the device disclosed in M. I. Elinson, Radio Eng. Electron Phys., 10, 1290 (1965), and the other devices described below.

The surface conduction-type emission device utilizes the phenomenon that electrons are emitted by passing an electric current through a small-area thin film formed on a substrate in parallel to the film plane. As the surface conduction-type emission device, there have been reported the above-described device disclosed by Elinson using a $SnO_2$ thin film, a device comprising an Au thin film [G. Dittmer, "Thin Solid Films", 9, 317 (1972)], a device comprising a $In_2O_3$/$SnO_2$ thin film [M. Hartwell and C. G. Fonstad, "IEEE Trans. EDConf.", 519 (1975)], a device comprising a carbon thin film [Hisashi Araki et al., Vacuum, Vo. 26, No. 1, 22 (1983)], etc.

A typical example of the construction of the surface conduction-type emission device is the device disclosed in M. Hartwell, et al., shown in FIG. 33. In FIG. 33, reference numeral 301 denotes a substrate, and reference numeral 304 denotes a conductive thin film of a metal oxide formed by sputtering. The conductive thin film 304 has an H-shaped planar form. The conductive thin film 304 is subjected to the electric forming described below to form an electron emitting portion 305. In this drawing, the distance L is set to 0.5 to 1 mm, and the width W is set to 0.1 mm. Although, in FIG. 33, the electron emitting portion 305 is shown in a rectangular shape at the center of the conductive thin film 304 for convenience's sake, FIG. 33 schematically shows the electron emitting portion 305, but it does not faithfully express the position and the shape of the electron emitting portion 305.

In the surface conduction-type emission devices such as the device of M. Hartwell et al., the conductive thin film 304 is generally subjected to electric forming to form the electron emitting portion 305 before electron emission. Namely, the electric forming means that an electric current is supplied to the conductive thin film 304 by applying a constant DC voltage or a DC voltage slowly increasing, for example, at a rate of about 1 V/min., across both ends of the conductive thin film 304 to locally break, deform or deteriorate, forming the electron emitting portion 305 in an electrically high-resistance state. In the electric forming, a crack occurs in a portion of the locally broken, deformed or deteriorated conductive thin film 304. When an appropriate voltage is applied to the conductive thin film 304 after the electric forming, electrons are emitted from a portion near the crack.

Known examples of the FE type devices include the devices disclosed in W. P. Dyke & W. W. Dolan, "Field Emission", Advance in Electron Physics, 8. 89 (1956), C. A. Spindt, "Physical Properties of thin-film field emission cathodes with molybdenum cone", J. Appl. Phys., 47, 5248 (1976), etc.

A typical example of the construction of the FE type device is the device of C. A. Spindt et al., shown in FIG. 34. In FIG. 34, reference numeral 310 denotes a substrate; reference numeral 311, an emitter wiring comprising a conductive material; reference numeral 312, an emitter cone; reference numeral 314, a gate electrode. In this FE type device, an appropriate voltage is applied between the emitter cone 312 and the gate electrode 314 to emit electrons from the tip of the emitter cone 312.

Another example of the construction of the FE type device does not have such a laminated structure as shown in FIG. 34, but comprises an emitter and a gate electrode which are provided on a substrate in substantially parallel with the plane of the substrate,.

A known example of the MIM type device is the device disclosed in C. A. Mead, "Operation of tunnel-emission devices", J. Appl. Phys., 32, 646 (1961), etc.

FIG. 35 shows a typical example of the construction of the MIM type device. In FIG. 35, reference numeral 320 denotes a substrate; reference numeral 321, a lower electrode made of a metal; reference numeral 322, an insulating thin layer having a thickness of about 100 angstroms; reference numeral 323, an upper electrode made of a metal and having a thickness of about 80 to 300 angstroms. In the MIM type device, an appropriate voltage is applied between the upper and lower electrodes 323 and 321 to emit electrons from the surface of the upper electrode 323.

The above-described cold-cathode device can emit electrons at a relatively low temperature and thus does not require a heater, as compared with the hot-cathode device. Therefore, the cold-cathode device has a simpler structure than the hot-cathode device, thereby permitting the formation of a fine device. Even when many cold-cathode devices are arranged on a substrate with a high density, the problem of heat-melting the substrate less occurs. Also, the cold-cathode device has the advantage of a high response speed, while the hot-cathode device has a low response speed because it is operated by heating with a heater.

Therefore, applications of the cold-cathode device have been actively studied. For example, of the cold-cathode devices, the surface conduction-type emission device has the simplest structure, and thus it can easily be manufactured. Therefore, the surface conduction-type emission device has the advantage that many devices can be formed over a large area. For example, as disclosed by the applicant of this application in Japanese Patent Laid-Open No. 64-31332, a method for driving an arrangement of many devices is studied.

With respect to applications of the surface conduction-type emission device, for example, a so-called image forming apparatus such as an image display device, an image recording device, and the like, a charge beam source, etc. have been studied. Particularly, as an application to the image display device, an image display device is studied, which comprises a combination of a surface conduction-type emission device and a fluorescent material, which emits light due to electron collision, as disclosed in, for example, U.S. Pat. No. 5,066,883 and Japanese Patent Laid-Open Nos. 2-257551 and 4-28137 which relate to the applicant of this application. In the image display device comprising a combination of the surface conduction-type emission device and the fluorescent material, excellent characteristics are expected, as compared with conventional other-system image display devices. For example, the image display device comprising the surface conduction-type emission device and the fluorescent material is excellent in that a back light is not required because it is a self-emission type, and the angle of view is wider than liquid crystal display devices which have recently been popularized.

A method of driving an arrangement of many FE-type devices is disclosed in, for example, U.S. Pat. No. 4,904,895 relating to the applicant of this application. A known example of applications of the FE type device to image display devices is the flat-panel image display device reported by R. Mayer [R. Meyer, "Recent Development on Microtips Display at LET1", Tech. Digest of 4th Int. Vacuum Microelectronics Conf., Nagahama, pp. 6–9 (1991)].

An example of application of the MIM type device to an image display device comprising an arrangement of many MIM devices is disclosed in Japanese Patent Laid-Open No. 3-55738 related to the applicant of this application.

Of the image display devices using the above-described electron emitting devices, a thin flat-panel image display device is a space-saving type and lightweight, and is thus attracted as a substitute for the cathode-ray tube image display device.

Thus, a flat-panel image display device is proposed, in which an electron source comprising the above electron emitting devices arranged in a matrix is contained in an airtight container. The airtight container is formed by sealing the peripheries of a faceplate on which a fluorescent material is arranged, and a rear plate on which the electron source is arranged, both of which are opposite to each other.

The inside of the airtight container is maintained in a vacuum of about $10^{-4}$ Pa, and the image display device requires means for preventing deformation or breakage of the rear plate or the faceplate due to a difference between the pressure in the airtight container and the atmospheric pressure as the display area increases. Therefore, a structural support (referred to as a "spacer or rib") comprising a relatively thin glass plate and withstanding the atmospheric pressure is provided between the rear plate and the faceplate.

A method of producing a spacer between a pair of substrates which constitute an image forming apparatus is disclosed in, for example, U.S. Pat. Nos. 4,923,421, 5,063,327, 5,205,770, 5,232,549, 5,486,126, 5,509,840, and 5,721,050, EP-A-0725416, EP-A-0725417, EP-A-0725418, EP-A-0725419, etc.

SUMMARY OF THE INVENTION

However, the image forming apparatus and flat-panel display using the above spacer has the following problems.

First, the electrons emitted from the electron emitting device near the spacer adhere to the spacer, or ions ionized by the action of the emitted electrons adhere to the spacer to possibly charge the spacer. Therefore, the orbits of the electrons emitted from the electron emitting device are bent due to charge of the spacer, and thus the electrons reach positions deviated from normal positions on the fluorescent material provided on the faceplate, thereby displaying a distorted image near the spacer.

Secondary, a high voltage Va of several hundreds V or more (for example, a high electric field of 1 kV/mm or more) is applied between the rear plate and the faceplate to accelerate the electrons emitted from the electron emitting device, thereby causing a fear of creeping discharge on the surface of the spacer. Particularly, when the spacer is charged as described above, there is the probability that discharge is induced.

In order to solve these problems, it is proposed that a small current is passed through the spacer to remove charge (Japanese Patent Laid-Open Nos. 57-118355 and 61-124031). In this case, an electrically high-resistance film (referred to as a "high-resistance film" hereinafter) is formed on a surface of a spacer base member so that a small current flows in the spacer surface. The high-resistance film used in this method comprises a metal film such as a tin oxide thin film, or tin oxide-indium oxide liquid crystal thin film, or the like.

However, in some types of images, i.e., in cases in which the driving pulse width is increased to increase the amount of the electrons emitted, the distortion of an image cannot be sufficiently decreased only by the method of removing charge by using the high-resistance film. This causes insufficient electric coupling between the high-resistance film and upper and lower substrates, i.e., between the face plate (referred to as "FP" hereinafter) and the rear pate (referred to as "RP" hereinafter), and thus a nonuniform distribution of resistance values including contact resistance occurs near the junction between both plates. As a result, the potential near the contact portions of the spacer changes to decrease the linearity of the electric field gradient of the side surface, thereby deviating the orbits of the emitted electrons away from the desired positions. This failure in potential control significantly influences the vicinity of the cathode because of its low electron kinetic energy.

In order to solve this problem, it is proposed that a low-resistance film (electrode) 25 with resistance lower than a high-resistance film 22 is provided on the end surfaces of an insulating spacer base member 21 which is in contact with a faceplate 17 and/or a rear plate 11, and the side surfaces of the space base member 21, as shown in FIG. 16. This method can ensure electric contact between the upper and lower substrates 17 and 11 and the high-resistance film 22. FIG. 16 shows an example in which the low-resistance film (electrode) 25 is arranged on the end surfaces (contact surfaces) 24 in contact with the faceplate 17 and the rear plate 11. FIG. 16 is a sectional view taken along a plane perpendicular to the plane direction of the rear plate, which includes the spacer.

On the other hand, the above two problems can be suppressed by setting Va to a low value or controlling the shape of the side surfaces of the insulating spacer base member 21 to expose the insulator to a vacuum without providing the high-resistance film 22. However, even in this case, when the potential of the end surfaces of the insulating spacer base member 21 is not defined, the orbits of the emitted electrons are changed in some cases. Therefore, even when the insulating spacer is provided between the faceplate and the rear plate, the electrode (low-resistance film) 25 must be arranged on at least one end surface of the spacer, as shown in FIG. 14. FIG. 15 is a sectional view taken along line A—A in FIG. 16, schematically showing the plate-shaped spacer base member 21. FIG. 8 is a perspective view showing the cylindrical spacer base member 21. In the cylindrical spacer base member 21, the diameter R of the cylinder corresponds to the length L and the thickness D of the plate-shaped spacer base member.

In addition, the term "spacer" is properly used with the term "spacer base member" here. The "spacer base member"

means a member in which a film (for example, the high-resistance film 22 and the low-resistance film 25) is provided on the surfaces thereof, as shown in FIG. 16. The "spacer" is a general term for members provided for supporting the space between the faceplate and the rear plate, and comprises at least the spacer base member and the film (the low-resistance film (electrode)).

Japanese Patent Laid-Open No. 8-180821 and U.S. Pat. Nos. 5,561,343, 5,614,781, 5,675,212, 5,746,635, 5,742,117, and 5,777,421, and W094/18694A, W096/30926A, W098/02899, W098/03986A, and W098/28774A disclose that a metal or a high-conductivity material is formed on the end surfaces of a spacer.

The above publications disclose a method of forming a low-resistance film of a metal or a high-conductivity material on an end surface of a spacer by any one of various methods such as sputtering deposition, resistance-heating evaporation, coating, dipping, printing, and the like. Of these forming methods, the coating, dipping and printing methods (liquid phase forming method) comprising coating a liquid to the spacer base member and then baking the coating are preferred because the low-resistance film (electrode) 25 can easily be formed at low cost.

However, the use of the liquid phase forming method for forming the low-resistance film (electrode) 25 on the spacer base member 21 causes the following problem.

In the use of the liquid phase forming method, the deposition conditions for the low-resistance film (electrode) 25 greatly depend upon the surface shape of the space base member 21.

Particularly, when the spacer base member 21 has a shape in which the corners are substantially right-angled, the low-resistance film (electrode) 25 is unsatisfactorily formed at the corners in some cases. Specifically, the shape accuracy of the liquid phase film greatly depends upon the wettability of the spacer base member with the low-resistance film material, and thus the end position of the low-resistance film rises to $h^1$ higher than the desired position $h^0$ due to the influences of surface contamination of the spacer base member and a variation in the shape near the end surfaces thereof, as shown in FIG. 4A. As a result, the heights of the anode potential and the cathode potential are changed to lose the linearity of an electric field near the contact portions between the spacer 21 and/or the rear plate 11 and the faceplate 17, thereby deviating the electron orbit away from the desired orbit.

From the viewpoint of a decrease in formation cost, U.S. Pat. No. 5,811,927 discloses a method of bundling a plurality of spacer base members, and then forming a low-resistance film in order to permit batch processing of a plurality of spacers. When this method is applied as a pre-step of the liquid phase method, spaces partially occur between the bundled spacers, as shown in FIG. 4B. In this case, the liquid phase forming material leaking in the spaces significantly rises due to a meniscus phenomenon to extend the end of the low-resistance film to the position h2.

Furthermore, when a cylindrical spacer, a columnar spacer having a polygonal sectional shape, or a plate-like spacer having uneven side surfaces is used as the spacer base member, as shown in FIGS. 5A and B, it is very difficult to remove the spaces between the bundled spacers. Therefore, a new method is required for forming a low-resistance film on required portions of the bundled spacer base members.

An object of the present invention is to realize a method capable of precisely and efficiently forming a film on a spacer base.

Specifically, an object of the present invention is to provide a method of forming a low-resistance film (electrode) on a spacer base member without causing the above-described problems in forming the low-resistance film (electrode) at the ends of the spacer base member by using the liquid phase forming method.

In accordance with an aspect of the present invention, there is provided a method of producing a spacer provided between a first substrate and a second substrate on which an electron emitting device is arranged, the method comprising the step of forming a film on at least a portion of at least one surface of the spacer, wherein the film forming step comprises the step of preparing a bundle of a plurality of spacer base members, and the step of providing a film material on the bundle, and wherein the bundle on which the film material is provided has a mask layer for covering at least a film non-formation portion near a film formation portion of each of the plurality of spacer base members of the bundle. Here, "the film formation portion" means the portion where the film material should be provided.

In this construction, the film non-formation portion is covered with the mask layer to permit the appropriate formation of a film even when a variation occurs in the conditions of providing the film material on the plurality of spacer base members which constitute the bundle. For example, in providing the film material on the bundle, there are the spacer base members in which the film material easily contacts the portions other than the film formation portion. In this case, when contact between the film non-formation portion and the film material is inhibited, contact between the film formation portion and the film material is liable to be insufficient. On the other hand, when the film material is sufficiently put into contact with the film formation portion, contact between the film non-formation portion and the film material causes a problem. The present invention is particularly effective to such a case. For example, a case in which the film material is provided on the bundle by the dipping method is considered. In this case, when the film formation portions of the respective spacer base members do not lie in the same plane, when the surface level of the film material varies, and when there is a sufficient space where the meniscus phenomenon of the film material occurs between the spacer base members, the film material is adhered to different regions of the spacer base members of the bundle in dipping of the bundle in the film material. The present invention can desirably form a film when a variation occurs in the conditions for providing the film material on the plurality of the spacer base members of the bundle. In a construction using an electron emitting device, a variation in the film formation portions of the spacers causes a variation in the electron orbits. The present invention can produce a spacer suitably used for the construction using the electron emitting device.

In the present invention, the mask layer is preferably formed on a surface of the spacer base member between the bundled spacer base members, wherein the surface of the spacer base member will be supposed to face a surface of the adjacent spacer base member each other when the plurality of the spacer base members are bundled. This is because it is difficult to control the conditions for providing the film material on a surface of the spacer base member between the bundled spacer base members, wherein the surface of the spacer base member will be supposed to face a surface of the adjacent spacer base member each other when the plurality of the spacer base members are bundled.

When the film formation portion is located in a contact surface of the spacer which is in contact with the first substrate or a contact member (wiring, an electrode, or the like) nearer to the first substrate than the spacer, or the second substrate or a contact member (wiring, an electrode, or the like) nearer to the second substrate than the spacer, electron emission is greatly influenced by the precision of film formation, particularly the degree of extension of the film formation portion to the side surfaces of the spacer. Therefore, the present invention can be particularly preferably applied to this case.

Particularly, when the film is a low-resistance film, or when the film is electrically connected to an electrode and wiring so that a potential is applied to the film, the present invention can be effectively used. Particularly, when the film has a sheet resistance value of $1\times10^7$ Ω/□ or less, the present invention can preferably be used.

The mask layer is preferably removed when it becomes unnecessary. Specifically, the mask layer can be removed by etching. In order to preferably remove the mask layer by etching, the material and etching conditions are preferably set so that the spacer base member and the film are different in etching resistance (resistance to an etchant) from the mask layer.

Although various mask layers can be used, a mask layer which adheres to the spacer base member is preferably used for preventing adhesion of the film material to the spacer base member.

In forming the mask layer on the film non-formation portion, the mask layer is also formed on the film formation portion so that the mask can easily be formed. In this case, the mask layer formed on the film formation portion is removed before the film material is provided. This step is the step of removing the mask layer formed on the film formation portion without removing the mask layer formed on the film non-formation portion, and thus it may be called a "partially removing step". The step of removing the mask layer before the step of providing the film material can be performed after the bundle is prepared, or performed for a plurality of spacer base members before the bundle is formed.

The step of removing the mask before the step of providing the film material can be preferably performed by physical removal. For example, the step can preferably be performed by filing or blasting.

In the present invention, a certain variation in the conditions for providing the film material on the respective spacer base members of the bundle is allowable, but the film formation portions of the respective spacer base members of the bundle are preferably located on substantially the same plane.

When the film is not completely formed only by providing the film material on the spacer base members, the step of completely forming the film is performed based on the film material. Specifically, the step of heating the film material can be preferably used. Particularly, the step of drying and/or baking the film is preferably used.

The present invention can preferably be applied to a case in which the surfaces of the spacer base members have unevenness. Also, the present invention can preferably be used for a case in which each of the spacer base members has a columnar shape.

In another aspect of the present invention, there is provided a method of manufacturing an image forming apparatus comprising a first substrate on which an image forming member for forming an image by electron irradiation is provided, a second substrate on which an electron emitting device is provided, and a spacer provided between the fist and second substrates, wherein the spacer is produced by the above-described method of producing a spacer.

For the image forming member, a fluorescent material which emits light by electron irradiation can preferably be used.

The present invention has the following effects.

The image forming apparatus using the spacer can realize high-quality display, i.e., the above-described production method can improve the shape and precision of the low-resistance film, thereby providing a spacer having suppressed beam deviation and discharge, and an image forming apparatus using the spacer.

The present invention has the second effect of obtaining high material selectivity. Namely, the production method can prevent rising of the coated liquid material, and thus makes control of wettability unnecessary or easy, thereby widening the range of selection of the base material and the liquid phase film material.

Furthermore, the geometrical requirement of the contact surfaces of the spacers, i.e., the surfaces on which the low-resistance electrode is formed, makes a patterning work substantially unnecessary. From this viewpoint, high precision and low cost can be satisfied to realize many effects, as described below. The geometrical requirement of the electrode forming surfaces means that the single spacer or a plurality of spacers arranged in the same image forming apparatus generally have a plane or common plane perpendicular to the atmospheric resistance axis.

Namely, the present invention has the third effect of permitting the step of patterning the low-resistance film formation region in a self-alignment manner by utilizing the planarity and perpendicularity of the contact surfaces. Particularly, an optical patterning method such as photolithography and an alignment work are unnecessary, and thus films (high-resistance film) on the contact surfaces of the spacers can be easily removed by a so-called physical processing method of rubbing the contact surfaces with a file in contact with the surfaces in a self-alignment manner.

Furthermore, a plurality of spacers can be bundled so that the contact surfaces lie in the same plane, thereby realizing the following effects.

The present invention has the fourth effect of permitting self-alignment coating of the low-resistance film. Namely, by forming the low-resistance film on the connected end surfaces of the spacers, the low-resistance film can be formed on many spacers at a time by using a low-cost liquid phase forming method such as dipping or the like.

The present invention has the fifth effect of widening the selectivity of the method of removing or pattering the mask layer. Namely, when the patterning step is performed for the bundled spacer base members, many formation surfaces can be formed at the same time, and not only filing but also sand blasting can be used as physical removal means because the non-formation portions of the respective spacers are masked with each other. This method can be easily applied to a step requiring a conventional pattern mask.

The present invention has the sixth effect of simplifying handing. From the viewpoint of the relation between electrical voltage resistance and the spaces between respective pixels, each of the spacers generally has a height/thickness ratio, i.e., an aspect ratio, of about 10:1 or more, and has a thin columnar structure or a thin plate structure. In some cases, in order to fix the spacers out of the image region and hold the number of the spacers assembled down, the spacers are longer than the image region to further increase the aspect ratio of the spacer base members, thereby causing the problem of chipping or breaking the spacer base members during handling in the production process. However, in the production method of the present invention, by bundling the spacers, the aspect ratio of a work can be decreased as a whole to obtain the effect of decreasing breakage of the spacers during handling.

Furthermore, in roughening the side surfaces of the spacer base members in order to suppress charging, the shape of fine irregularity is chipped during handling in some cases. However, in the production method of the present invention, by bundling the spacers, the irregular modified surfaces of the adjacent spacers are protected (shielded or masked) by each other through the mask layers during the time of handling of the bundled spacers, thereby obtaining the effect of preventing chipping of the irregular structure.

As described above, in the production method of the present invention, bundling the spacer base members can inhibit chipping of the spacer base members in handling in the production process to avoid discharge from the chipped portions, thereby providing a high-quality image display device.

The present invention has the seventh effect of improving low precision of the liquid phase film due to a meniscus. Namely, with the columnar spacers or spacers having uneven side surfaces which face each other when the spacers are bundled, it is difficult to remove the spaces between the bundled spacers. If the low-resistance film is formed on the contact surfaces of the bundled spacers with the spaces therebetween, the low-resistance film material flows into the spaces to deteriorate the formation precision of the low-resistance film, thereby causing deviation of an emitted beam. However, in the production method of the present invention, even if the spaces are present between the bundled spacers, the outer surfaces of the spacers are masked with the mask layers, and thus the low-resistance film material flowing into the spaces is finally removed together with the under mask layers in the step of removing the mask layers, thereby preventing the occurrence of the above problem.

It is important to perform the step of bundling the spacers before the step of coating the low-resistance film, but the bundling step may be performed either before or after the step of partially removing the mask layers. However, when the fifth and sixth effects are desired, the bundling step is preferably performed before the step of partially removing the mask layers.

In the above-described production method, the low-resistance film (electrode) can be uniformly and precisely formed on the end surfaces (contact surfaces) of the spacer base members at low cost by the liquid phase forming method. As a result, it is possible to obtain a high-quality image forming apparatus which has the stable orbits of the electrons emitted from the electron emitting device and no useless discharge and which can display a good image for a long time.

In the bundling step, the spacer base members are preferably bundled in either of the two directions below or a combination of the two directions.

One of the bundling directions is a "parallel bundling direction" in which the adjacent spacer base members have parallel lines normal to the same end surfaces. The other direction is an "antiparallel bundling direction" in which the adjacent spacer base members have parallel lines normal to the opposite end surfaces.

When the end surfaces of the spacer base members have a trapezoidal sectional shape, the "antiparallel bundling direction" is preferred.

In bundling the spacer base members, besides the method of bundling the spacers through the mask layers, the spacer base members may be bundled through an appropriate jig.

Further objects, features and advantages of the present invention will become apparent from the following description of the preferred embodiments (with reference to the attached drawings).

DESCRIPTION OF THE PREFERRED EMBODIMENTS

Embodiments of the present invention will be described in detail below with reference to the drawings. First, a spacer base member 21 as a component of an image forming apparatus is describe below with reference to FIG. 1, in which a mask layer is coated and patterned on the spacer base member 21, and then an electrically low-resistance film (electrode) 25 is formed on the end surfaces (contact surfaces) 24 of the spacer base member 21.

Figure 2A:
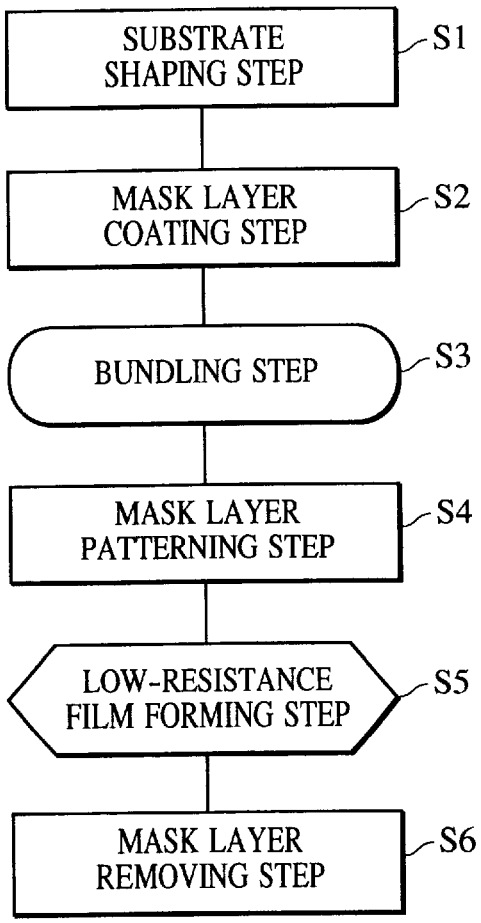
FIG. 2A is a drawing illustrating a spacer production process in accordance with an embodiment of the present invention.
Figure 2B:
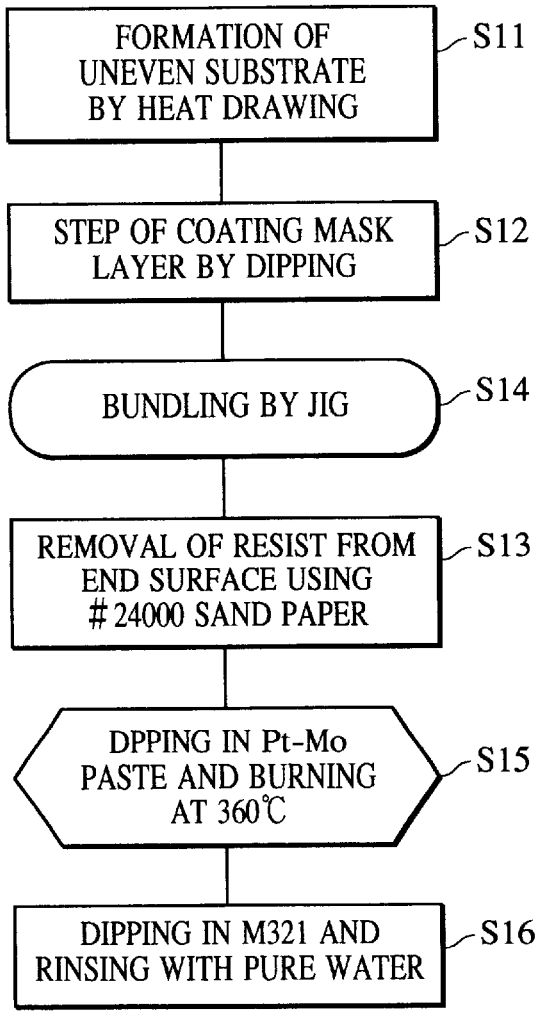
FIG. 2B is a drawing illustrating the low-resistance film forming step.

Therefore, an example of the procedure of the method of producing a low-resistance film of the present invention is schematically shown in FIGS. 2A and 2B. The procedure shown in FIG. 2A comprises the first step S1 of shaping a substrate by mechanical processing (for example, a spacer base material is cut out from a plate raw material by a cutting work), the second step S2 of coating a mask layer on the surfaces of the spacer base material, the third step of bundling many spacer base materials so that the patterned surfaces of the spacer base materials lie in the same plane before patterning, the fourth step S4 of patterning the mask layers to remove the mask layers from the patterned surfaces, the fifth step S5 of forming an electrically low-resistance film on the surfaces from which the mask layers are removed, and the sixth step S6 of removing the mask layers from the surfaces of the spacer base materials.

Figure 3A:
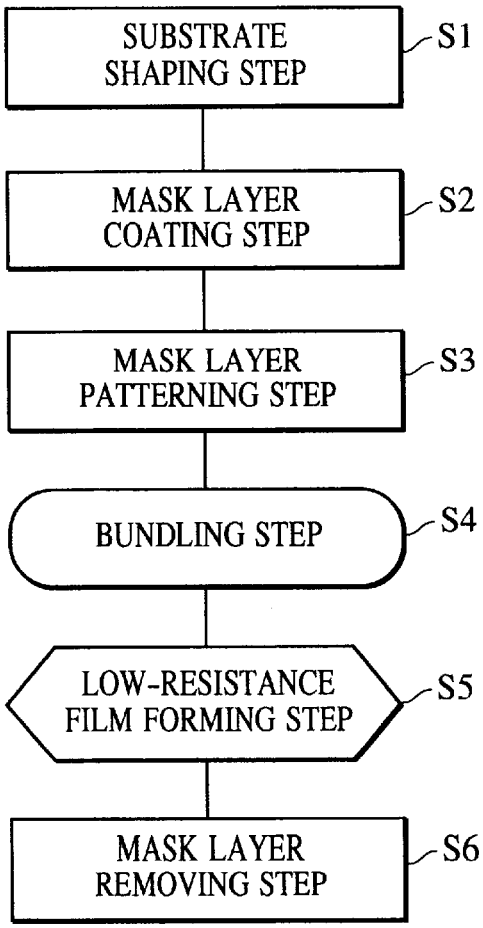
FIG. 3A is a drawing illustrating a spacer production process in accordance with another embodiment of the present invention.

The procedure shown in FIG. 3A is different from the procedure shown in FIG. 2A in that the third bundling step S3 and the fourth mask layer pattering step S4 are reversed. In the procedure shown in FIG. 3A, the mask layer is removed from each of the spacer base material before bundling, and then the spacer base materials are bundled so that the patterned surfaces lie in the same plane, followed by the formation of the low-resistance film.

The present invention is not limited to these procedures, and of course, modification can be made within the scope of the claims of the present invention.

The low-resistance film (electrode) 25 of the present invention is preferably formed by a liquid phase forming method using a liquid containing a conductive material in order to improve the utilization ratio of a raw material, and decrease the cost of the production process. In the present invention, the liquid phase forming method is performed in accordance with any one of the first to fourth embodiments below to permit the efficient and precise formation of the low-resistance film on the end surfaces (contact surfaces) of the spacer base member 21.

In the first embodiment, the previously coated mask layer is patterned (removed) in the region in which the low-resistance film 25 is formed. The process for forming a liquid phase film uses a simple method without using a special patterning step.

In the second embodiment, the step of patterning the mask layer, i.e., the step of partially removing the mask layer, comprises partially removing the mask layer from the desired regions (contact surfaces) by physical means without using a conventional optical patterning means. In this step, only the end surfaces (contact surfaces) are processed in a self-alignment manner by a removal method such as filing or sand blasting.

In the third embodiment, in the step of pattering the mask layer (refer to FIG. 2A) or the low-resistance film forming step (refer to FIG. 3A), the spacer base members 21 are bundled so that the side surfaces face each other and the contact surfaces 24 lie in the same plane, and the low-resistance film formation regions are connected and integrated, and thus handled as one work, thereby permitting the low-resistance film 25 to be formed on the plurality of spacer base members 21 at a time. This method comprises bundling the spacer base members, and thus has the function that the side surfaces of the non-formation regions of the adjacent spacer base members are masked by each other to support the mask function of the mask layers.

In the fourth embodiment, the dipping process described below is used as the liquid phase forming method.

In the present invention, the liquid phase forming method comprises coating a liquid containing the conductive component material of the low-resistance film 25 dispersed or dissolved therein on the end surfaces (contact surfaces) of the spacer base member 21, and then baking the coated material to form the low-resistance film (electrode) 25.

The first embodiment is described below. The step of coating the mask layer on the spacer base member 21 and the step of partially removing the mask layer (patterning step) are performed as a pre-process of the low-resistance film forming step, thereby making the subsequent step of precisely patterning the low-resistance film 25 unnecessary. In order to obtain the above function, a general material can be used for the mask layer, but the material is not limited as long as the requirements (a, b and c) below are satisfied. Namely, various organic materials and inorganic materials can be used.

(a) The mask layer can be selectively separated from the low-resistance film 25.

(b) The mask layer comprises a continuous non-porous film.

(c) The mask layer is not eluted with a coating material for forming the low-resistance film.

From the viewpoint of promoting permeation of a material for removing the mask layer into the mask layer, a material which can produce a porous film having fine voids or grain boundaries is preferably used as the material for the low-resistance film.

Since an optical process need not be used for patterning, a photosensitive resist need not be used to increase the freedom of selection of the mask layer material. The use of a resist not photosensitive has the advantage that atmospheric control such as light shield or the like is not required.

Next, the second embodiment is described below. Patterning of the mask layer is performed in order to define the desired regions (the contact surfaces 24 of the spacer) to precisely define the shape of the low-resistance film 25, and simplify the low-resistance film forming process. As the removal means which exhibits the above function, chemical and photochemical removal means including etching can be used. However, physical removal means can be effectively used by positively employing the contact surfaces 24, i.e., the geometrical requirement of the spacer base member.

In the present invention, as the effective physical means for removing the mask layers, filing using friction, blasting of particles, or the like is preferred as a simple method.

The third embodiment will be described below. In bundling the spacer base members 21 and then forming the low-resistance film 25 on the spacer base members 21 by the liquid phase forming method, a material for the low-resistance film, which permeates into the spaces, generally causes the problem of deteriorating the formation precision of the low-resistance film. However, in the production method of the present invention, even when the coating solution penetrates, the penetrating coated film is finally removed by separating the mask layer, thereby causing no deterioration in the formation precision and ensuring desired formation precision.

Figure 4A:
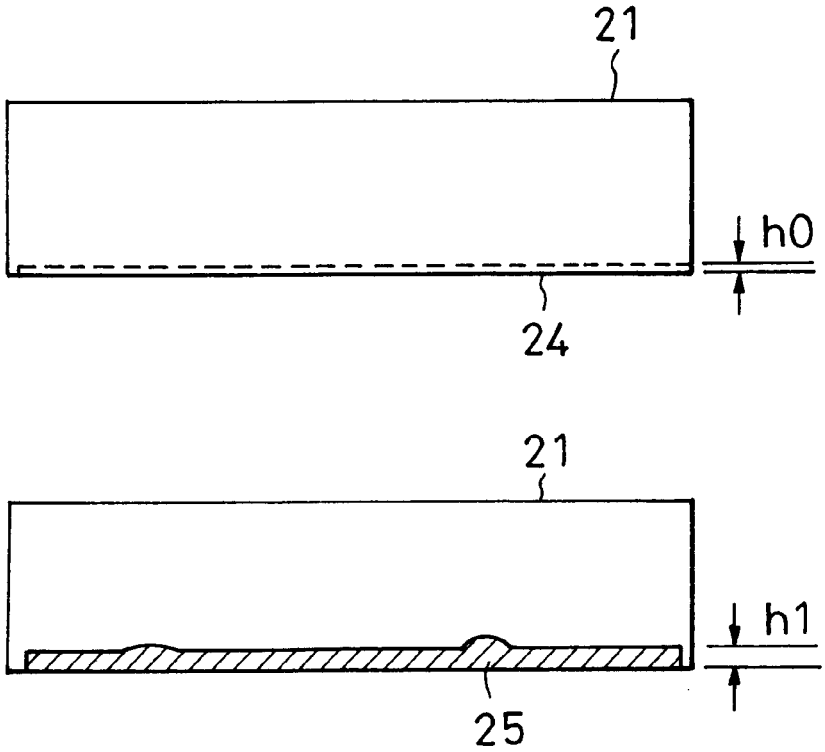
FIG. 4 is a schematic drawing illustrating rising of a low-resistance film formation region due to dipping.
Figure 4B:
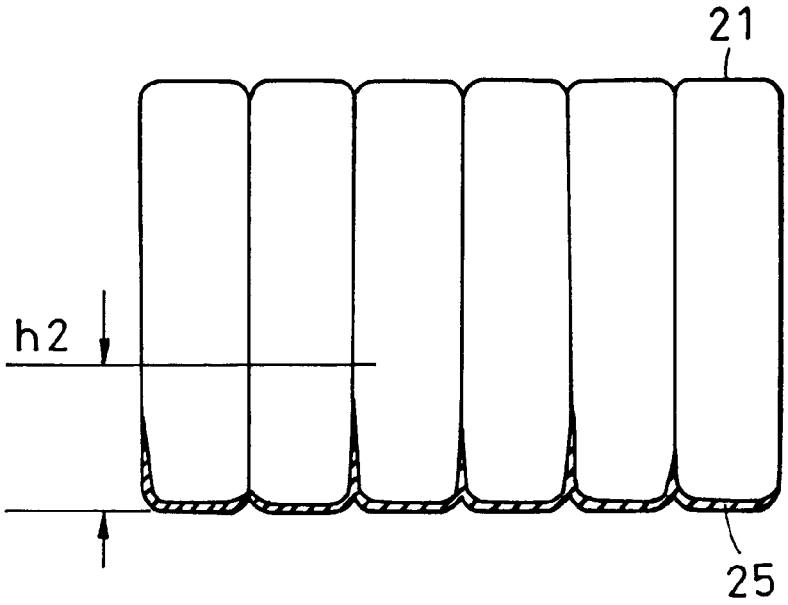

From the above-described viewpoint, the production method of the present invention can be applied to a spacer base member having a shape which principally produces spaces between the respective spacer base members when they are bundled. For example, FIG. 4 shows an example in which the low-resistance film 25 having a thickness of h0 is formed on the contact surface 24 of the spacer base member 21. In this example, the penetrating coated film having a width of h1 to h2 is also formed on the side surfaces of the bundled spacer base members 21. However, the penetrating coated film is removed together with the mask layers.

Other examples of applications include applications to a columnar spacer comprising at least a portion having a polygonal sectional shape, a spacer having uneven side surfaces, etc (refer to FIG. 5). In this embodiment, the polygonal sectional shape means a tetragonal sectional shape excluding a square, a rectangle, a trapezoid, a parallelogram, and a rhomboid, and includes circular, elliptical, star-shaped, cross, and L-shaped sections.

Figure 6A:
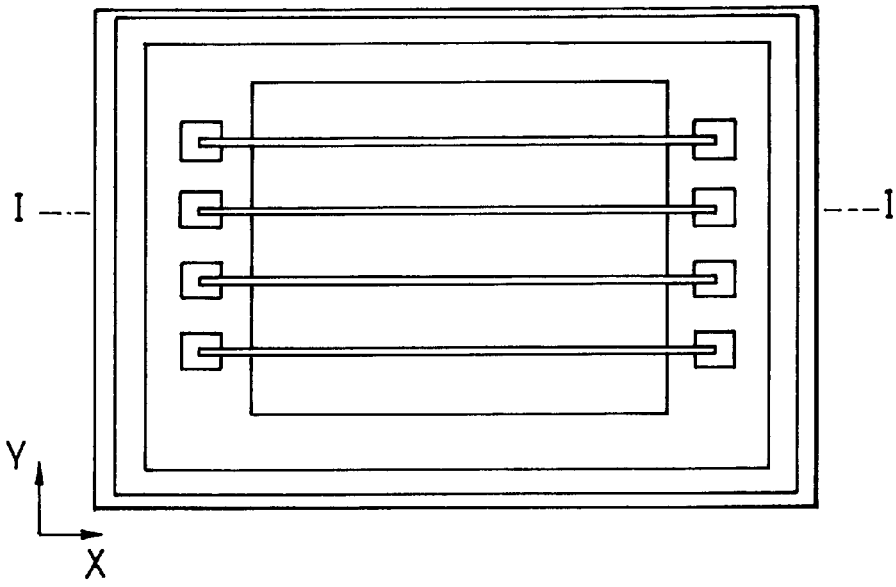
FIGS. 6A and 6B are drawings illustrating the state in which long spacers having low-resistance films formed thereon are mounted on an image forming apparatus.
Figure 6B:
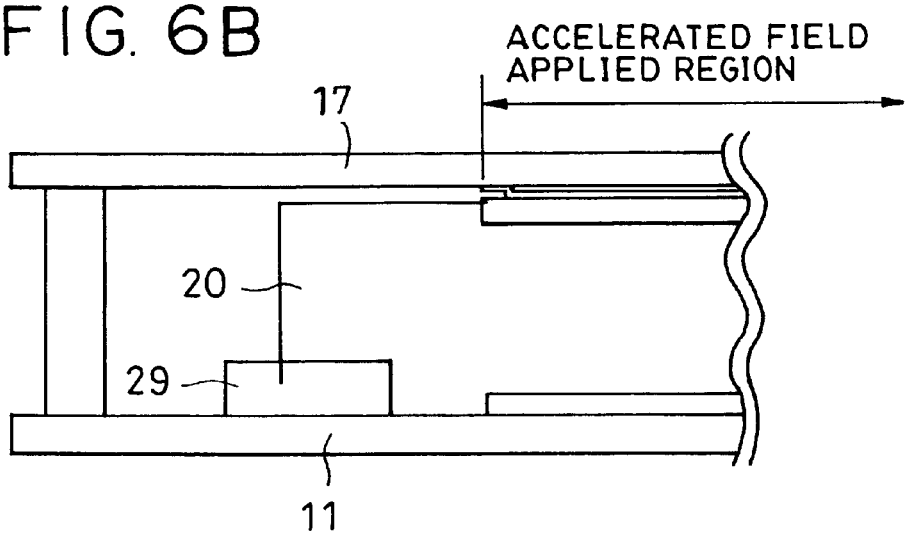

Also, an appropriate fixing method can be selected, in which the spacer base members 21 are elongated to extend to the outside of the image region (accelerated field application region), and fixed only in the region out of the image region. FIG. 6 shows an image forming apparatus in which spacers 20 are provided between a rear pate 11 and a faceplate 17, and supported by supporting members 29. However, the spacer base member 21 used for each of the spacers 20 is elongated, as compared with conventional spacer base members. It is generally difficult to bundle the long spacer base members 21 without the spaces therebetween, but the present invention can ensure effectiveness even when the low-resistance film 25 is formed on the bundled long spacer base members.

Particularly, when a high-resistance film is not formed on the insulating spacer base members 21, triple junctions are possibly formed between a vacuum, the insulator (spacer base member) and the metal (low-resistance film) at the interfaces with the low-resistance film 25. As a result, a discharge phenomenon easily significantly occurs due to the formation of the low-resistance film. In the present invention, the first to third embodiments comprising bundling the spacer base members and then forming the low-resistance film by forming the mask layers are very effective.

As the bundling method, any method can be used as long as a plurality of spacer base members 21 can be bundled so that the contact surfaces 24 thereof are continued in the same plane. A simple and effective method of bundling the plate-shaped spacer base members 21 comprises positioning the contact surfaces by using a flat glass subjected to mirror-polishing, lightly bundling the spacer base members, and then partly holding the largest-area surfaces, i.e., the side surfaces, by using a jig from both sides thereof.

For the columnar spacers, a similar method can be used, in which the contact surfaces are positioned by using a flat glass subjected to mirror-polishing, lightly bundling the spacer base members, and bundling and fastening the central portions of the spacers in the height direction with a band to fix the spacers.

The fourth embodiment is described below. The liquid phase forming method using the dipping process uses the material with a high efficiency and has a constant patterning effect, thereby permitting the formation over a wide area at a time.

An example of the dipping method of the present invention is described with reference to FIG. 7. FIG. 7 is a side view of the spacer base member 21 in which the mask layers formed on the end surfaces are patterned. In this embodiment, dipping is performed by the following steps H to K.

Figure 7A:
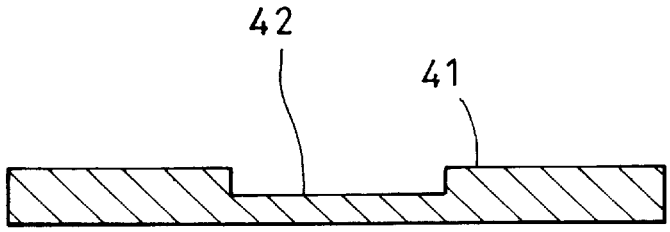
FIG. 7 is a schematic drawing illustrating an example of the method of forming a low-resistance film (electrode) on a spacer base member in accordance with the present invention.
Figure 7B:
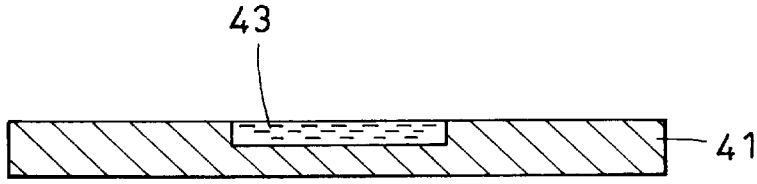

Step H) A liquid 43 in which a conductive material for forming the low-resistance film 25 is dispersed or dissolved is spread on a substrate 41 having an appropriate recessed portion 42 and coated thereon (refer to FIGS. 7A and B).

Figure 7C:
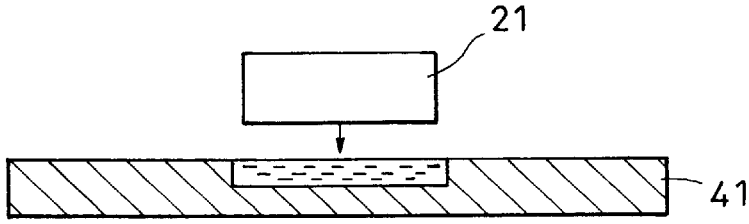
Figure 7D:
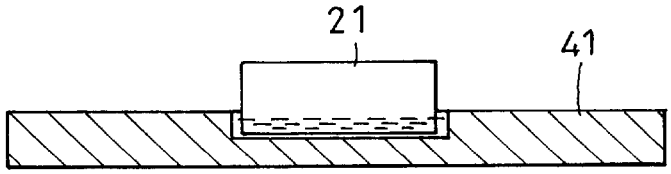

Step I) The end surfaces (the upper and lower contact surfaces shown in FIG. 1) of the spacer base member 21 are brought into contact with the liquid 43 spread on the substrate 41 and dipped therein (refer to FIGS. 7C and D).

Figure 7E:
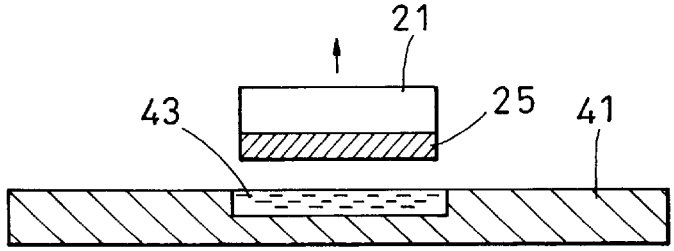

Step J) The spacer base member 21 is separated from the substrate 41 on which the liquid 43 is spread to transfer the liquid 43 as the low-resistance film 25 (refer to FIG. 7E).

Step K) The liquid 25 transferred to the spacer base member 21 is heated to form the low-resistance film (electrode) 25.

In the present invention, the liquid 43 in which the conductive material for forming the low-resistance film 25 is dispersed or dissolved is referred to as the "coating solution".

This dipping method can simply form the low-resistance film (electrode) 25 only on the end surfaces (contact surfaces) 24 of the spacer base member 21. As the means for spreading the coating solution 43 for dipping, a method of spreading the solution by bar coating or using a doctor blade, or spin coating can be used.

The substrate 41 on which the coating solution 43 is spread does not necessarily have the recessed portion, and may be a flat substrate. Furthermore, when the spacer base member 21 is brought into contact with the coating solution 43, the spacer base member 21 may be dropped into the spread solution in the transfer step, as shown in FIG. 7. Conversely, the substrate 41 with the spread solution (in this case, the coating solution 43 is held by the surface of the substrate due to the viscosity) facing downward may be moved downward and brought into contact with the spacer base member 21.

As described above, in any one of the above first to fourth embodiments, the low-resistance film (electrode) 25 can be sufficiently coated on the end surfaces (contact surfaces) of the spacer base member 21 by the simple liquid phase forming method at low cost.

By using glass or ceramic as the material for the above-described spacer base member 21, it is possible to form the spacer 20 which can be easily cut at low cost and which exhibits high assembly strength, and an image forming apparatus using the spacer 20. In the image forming apparatus, from the viewpoint of matching of thermal expansion coefficients, the same material is preferably used for the faceplate, the rear plate and the spacer base member.

When the low-resistance film (electrode) 25 is formed on the end surfaces (contact surfaces) 24 of the spacer base member 21 (refer to FIGS. 1 and 8), each of which has a right-angle or acute-angle edges (corners) 23, by the liquid phase forming method (refer to FIG. 9B and FIG. 10B), the low-resistance film 25 and high-resistance film (formed on the side sides and side end surfaces of the spacer base member 21) are not sufficiently formed at the edges 23, or electrical connection is insufficient. It was thus found from the intensive research performed by the inventors that the above problem could be solved by making the edges 23 obtuse, as shown in FIGS. 9A and 10A.

Figure 1:
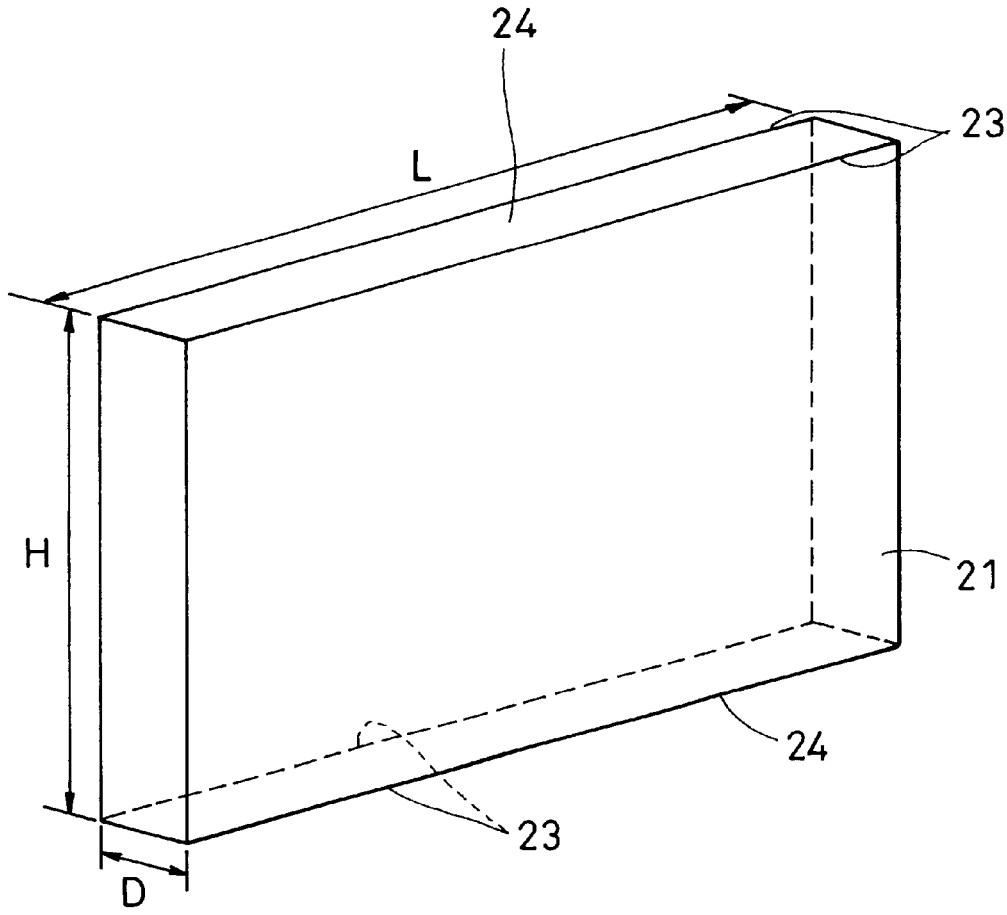
FIG. 1 is a perspective view schematically showing a spacer base member in accordance with an embodiment of the present invention.
Figure 8:
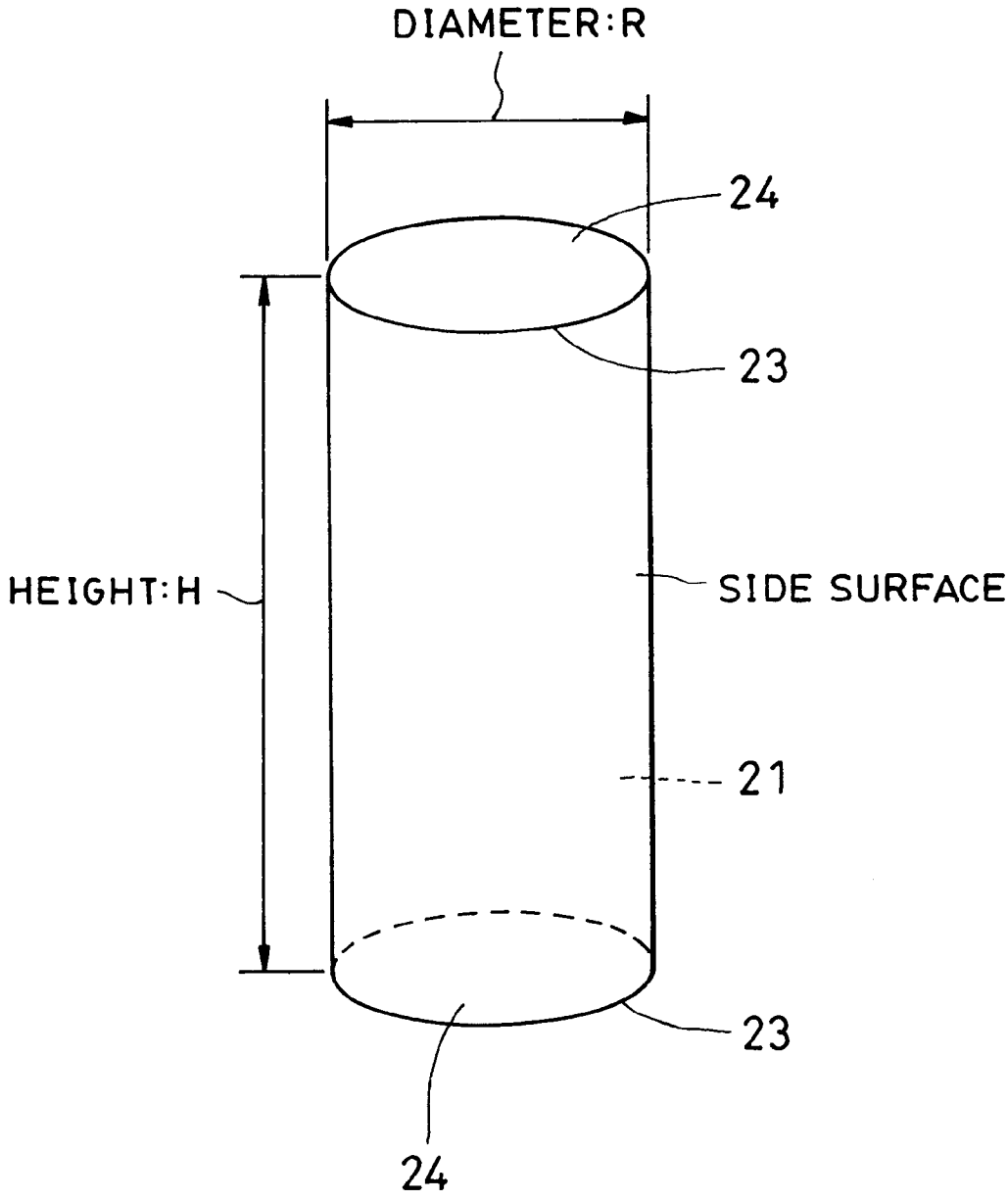
FIG. 8 is a perspective view showing a cylindrical spacer base member in accordance with the present invention.
Figure 10A:
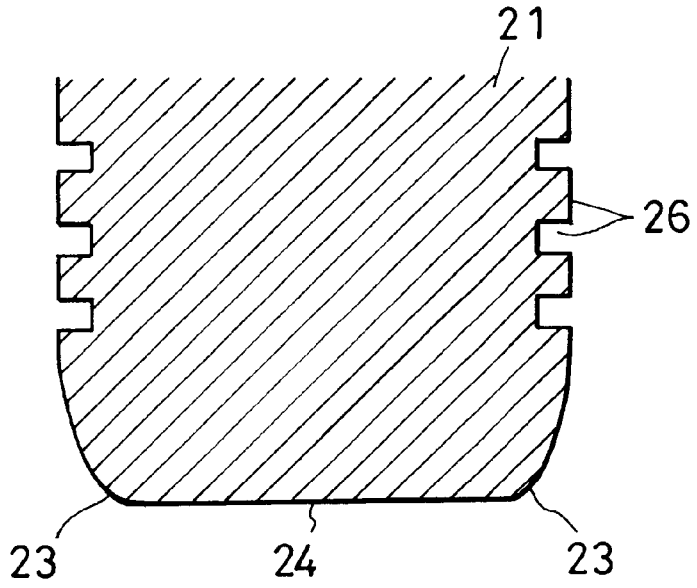
FIGS. 10A and 10B are enlarged sectional views showing the examples of the spacer base member shown in FIGS. 9A and 9B, respectively.
Figure 10B:
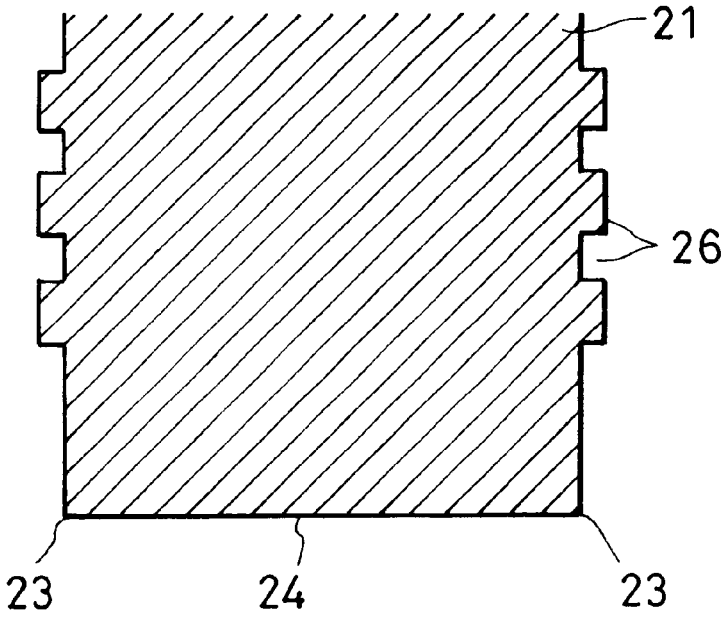
Figure 11A:
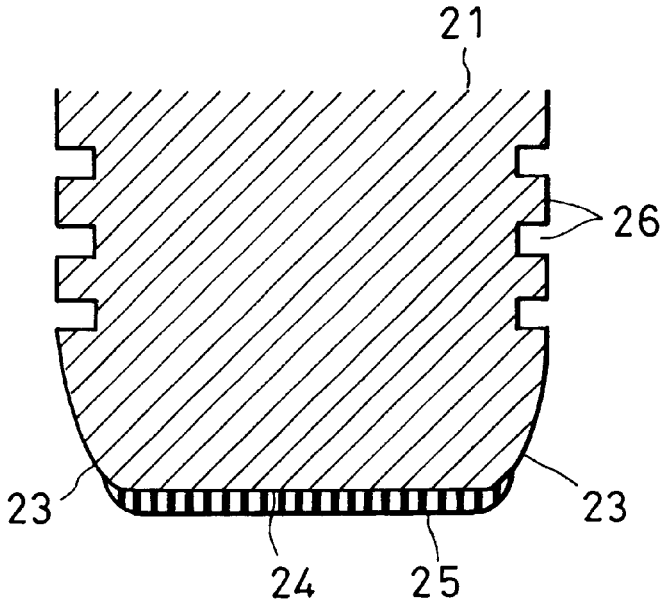
FIGS. 11A and 11B are sectional views showing the vicinities of the contact surfaces of the examples of the spacer base member shown in FIGS. 9A and 9B, respectively, with the low-resistance films coated thereon.
Figure 11B:
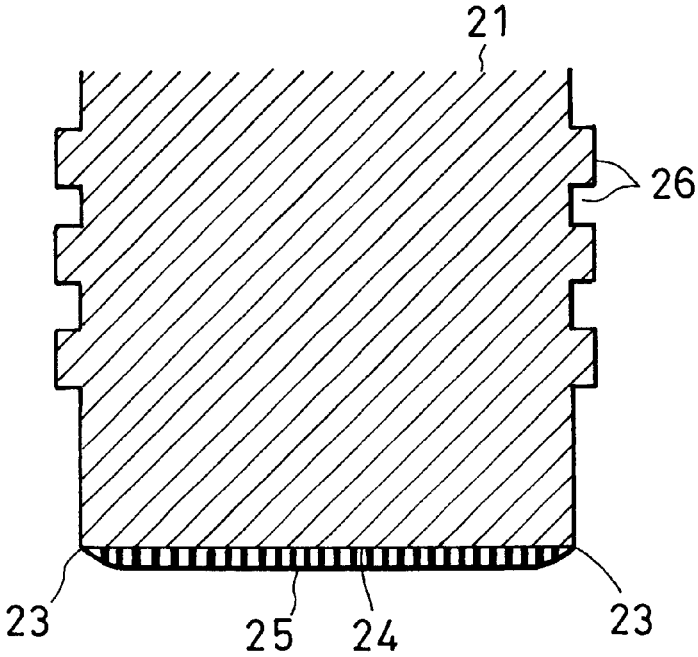

FIG. 11 is a schematic drawing showing the state in which the low-resistance film (electrode) 25 is coated on the end surfaces (contact surfaces) 24 of the spacer base member 21 used in the present invention. Like the end surfaces of the spacer base member shown in FIGS. 9 and 10, FIG. 11 shows the section of one of the end surfaces of the spacer base member 21 taken along the direction perpendicular to the plane of the rear plate (or the faceplate). Namely, when the spacer base member 21 has a plate shape, as shown in FIG. 1, the sectional view (sectional view parallel to the lateral end surfaces) of a portion of the spacer base member 21, which has thickness D (minimum), corresponds to the sectional views of FIGS. 9, 10 and 11. When the spacer 21 has a columnar shape as shown in FIG. 8, the sectional view taken along a vertical plane including the centers of the end surfaces (contact surfaces) 24 of the spacer base member 21 corresponds to the sectional views of FIGS. 9, 10 and 11.

Figure 12:
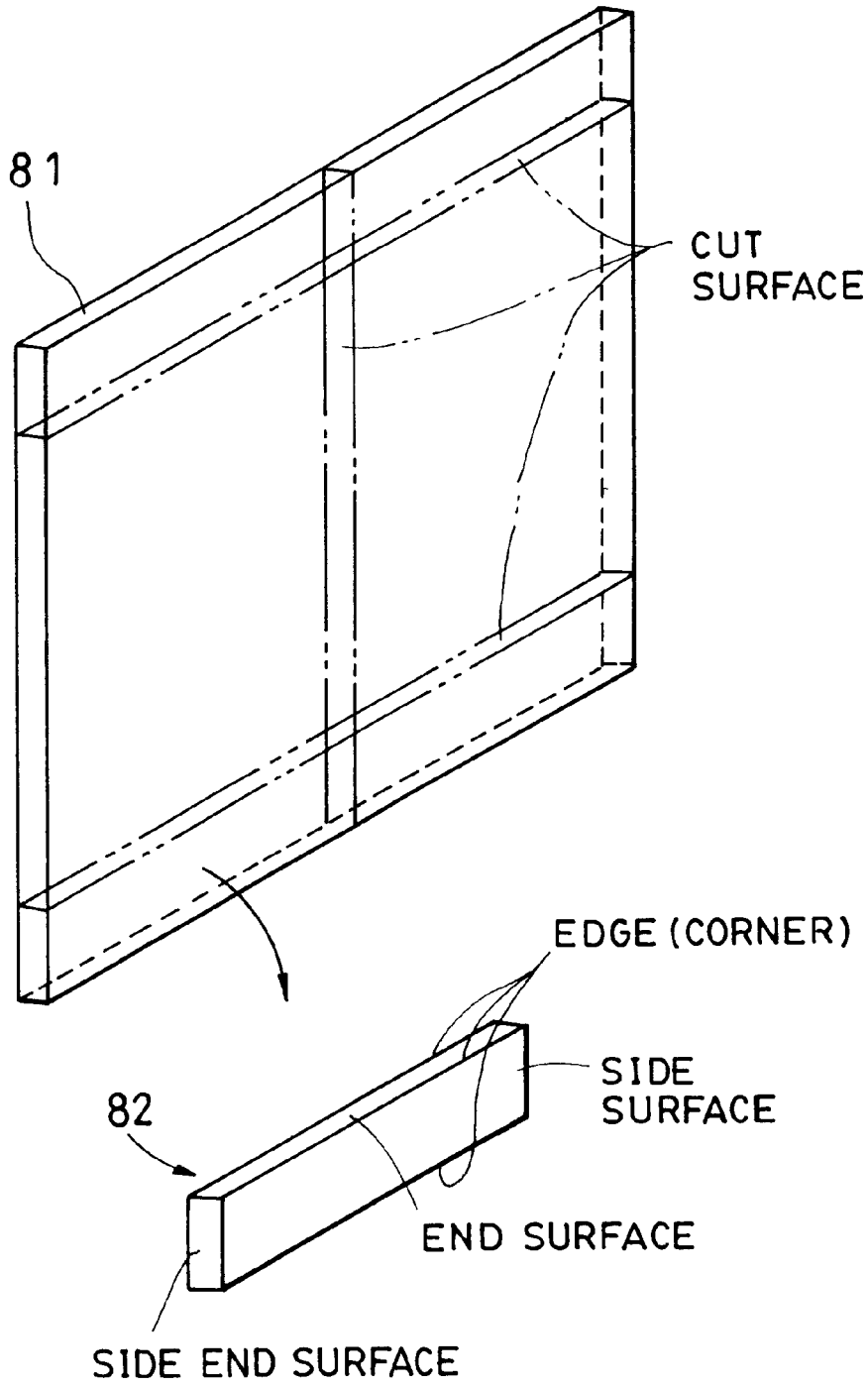
FIG. 12 is a perspective view showing the state in which a spacer base member is cut out from a raw material.

As the means for obtaining the end shape satisfying the above requirements, any means may be used. For example, when the plate spacer base member 21 shown in FIG. 1 is used, a base material (referred to as a "spacer base material" hereinafter) 82 for the spacer base member 21 is cut out from a glass plate (base material) 81 having the same thickness D as the spacer base member 21 by cutting means such as a diamond cutter or the like, as shown in FIG. 12. This cutting method can produce the spacer base material 82 having the same thickness D, height H and length L as shown in FIG. 1.

Figure 9A:
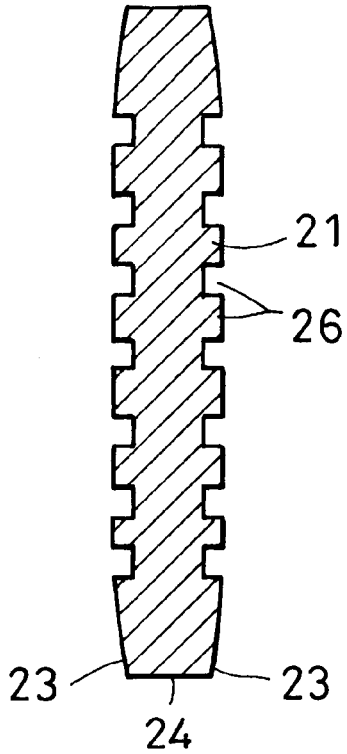
FIGS. 9A and 9B are sectional views respectively showing other examples of the spacer base member used in the production method of the present invention.

Then, the spacer base material 82 is subjected to end processing as shown in FIGS. 9A and FIG. 10A. Specifically, this end processing is processing for forming the circular ends, or tapering the ends (flattening the corners), thereby removing an acute portion from the edges (corners) of the spacer base material 82, i.e., making the corners obtuse. As the means for end processing, sand blasting, laser scribing, water blasting, scribe cutting, polishing, chemical etching with hydrofluoric acid, and the like may be used.

Figure 9B:
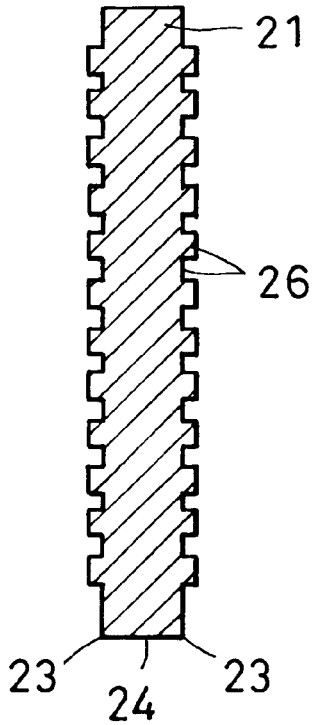

In forming the circular edges of the spacer base material 82 (refer to FIG. 9A and FIG. 10A), the radius of curvature r is preferably in the range of ½ or less of the thickness D of the spacer base material 82, and more preferably $D \times 1/100$ or more (schematically shown in FIG. 9B and FIG. 10B). With this radius of curvature r, the continuity of the low-resistance film (electrode) 25 and the assembly precision of the spacer can be satisfied. The thickness D is preferably 10 $\mu$m to 500 $\mu$m, and more preferably 20 $\mu$m to 200 $\mu$m. Therefore, the radium of curvature r is preferably 0.1 $\mu$m to 250 $\mu$m, and more preferably 0.2 $\mu$m to 100 $\mu$m.

FIG. 11 shows an example (circular ends) of the sectional shape of the spacer which can be used in an embodiment of the present invention, and in which the low-resistance film 25 is coated on the ends. When the spacer base member 21 is made of glass and has such a plate shape as shown in FIG. 1, and such an end shape as shown in FIGS. 9 and 10, it is preferable to use the heat drawing method described below rather than the cutting method shown in FIG. 12 (refer to FIG. 2B and FIG. 3B).

Namely, the procedure shown in FIG. 2B comprises the first step S11 of forming a spacer base material on an uneven substrate (spacer base) by heat drawing, the second step S12 of coating a mask layer such as OFPR-800 by the dipping process, the third step S13 of bundling spacer base members by a jig, the fourth patterning step F14 of partially removing the mask layer from the end surfaces (contact surfaces) of the spacer base members by #24000 sand paper, the fifth step S15 of dipping the contact surfaces of the spacer base members in Pt—Mn paste and then baking the coating at 360° C. to produce a low-resistance film on the contact surfaces, and the sixth step S16 of removing the remaining mask layer by dipping in M321 and rinsing with pure water.

Figure 3B:
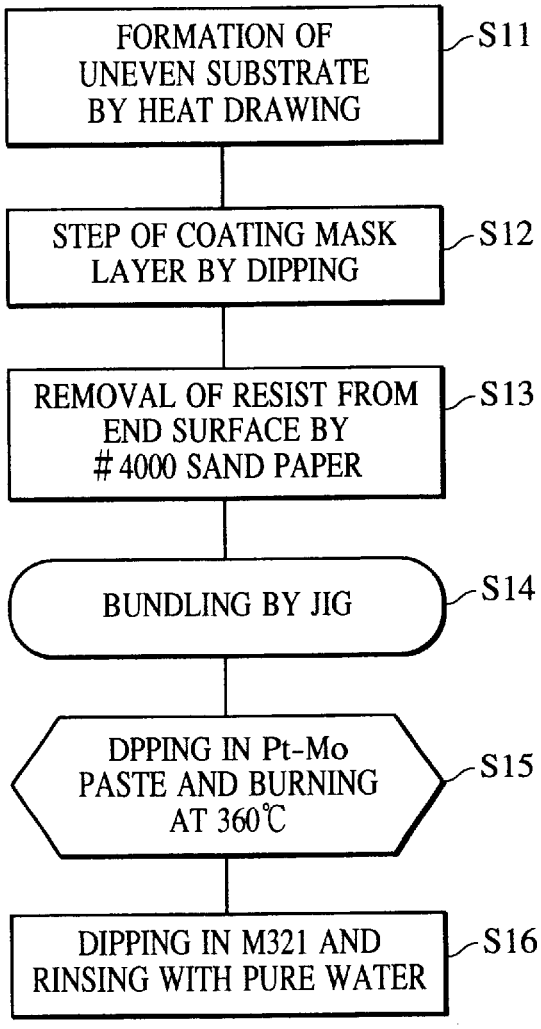
FIG. 3B is a drawing illustrating the low-resistance film forming step.

The procedure shown in FIG. 3B is different from the procedure shown in FIG. 2B in that the third step S13 and the fourth step S14 are reversed. In this procedure shown in FIG. 3B, the mask layer is removed from the end surfaces of each of the spacer base members by using #4000 file, and then the spacer base members are bundled by a jig so that the patterned surfaces lie in the same plane, followed by the next step of forming the low-resistance film.

This heat drawing method permit the formation of the spacer base material 82 and end processing (processing to the end shape having required curvature) at the same time.

Next, an example of the heat drawing method will be described below with reference to the apparatus shown in FIG. 13 (Steps A to C).

[Step A]

First, a glass plate (base material) 91 is prepared. Assuming that the sectional area of the intended spacer base member 21 is S2, and the sectional area of the glass plate (base material) 91 is S1, S1 and S2 satisfy the relation (S2/S1)<1. In this case, "the section" means a section of the glass plate (base material) 91 or the spacer base member 21 taken along a plane perpendicular to the directional component of velocity V1 or V2.

[Step B]

Both ends of the glass plate (base material) 91 prepared in step A are fixed, and a portion of the glass plate 91 in the longitudinal direction is heated by heating means (heater) 92. At the same time, one end of the glass plate 91 is delivered by first transfer means (for example, a roller pair) 94 at a velocity V1 to the heating means 92, and the other end of the glass plate (base material) 91 is drawn out of the heating means 92 by second transfer means (for example, a drawing roller pair) 93 at a velocity V2. As a result, the glass plate (base material 91 is drawn while being heated by the functions of the first transfer means 94, the heating means 92 and the second transfer means 93.

The direction of the velocity V2 is substantially the same as the velocity V1. Therefore, the velocities V1 and V2 preferably satisfy the relation (S2/S1)=(V1/V2). Specifically, the value V2/V1 is preferably 10 to 10000, and more preferably 100 to 10000.

Although the heating temperature of the heating means (heater) 92 depends upon the type and the formed shape of the glass, the heating temperature is preferably the softening point of the glass plate (base material) 91 or more, for example, 500 to 700° C. The transfer means 94 and 93 preferably comprise rotators such as the rollers shown in FIG. 13, and a belt (not shown in the drawing) driven by a plurality of rotators so that the glass plate (base material) 91 is transferred in contact with the rollers and the belt. By satisfying these conditions, a sectional shape having an edge with the above-described desired radius of curvature r can be obtained.

[Step C]

Next, the glass plate (base material) 91 drawn in step B is sufficiently cooled, and then cut to a desired length by cutting means 95 to form the spacer base member 21. The cooling temperature may be about room temperature.

By the above-described steps A to C, the spacer base member 21 having an edge (corner) with the desired radius of curvature r can be obtained. The glass plate (base material) 91 prepared in step A preferably has the end surfaces (contact surfaces) 24 each having the sectional shape shown in FIGS. 9 or 10. This can facilitate the formation of the spacer base member 21 having a shape similar to the section of the glass plate (base material) 91 prepared in the step A through the steps A to C. Therefore, the velocity ratio of V1 to V2 is appropriately set so that the spacer base member 21 in which the radius of curvature r of the glass plate (base material) 91 is decreased to a desired value can be obtained with high reproducibility.

Therefore, the use of the heating drawing method eliminates the need for direct processing of the spacer base member 21 required for obtaining a small radium of curvature. In other words, processing can be performed in the state (before drawing) in which the radius of curvature is large, and thus the spacer base member 21 having the edges (corners) 23 with a small radius of curvature can be easily obtained with high precision.

Figure 13:
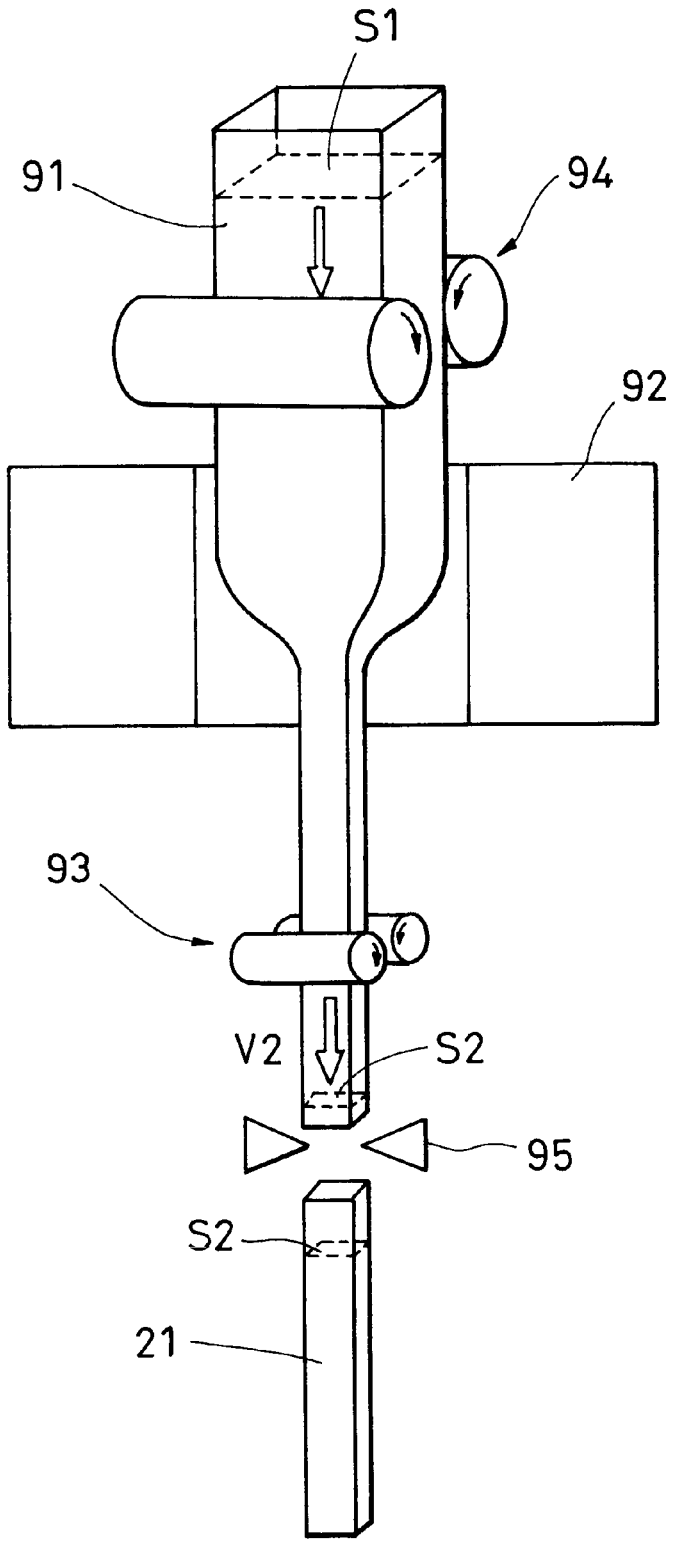
FIG. 13 is a perspective view showing the step of producing a spacer base member from a glass base material by a drawing method in the production method of the present invention.

In the heat drawing method, as shown in FIG. 13, the transfer means 93 and 94 are preferably arranged in correspondence with the side surfaces of the spacer base member 21 shown in FIG. 1, i.e., the glass plate (base material) 91, in the longitudinal direction. This is because during transfer and drawing of the glass plate (base material) 91 at the velocities V1 and V2, the velocities can be precisely controlled with high stability. Also, each of the transfer means 93 and 94 preferably comprises a pair of transfer means for holding the side surfaces of the glass plate (base material) 91 therebetween in the longitudinal direction, as shown in FIG. 13. As the transfer means, means for simply transferring the spacer base member 21 or the glass plate (base material) 91 by rotation is preferred, but the transfer means is not limited to this.

As described above, the mask layer is coated on the spacer base member 21 having the end surfaces (contact surfaces) having the desired shape obtained by the above method, and the mask layer on the end surfaces (contact surfaces) 24 is patterned. Then, the low-resistance film (electrode) 25 is formed on the end surfaces by the liquid phase forming method to sufficiently coat the end surfaces (contact surfaces) of the spacer base member 21 with the low-resistance film (electrode) 25.

Particularly, in forming the spacer base member 21 by using the heat drawing method, the low-resistance film (electrode) 25 is preferably formed on the spacer base member 21, which is subjected to coating of the mask layer and patterning, by the liquid phase forming method (for example, the dip transfer method described below) after the glass plate is cut to the desired length L in the step C. This is because the spacer base member 21 can easily be handled in forming the low-resistance film (electrode) 25 by the liquid phase forming method (for example, the dip transfer method described below).

Furthermore, an uneven structure is previously provided on the base material so that unevenness 26 can be formed on the side surfaces (and the side end surfaces) of the spacer base member 21 as a final product by the same step as the step of making the end surfaces obtuse in the heat drawing method (refer to FIGS. 9 to 11).

Figure 14:
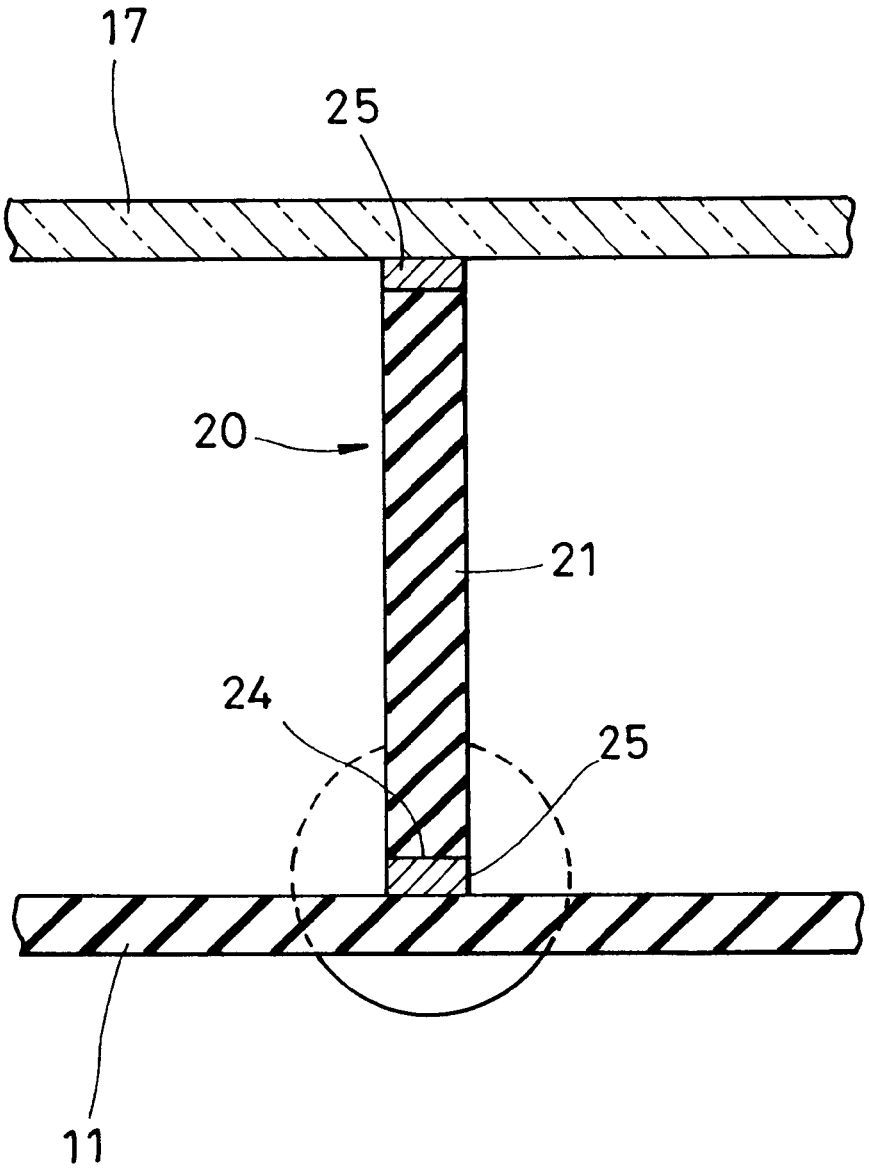
FIG. 14 is a sectional view of the side end surface of a spacer base member of the present invention which is mounted on an image forming apparatus (panel)
Figure 15:
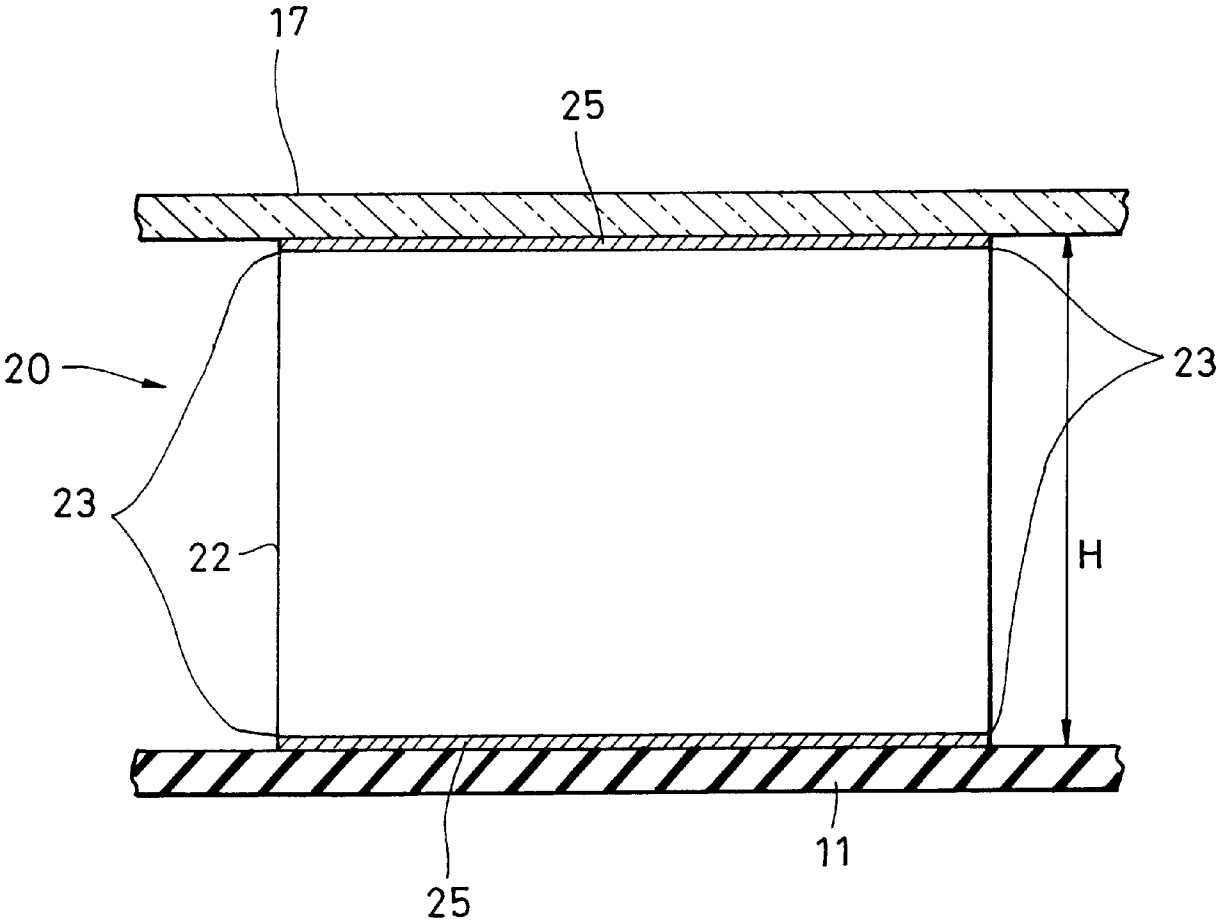
FIG. 15 is a sectional side view of the spacer base member shown in FIG. 14, with the high-resistance films formed on the side surfaces thereof.
Figure 16:
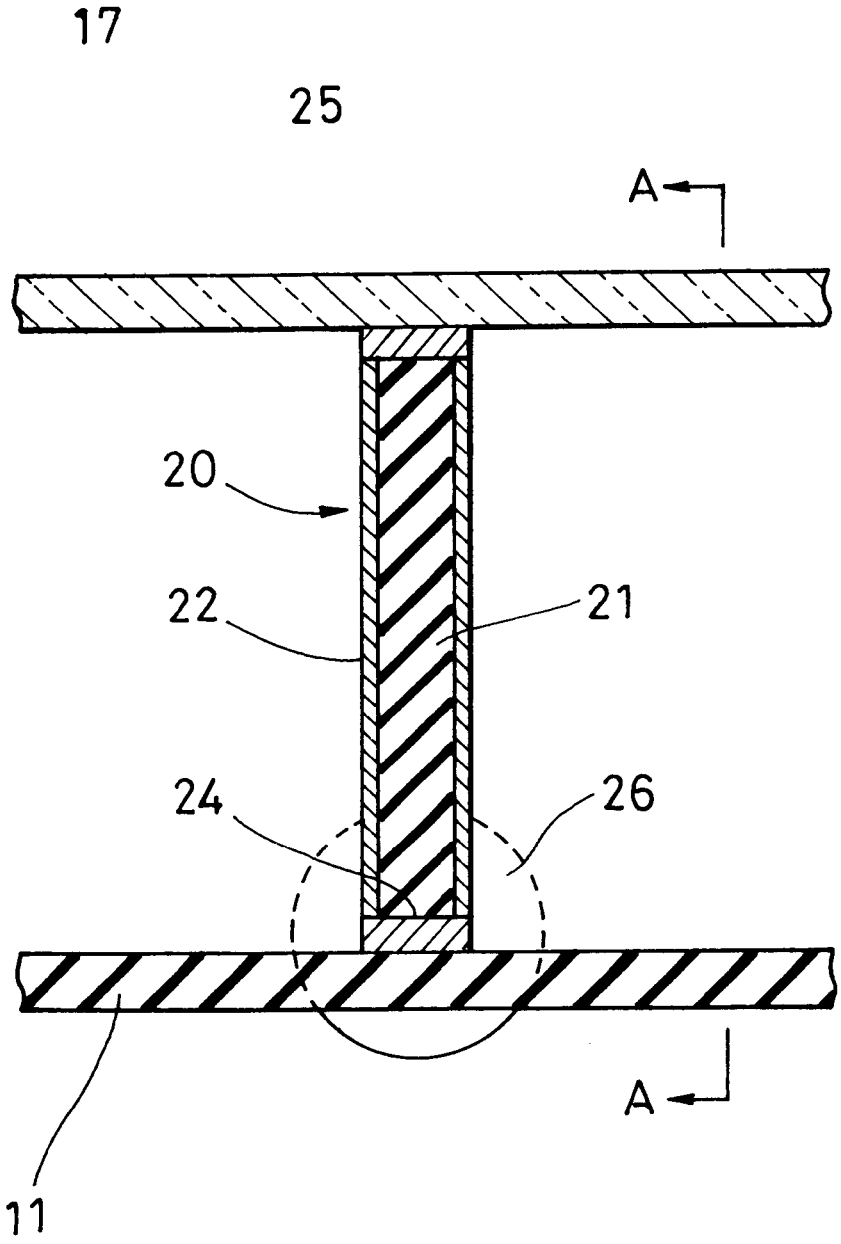
FIG. 16 is a sectional view of the side end surface of the spacer base member shown in FIG. 15.

For example, the spacer 20 comprising the low-resistance film (electrode) 25 provided on the contact surfaces of the insulating spacer base member 21 by the liquid phase forming method of the present invention is arranged between the rear plate (electron source) 11 and the faceplate 17 in the image forming apparatus (refer to FIG. 14). When the spacer 20 is arranged between the rear plate (electron source) 11 and the faceplate 17 in a high-Va image forming apparatus in which a voltage of several kV to several tens kV is applied, the high-resistance film 22 is preferably formed on the side surfaces of the spacer base member 21, as shown in FIGS. 15 and 16. By forming the low-resistance film 22 on the side surfaces of the insulating spacer base member 21, charge of the surfaces (side surfaces) of the spacer can be suppressed to obtain a good image with no deviation of light emission points.

Although FIGS. 15 and 16 show an example in which the high-resistance film 22 is coated only on the side surfaces of the spacer base member 21, the high-resistance film 22 may be coated on all surfaces (the side surfaces, side end surfaces and upper and lower end surfaces) of the spacer base member 21. The high-resistance film 22 is not necessarily coated on all outer surfaces of the spacer base member 21. Namely, of the outer surfaces of the spacer base member 21 exposed in a vacuum chamber which will be described below, the surfaces not coated with the electrode (low-resistance film) 25 may be coated with the high-resistance film 22. However, since the high-resistance film 22 must be electrically connected to the low-resistance film (electrode) 25, electrical connection can be ensured by overlapping the low-resistance film (electrode) 25 and the high-resistance film 22.

FIGS. 15 and 16 show the example in which the high-resistance film 22 is coated with the low-resistance film (electrode) 25. However, conversely, the high-resistance film 22 may be coated on the side surfaces of the spacer base member 21 after the end surfaces of the spacer base member 21 are coated with the low-resistance film (electrode) 25. This permits the interfaces between the low-resistance film (electrode) 25 and the spacer base member 21 to be coated with the high-resistance film 22. As a result, it is possible to suppress discharge in the interfaces due to the shape of the low-resistance film (electrode) 25.

The surface resistance value of the high-resistance film 22 is preferably $10^7$ Ω/□ to $10^{14}$ Ω/□. With this surface resistance value, it is possible to suppress charge, current consumption between the upper and lower substrate (FP and RP) and heat generation. On the other hand, the resistance value of the low-resistance film (electrode) 25 is preferably 1/10 or less of the resistance value of the high-resistance film 22, i.e., $10^7$ Ω/□ or less, in order to achieve good electrical connection between the faceplate 17 and/or the rear plate 11 and the high-resistance film 22.

The electron source used in the image forming apparatus of the present invention preferably comprises the above-described cold-cathode device (MIM, FE, surface conduction type electron emission device, or the like). As the cold-cathode device, the surface conduction type electron emission device is particularly preferred because it has a simple structure and is thus suitable for a large-area flat panel display.

The image forming apparatus of the present invention comprises a display and a device for forming a latent image by using an electron beam resist as a target (image forming member) which is irradiated with the electrons emitted from the electron emitting device.

(Construction of Display Panel and Manufacturing Method Thereof)

Figure 17:
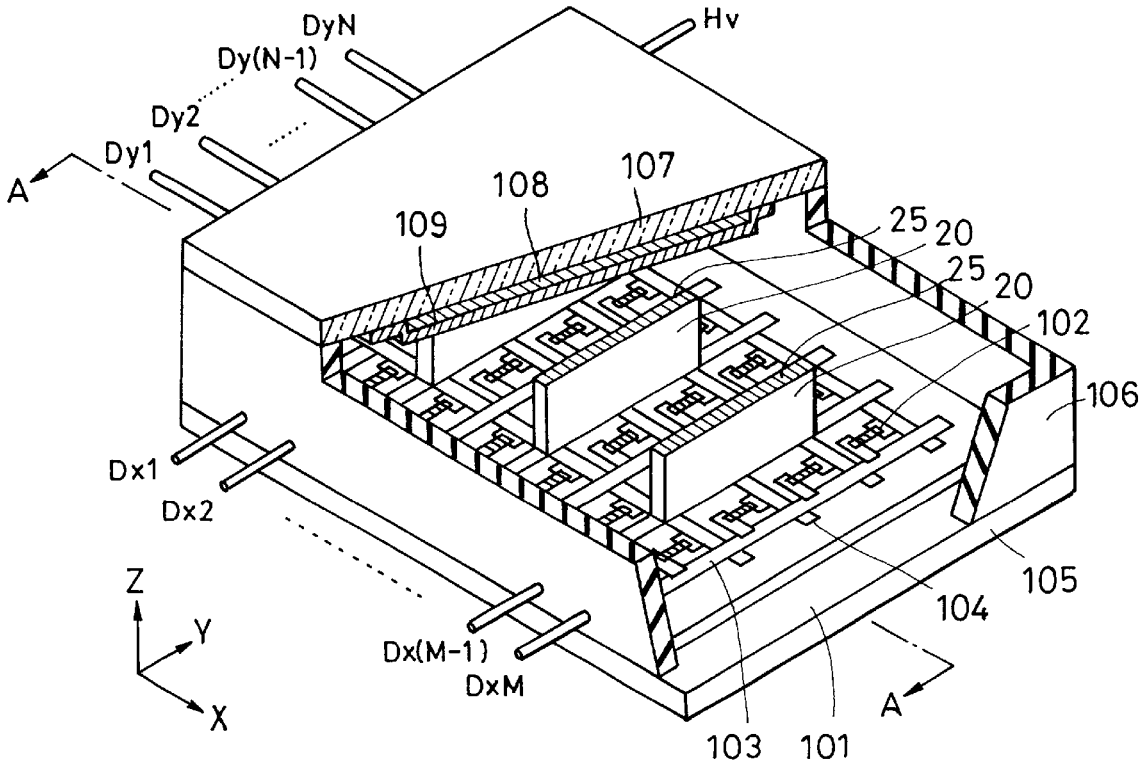
FIG. 17 is a partially cut-out perspective view showing an image display apparatus (panel) using a spacer of the present invention.

An example of the construction of the image display device (display panel) 100 using the spacer 20 in accordance with an embodiment of the present invention, and an example of a manufacturing method thereof are described in detail below. FIG. 17 is a partially cut-out perspective view of the appearance of the display panel 100 of the embodiment, showing the internal structure of the display panel 100. In FIG. 17, reference numeral 105 denotes a rear plate (corresponding to reference numeral 11 in FIGS. 14 to 16); reference numeral 106, a side wall; reference numeral 107, a faceplate (corresponding to reference numeral 17 in FIGS. 14 to 16). These members 105 to 107 form an airtight container for maintaining the inside of the display panel 100 in a vacuum state. In assembling the airtight container, the joints between the respective members must be sealed for maintaining sufficient strength and airtightness.

Therefore, for example, frit glass is coated on the joints and baked at 400 to 500° C. for 10 minutes or more in the air or a nitrogen atmosphere to achieve desired sealing. Since the inside of the airtight container is maintained in a vacuum of about $10^{-4}$ Pa, the spacer 20 of the present invention is provided as an atmospheric pressure resistant structure for preventing breakage of the airtight container due to the atmospheric pressure or unexpected shock.

In FIG. 17, a substrate 101 is fixed to the rear plate 105, and N×M cold-cathode devices 102 are formed on the substrate 101. In this display panel, each of N and M is a positive integer and set to an appropriate value according to the desired number of display pixels. For example, in a display device for high-definition television display, N and M are preferably set to 3000 or more and 1000 or more, respectively. The N×M cold-cathode devices 102 are wired in a simple matrix by M line-direction wiring electrodes 103 and N column-direction wiring electrodes 104.

Therefore, the portion comprising the substrate 101, the line-direction wiring electrodes 103 and the column-direction wiring electrodes 104 is referred to as a "multiple electron source". In this embodiment, the material and the shape of the cold-cathode devices or the production method thereof are not limited as long as the electron source comprises the cold-cathode devices wired in a simple matrix. Therefore, for example, the cold-cathode devices such as the surface conduction type emission devices, FE type devices or MIM type devices can be used.

Figure 18:
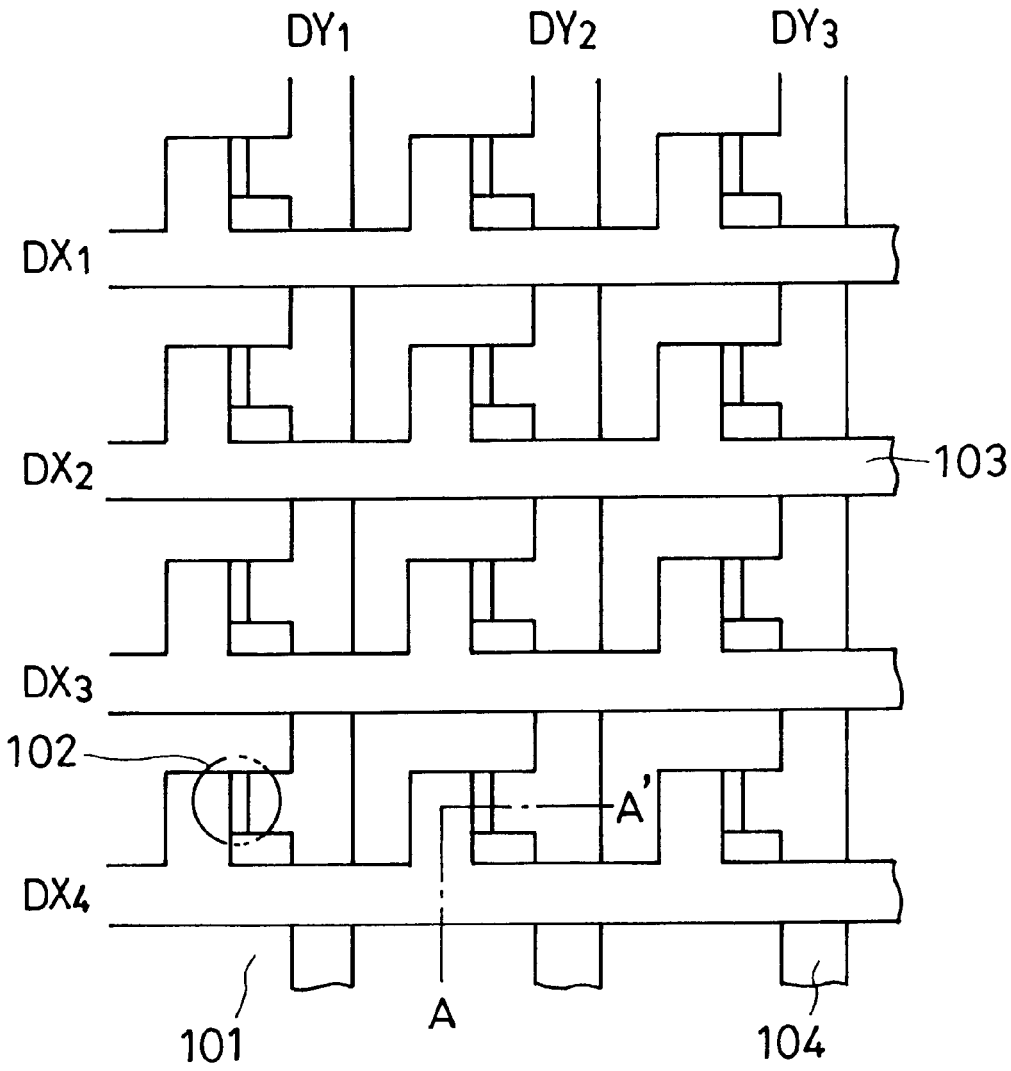
FIG. 18 is a plan view of a substrate of a multiple electron source used in an embodiment of the present invention.

A description will now be made of the structure of the multiple electron source in which the surface conduction type emission devices described below are arranged on the substrate and wired in a simple matrix. FIG. 18 is a plan view of the multiple electron source used in the display panel 100 shown in FIG. 17. In FIG. 18, the surface conduction type emission devices are arranged on the substrate 101, and wired in a simple matrix by the line-direction wiring electrodes 103 and the column-direction wiring electrodes 104. Furthermore, insulating layers (not shown in the drawing) are formed between the line-direction wiring electrodes 103 and the column-direction wiring electrodes 104 at the intersections of both types of electrodes to maintain electrical insulation.

Figure 19:
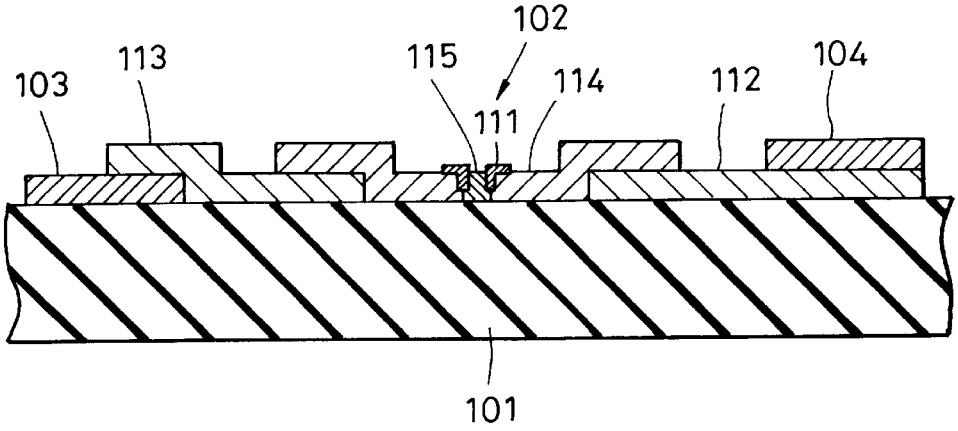
FIG. 19 is a partial sectional view of the substrate of the multiple electron source shown in FIG. 18.

FIG. 19 is a sectional view taken along A–A' in FIGS. 17 and 18. The multiple electron source having the above-described structure is produced by previously forming the line-direction wiring electrodes 103, the column-direction wiring electrodes 104, the electrode insulating layers (not shown), device electrodes 112 and 113 of the surface conduction type emission devices, conductive thin films 114 on the substrate 101, and then supplying a current to each of the devices through the line-direction wiring electrodes 103 and the column-direction wiring electrodes 104 to perform electric forming (described below) and electric activation (described below).

Although, in this embodiment, the substrate 101 of the multiple electron source is fixed to the rear plate 105 of the airtight container, the substrate 101 of the multiple electron source may be used as the rear plate of the airtight container when the substrate 101 of the multiple electron source has sufficient strength.

Figure 20A:
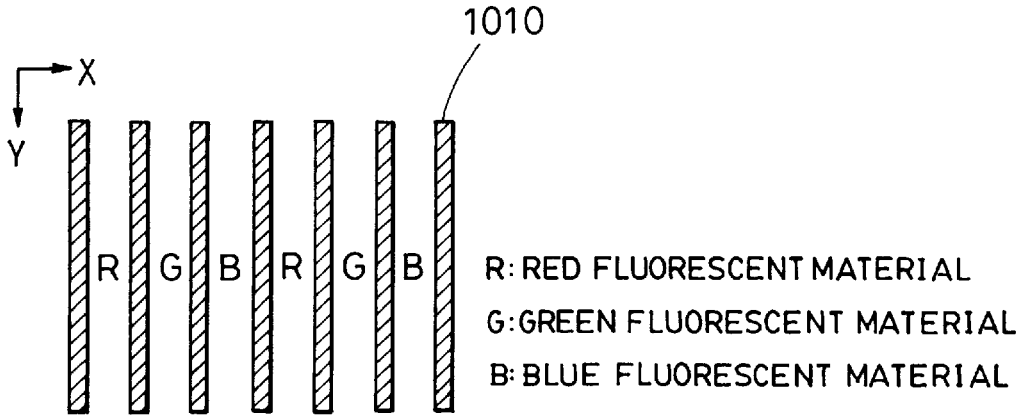
FIGS. 20A and 20B are plan views showing examples of the arrangement of a fluorescent material on a faceplate of a display panel in accordance with an embodiment of the present invention.

Furthermore, a fluorescent film 108 is formed on the lower side of the faceplate 107. This embodiment relates to a color display device, and thus fluorescent materials of the primary colors including red, green and blue, which are used in the CRT field, are arranged in the fluorescent film 108. Each of the fluorescent materials is arranged in stripes, for example, as shown in FIG. 20A, a black conductor 1010 being provided between the respective stripes of the fluorescent materials. The black conductor 1010 is provided for preventing a deviation of a display color, preventing reflection of external light to prevent deterioration in display contrast, and preventing charge-up of the fluorescent film due to electrons even when the electron irradiation positions are slightly deviated. Although the black conductor 1010 comprises graphite as a main component, other materials may be used as long as the materials are suitable for the above purposes.

Figure 20B:
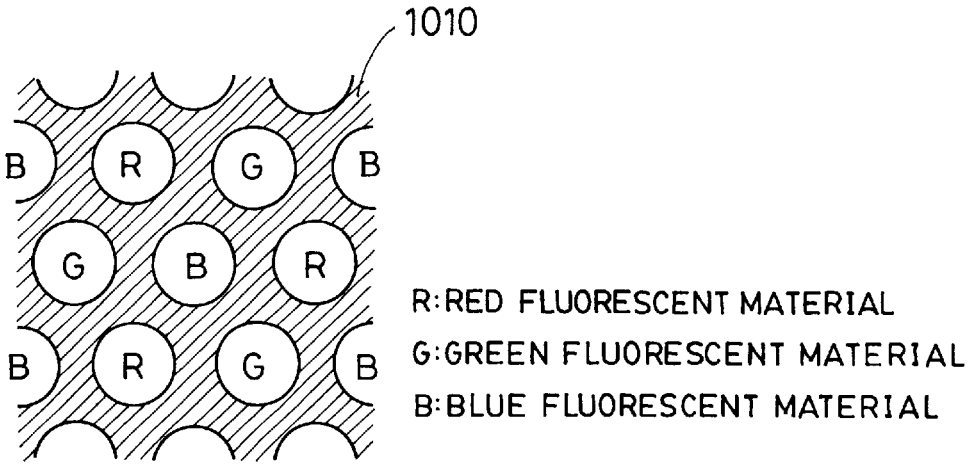

The arrangement of the fluorescent materials of the primary colors is not limited to the stripe arrangement shown in FIG. 20A. For example, the delta arrangement shown in FIG. 20B, or other arrangements may be used. In forming a monochromatic display panel, a single color fluorescent material may be used for the fluorescent film 108, and the black conductor 1010 is not necessarily used.

Furthermore, a metal back 109, which is known in the CRT field, is provided on the rear plate side of the fluorescent film 108. The metal back 109 is provided for improving the efficiency of light utilization by mirror reflection of a part of the light emitted from the fluorescent film 108, protecting the fluorescent film 108 from collision of negative ions, and causing the fluorescent film 108 to function as an electrode for applying an electron accelerated voltage and function as a track of the electrons which excite the fluorescent film 108. The metal back 109 is formed by smoothing the surface of the fluorescent film 108 formed on the faceplate 107, and then depositing aluminum (Al) on the fluorescent film 108 by a vacuum deposition process. When a fluorescent material for low voltages is used for the fluorescent film 108, the metal back 109 is not used.

Although not used in this embodiment, a transparent electrode made of, for example, ITO may be provided between the faceplate 107 and the fluorescent film 108 in order to use the transparent electrode for applying the accelerated voltage and improve conductivity of the fluorescent film 108.

Furthermore, line wiring terminals Dx1 to DxM and column wiring terminals Dy1 to Dyn and terminal Hv are electrical connection terminals for the airtight structure, which are provided for electrically connecting the display panel 100 and each of the above-described circuits. The line wiring terminals Dx1 to DxM are electrically connected to the line-direction wiring electrodes 103 of the multiple electron source, the column wiring terminals Dy1 to Dyn are electrically connected to the column-direction wiring electrodes 104, and terminal Hv is electrically connected to the metal back 109 of the faceplate 107.

In order to bring the inside of the airtight container into a vacuum state, the airtight container is assembled, and then connected to an exhaust tube and a vacuum pump (not shown) to evacuate the airtight container to a degree of vacuum of about $10^{-5}$ Pa. Although the exhaust tube is then sealed, a getter film (not shown) is formed at a predetermined position in the airtight container in order to maintain the vacuum in the airtight container immediately before or after sealing. The getter film is formed by, for example, heating a getter material containing Ba as a main component by a heater or radio-frequency heating to deposit the material. The degree of vacuum in the airtight container is maintained at $1\times10^{-3}$ to $\times10^{-5}$ Pa by the adsorption function of the getter film.

Figure 21:
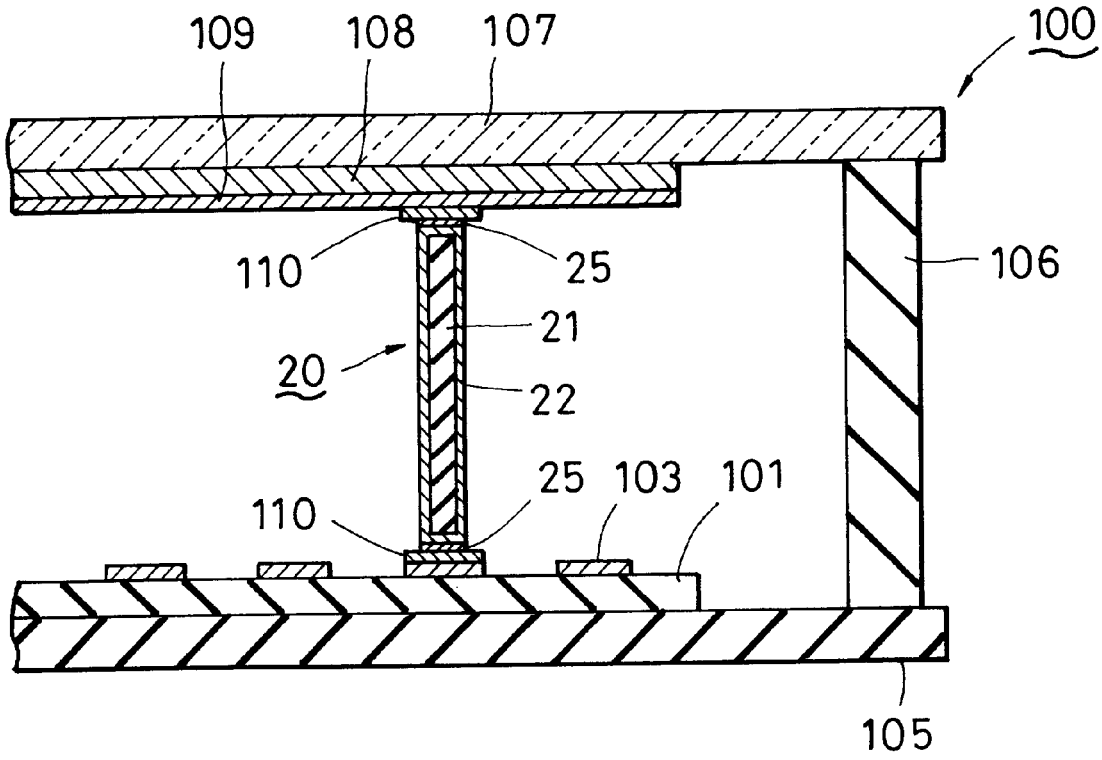
FIG. 21 is a sectional view of the display panel taken along line A–A' in FIG. 17.

FIG. 21 is a schematic sectional view taken along line A–A' in FIG. 17. In FIG. 21, reference numerals respectively correspond to those of FIG. 17. Referring to FIG. 21, the spacer 20 comprises the high-resistance film 22 deposited on the surfaces of the insulating spacer base member 21, for preventing charge of the surfaces, and the low-resistance film (electrode) 25 deposited on the contact surfaces (end surfaces) 24 of the spacer base member 21, which face the inner surface (the metal back 109) of the faceplate 107, and the surface (the line-direction wiring electrodes 103 or the column-direction wiring electrodes 104) of the substrate 101.

The required number of the spacers 20 for achieving the above purposes are arranged at necessary intervals on the faceplate 107, and fixed to the inner side of the faceplate 107 and the surface of the substrate 101 by fixing members (not shown) arranged outside the image region.

The high-resistance film 22 is deposited on the surfaces of the insulating member (spacer base member) 21, which are exposed to at least the vacuum in the airtight container, and are electrically connected to the inner side (the metal back 109, etc.) of the faceplate 107, and the surface (the line-direction wiring electrodes 103 or the column-direction wiring electrodes 104) of the substrate 101 through the low-resistance film (electrode) 25 and a binder 110.

Although the spacers 20 are fixed by the fixing members outside the image region, the spacers 20 may be fixed to the line-direction wiring electrodes 103 and the metal back 109 by the mixing members such as glass frit containing conductive fine particles, or the like, which are provided near the contact surfaces of the spacer 20.

In this embodiment, the spacers 20 have a plate shape, and are arranged in parallel with the line-direction wiring electrodes 103 to be electrically connected to the line-direction wiring electrodes 103. However, the spacers 20 may have a columnar shape, or have an uneven surface. Furthermore, the spacers 20 must have an insulation property sufficient for withstanding the high voltage applied between the line-direction wiring electrodes 103 and the column-line wiring electrodes 104 on the substrate 101, and the metal back 109 on the inner side of the faceplate 107, and conductivity enough for suppressing charge of the surfaces of the spacers 20.

In this embodiment, the spacer base member 21 which constitutes each of the spacers 20 comprises a ceramic member of quartz glass, glass having a decreased content of impurities such as Na, soda lime glass, alumina or the like. As the material for the spacer base member 21, a material having a coefficient of thermal expansion close to those of the constitutive members of the airtight container and the substrate 101 is preferably used.

The current flowing through the high-resistance film 22 of the spacers 20 is obtained by diving the accelerated voltage Va applied to the faceplate 107 (the metal back 109) on the high potential side by the resistance value Rs of the high-resistance film 22. The resistance value Rs of the spacers 20 is set in the preferred range from the viewpoint of suppression of charge and power consumption. From the viewpoint of suppression of charge, the surface resistance is preferably $10^{14}$ Ω/□ or less, and more preferably $10^{13}$ Ω/□ or less, for obtaining the sufficient charge inhibiting effect. Although the lower limit of the surface resistance depends upon the shape of the spacers 20 and the voltage applied between the respective spacers, the lower limit is preferably $10^{7}$ Ω/□ or more.

The thickness t of the high-resistance film 22 formed on the spacer base members 21 is preferably in the range of 10 nm to 1 μm. Although the thickness depends upon the surface energy of the material of the spacer base members 21, and adhesion to the spacer base members 21, and the substrate temperature, a thin film having a thickness of 10 nm or less generally is liable to be formed in an island shape, and has unstable resistance and poor reproducibility. While with a film having a thickness t of 1 μm or more, film stress is increased to increase the danger of film peeling and increase the deposition time, thereby deteriorating productivity.

Therefore, in the present invention, the thickness of the high-resistance film 22 is preferably 50 to 500 nm. The surface resistance is represented by ρ/t wherein ρ is resistivity of the high-resistance film 22. In consideration of the above-described preferred ranges of the surface resistance and the thickness t, the resistivity ρ is preferably 10 Ω·cm to $10^{10}$ Ω·cm. In order to realize the more preferred ranges of the surface resistance and the thickness t, the resistivity ρ is preferably $10^4$ Ω·cm to $10^8$ Ω·cm.

As described above, when a current flows through the high-resistance film 22, or when the whole display panel 100 generates heat during an operation, the temperature of the spacer 20 is increased. With the high-resistance film 22 having a high temperature coefficient of resistance, the resistance value is decreased by an increase in temperature, thereby increasing the current flowing through the spacer 20 and further increasing the temperature. As a result, the current is continuously increased until it exceeds the limit of a power supply. According to experiences, the absolute value of the temperature coefficient of resistance with which such excursion of the current occurs is −1% or less. Namely, the temperature coefficient of resistance of the high-resistance film 22 of the spacer 20 is preferably −1% or more.

As the material for the high-resistance film 22 having the effect of suppressing charge, for example, a metal oxide can be used, and particularly oxides of chromium, nickel, and copper are preferred materials. The reason for this is that these oxides have a relative low efficiency of secondary electron emission, and are thus less electrically charged when the electrons emitted from the electron emitting devices 102 are applied to the spacers 20. Besides the metal oxides, carbon is a preferred material having a low efficiency of secondary electron emission. Particularly, amorphous carbon has high resistance, and is thus has the effect of easily controlling the resistance of the spacer 20 to a desired value.

Other examples of material for the high-resistance film 22 include nitrides of aluminum-transition metal alloys. The nitrides are preferred materials because the resistance value can be controlled in a wide range from a good conductor to an insulator by controlling the composition of the transition metal. Also, the nitrides are stable materials which exhibit less changes in the resistance value during the process of manufacturing the display device described below, and which are easily handled in practical use because the temperature coefficients of resistance are −1% or more. The transition metal elements include Ti, Cr, Ta, and the like.

The alloy nitride film is formed on the insulating member by a thin film forming method such as reactive sputtering, electron beam deposition, ion plating, ion-assisted deposition, or the like in a nitrogen gas atmosphere. Although the metal oxide film can be formed by the same thin film forming method, an oxygen gas is used in place of the nitrogen gas. The metal oxide film can also be formed by a CVD method or an alkoxide coating method. The carbon film is formed by evaporation, sputtering, CVD, or plasma CVD. Particularly, in use of amorphous carbon, it is preferable that the deposition atmosphere contains hydrogen, or a hydrocarbon gas is used as deposition gas.

The low-resistance film (electrode) 25 formed on the end surfaces (contact surfaces) of the spacer members 20 is provided for electrically connecting the high-resistance film 25 to the faceplate 107 (the metal back 109, etc.) on the high potential side, and the substrate 101 (the wiring electrodes 103 and 104) on the low potential side. The low-resistance film (electrode) 25 has the plurality of functions below.

1) The Function to Electrically Connect the High-resistance Film 22 to the Faceplate 107 and the Substrate 101.

As described above, the high-resistance film 22 is provided for preventing surface charge of the spacers 20. However, when the high-resistance film 22 is connected to the faceplate 107 (the metal back 109, etc.) and the substrate 101 (the wiring electrodes 103 and 104) directly or through the contact members 110, large contact resistance occurs at the joints, thereby possibly failing to rapidly remove the charge produced in the surfaces of the spacers 20.

In order to solve this problem, the low-resistance film (electrode) 25 is provided on the contact surfaces 24 of the spacers 20 in contact with the faceplate 107, the substrate 101, and the contact members 110.

2) The Function to Make the Potential Distribution of the High-resistance Film 22 Uniform The electrons emitted from the electron emitting devices 102 make electron orbits according to the potential distribution formed between the faceplate 107 and the substrate 101. In order to prevent a disturbance of the electron orbits near the spacers 20, the potential distribution of the high-resistance film 22 must be controlled over the entire region. When the high-resistance film 22 is connected to the faceplate 107 (the metal back 109, etc.) and the substrate 101 (the wiring electrodes 103 and 104) directly or through the contact members 110, variation possibly occurs in the connection state due to the contact resistance at the connection interfaces, thereby deviating the potential distribution of the high-resistance film 22 from the desired distribution.

In order to solve this problem, the low-resistance film (electrode) 25 is provided on the contact surfaces 24 of the spacers 20 in contact with the faceplate 107, and the substrate 101. The potential of the entire high-resistance film 22 can be controlled by applying a desired potential to the low-resistance film (electrode) 25.

3) The Function to Control the Orbits of Emitted Electrons

The electrons emitted from the electron emitting devices 102 make electron orbits according to the potential distribution formed between the faceplate 107 and the substrate 101. With respect to the electrons emitted from the electron emitting devices 102 near the spacers 20, restrictions (changes in wiring, the device positions, etc.) are produced by providing the spacers 20. In this case, in order to form an image without distortion and unevenness, the orbits of the emitted electrons must be controlled so that the electrons are applied to the desired positions on the faceplate 107. By providing the low-resistance film (electrode) 25 on the surfaces in contact with the faceplate 107 and the substrate 101, the potential distribution of the spacers 20 can be provided with desired characteristics, and the orbits of the emitted electrons can be controlled.

As the material of the low-resistance film (electrode) 25, a material having a sufficiently lower resistance value than the high-resistance film 22 may be selected. The material is appropriately selected from a printed conductor composed of a metal such a Ni, Cr, Au, Mo, W, Pt, Ti, Al, Cu, Pd, or the like, or alloy, and a metal or metal oxide such as Pd, Ag, Au, $RuO_2$, Ag—PbO, or the like and glass; a conductive fine particle dispersed film comprising $SnO_2$ conductive fine particles doped with Sn and dispersed in a binder composed of silica or silicon oxide having alkyl-, alkoxy-, or fluorine-substituted terminals; a transparent conductor such as $In_2O_3$—$SnO_2$, or the like; a semiconductor material such as polysilicon or the like.

The binder 110 must be provided with conductivity in order to electrically connect the spacers 20 to the line-direction wiring electrodes 103 and the metal back 109. Namely, as the binder 110, glass frit containing a conductive adhesive, metal particles, and a conductive filler is preferably used.

In the above-described image display device (display panel) 100, a voltage is applied to each of the electron emitting devices 102 through the external terminals Dx1 to DxM and Dy1 to DyN of the container to emit electrons from the electron emitting devices 102. At the same time, a high voltage of several hundreds V to several kV is applied to the metal back 109 through the external terminal Hv of the container to accelerate the emitted electrons toward the faceplate 107 and cause the electrons to collide with the inner surface of the faceplate 107. As a result, the fluorescent material of each color of the fluorescent film 108 is excited to emit light, thereby displaying an image.

Generally, the voltage applied to the surface conduction type emission devices 102 of this embodiment, which serve as the electron emitting devices (cold-cathode devices), is about 12 to 16 V, and the distance d between the metal back 109 and the cold-cathode devices 102 is about 0.1 mm to 8 mm, and the voltage between the metal back 109 and the cold-cathode devices 102 is about 0.1 kV to 10 kV.

Although the basic construction and the manufacturing method of the image display device (display panel) 100 of this embodiment are described above, the method of producing the multiple electron source used in the display panel 100 of this embodiment is described below. In the multiple electron source used in the image display device of this embodiment, the material, the shape or the production method of the cold-cathode devices is not limited as long as the electron source comprises the cold-cathode devices wired in a simple matrix.

Therefore, for example, the surface conduction type emission devices, the FR devices, or the MIM devices can also be used as the cold-cathode devices. However, when an inexpensive display device having a large display screen is desired, the surface conduction type emission devices are particularly preferred as the cold-cathode devices.

Namely, with the FE type devices, the electron emission properties are greatly influenced by the relative position between an emitter cone and a gate electrode, and the shape, and thus a high-precision production technique is required, thereby causing difficulties in achieving a large area and a low production cost. With the MIM type devices, the thickness of each of an insulating layer and an upper electrode must be increased and made uniform, thereby causing difficulties in achieving a large area and a low production cost. On the other hand, with the surface conduction type emission devices, the production method is relatively simple, and thus a large area and low production cost can easily be achieved.

Furthermore, the inventors found that a surface conduction type emission device comprising a fine particle film which constitutes an electron emission portion or the periphery thereof has excellent electron emission properties, and can easily be produced. It is thus said that the surface conduction type emission devices are most preferably used for the multiple electron source of the large-screen image display device.

Therefore, the display panel 100 of this embodiment uses the surface conduction type emission device comprising a fine particle film which constitutes the electron emission portion or the periphery thereof. First, the preferred basic construction, production method and characteristics of the surface conduction type emission device are described, and the structure of the multiple electron source comprising many devices wired in a simple matrix is then describe below.

(Preferred Construction and Production Method of Surface Conduction Type Emission Device)

Typical examples of the construction of the surface conduction type emission device comprising the fine particle film which constitutes the electron emission portion or the periphery thereof include the two types including a planar type and a vertical type.

1) Planar Surface Conduction-type Emission Device

Figure 22A:
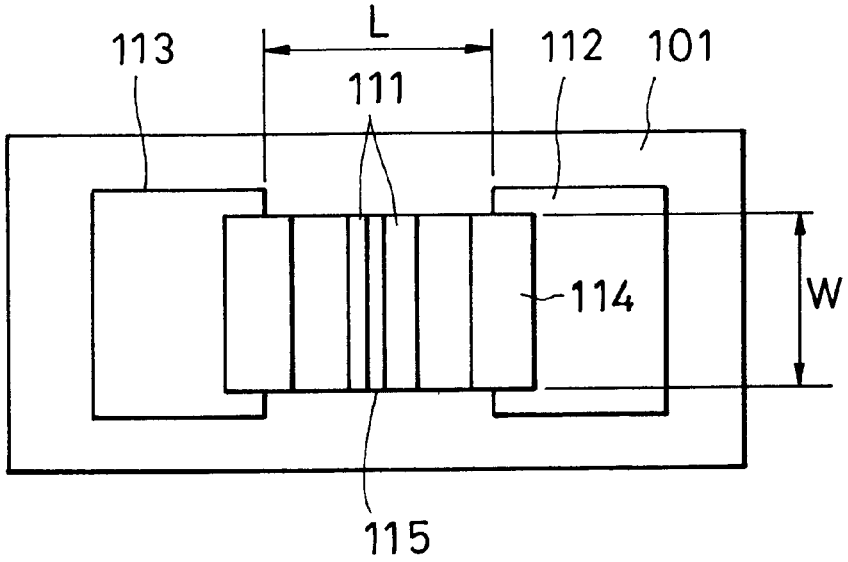
FIGS. 22A and 22B are respectively a plan view and a sectional view of a flat panel-type surface conduction emission device used in an embodiment (an image forming apparatus) of the present invention.

First, the construction and the production method of the planar surface conduction type emission device are described. FIGS. 22A and B are respectively a plan view and a sectional view illustrating the construction of the planar surface conduction type emission device. In these drawings, reference numeral 101 denotes a substrate, reference numerals 112 and 113 each denote a device electrode, reference numeral 114 denotes a conductive thin film, reference numeral 115 denotes an electron emission portion formed by electric forming, and reference numeral 111 denotes a thin film formed by electric activation.

As the substrate 101, for example, various glass substrates of quartz glass, blue plate glass, and the like; various ceramic substrates of alumina and the like; other substrates each comprising an insulating layer of $SiO_2$ laminated on the glass or ceramic substrate can be used.

Each of the device electrodes 112 and 113 provided opposite to each other in parallel with the surface of the substrate 101 is made of a conductive material. For example, a material may be appropriately selected from metals such as Ni, Cr, Au, W, Pt, Ti, Cu, Pd, Ag, and the like; alloys of these metals; metal oxides such as $In_2O_3$—$SnO_2$ and the like; semiconductors such as polysilicon and the like. The electrodes can be easily formed by a combination of a film technique such as vacuum evaporation or the like, and a patterning technique such as photolithography, etching, or the like. However, the electrodes may be formed by using other methods (for example, a printing technique).

Each of the device electrodes 112 and 113 is appropriately designed according to the purpose of application of the electron emitting device. In designing the electrodes, the electrode distance L is generally appropriately selected from values in the range of several hundreds angstroms to several micrometers. However, the distance preferable for application to the display device is in the range of several micrometers to several tens micrometers. The thickness d of the device electrodes is generally appropriately selected from values in the range of several hundreds angstroms to several micrometers.

The conductive thin film 114 comprises the fine particle film. The fine particle film represents a film (including island-like aggregates) containing many fine particles as a component. In microscopic examination of the fine particle film, a structure in which the fine particles are separately arranged, in which the fine particles are adjacent to each other, or in which the fine particles are overlapped with each other is observed.

The particle diameter of the fine particles used in the fine particle film is in the range of several angstroms to several thousands angstroms, but the particle diameter is preferably in the range of 10 angstroms to 200 angstroms. The thickness of the fine particle film is appropriately set in consideration of the conditions below. Namely, the conditions include a condition necessary for preferable electrical connection to the device electrode 112 or 113, a condition necessary for preferable electric forming described below, a condition necessary for setting the electric resistance of the fine particle film to the appropriate value below, etc. Specifically, the thickness is preferably set in the range of several angstroms to several thousands angstroms, and most preferably in the range of 10 angstroms to 500 angstroms.

Examples of the material used for forming the fine particle film include metals such as Pd, Pt, Ru, Ag, Ti, In, Cu, Cr, Fe, Zn, Sn, Ta, W, Pb, and the like; oxides such as PdO, $SnO_2$, $In_2O_3$, PbO, $Sb_2O_3$, and the like; borides such as $HfB_2$, $ZrB_2$, $LaB_6$, $CeB_6$, $YB_4$, $GdB_4$, and the like;

carbides such as TiC, ZrC, HfC, TaC, SiC, WC, and the like; nitrides such as TiN, ZrN, HfN, and the like; semiconductors such as Si, Ge, and the like, carbon, and the like. The material is appropriately selected from these materials.

As described above, the conductive thin film 114 comprises the fine particle film, but the sheet resistance value is set in the range of $10^3$ Ω/□ to $10^7$ Ω/□.

Figure 22B:
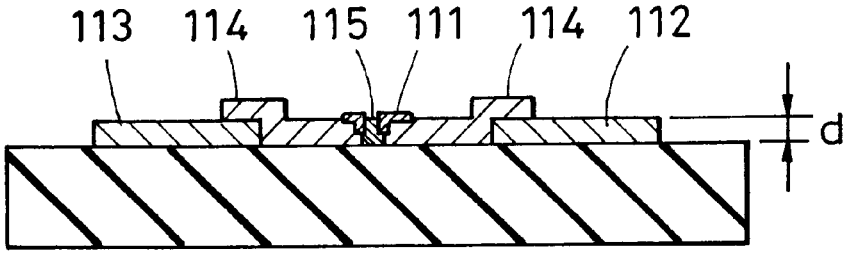

The conductive thin film 114 is electrically sufficiently connected to the device electrodes 112 and 113, and thus the conductive thin film 114 overlaps with the device electrodes 112 and 113. In the overlap structure, the substrate 101, the device electrodes 113 and 114, and the conductive thin film 114 are laminated in order from below, as shown in FIG. 22. However, according to circumstances, the substrate, the conductive thin film, and the device electrodes may be laminated in order from below.

The electron emission portion 115 comprises a crack formed in a portion of the conductive thin film 114, and has the electrical property of higher resistance than the peripheral portion of the conductive thin film. The crack is formed by an electric forming process for the conductive thin film 114, as described below. In some cases, fine particles having a particle diameter of several angstroms to several hundreds angstroms are provided in the crack. Since it is difficult to precisely correctly illustrate the actual position and shape of the electron emission portion, FIG. 22 schematically shows the electron emission portion 115.

The thin film 111 comprises carbon or a carbon compound, and covers the electron emission portion 115 and the periphery thereof. The thin film 111 is formed by electric activation described below after the electric forming process.

The thin film 111 comprises single crystal graphite, polycrystalline graphite, amorphous carbon, or a mixture thereof, and has a thickness of 500 angstroms or less, and preferably 300 angstroms or less.

Since it is difficult to precisely illustrate the actual position and shape of the thin film 111, FIG. 22 schematically shows the thin film 111. The plan view of FIG. 22A shows the device with the thin film 111 being partially removed.

Although the preferred basic construction of the device is described above, the embodiment of the present invention uses the device described blow. The substrate 101 comprises blue plate glass, and each of the device electrodes 112 and 113 comprises a Ni thin film. The thickness d of each of the device electrode is 1000 angstroms, and the electrode distance L is 2 micrometers. The fine particle film comprises Pd or PdO as a main material, and has a thickness of about 100 angstroms and a width W of about 100 micrometers.

Next, the preferred method of manufacturing the planar surface conduction type emission device is described. FIGS. 23A to E are sectional views respectively illustrating the steps for manufacturing the surface conduction type emission device. In these drawings, the same reference numerals as FIG. 22 denote the same members.

Figure 23A:
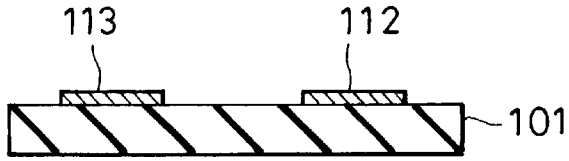
FIGS. 23A through 23E are sectional views showing the steps of producing the surface conduction-type emission device shown in FIG. 22.

1) As shown in FIG. 23A, the device electrodes 112 and 113 are first formed on the substrate 101. In forming these electrodes, the substrate 101 is previously sufficiently washed with a detergent, pure water and an organic solvent, and then the material for the device electrodes is deposited by, for example, a vacuum deposition process such as evaporation, sputtering, or the like. Then, the deposited electrode material is patterned by photolithography and etching techniques to form a pair of the device electrodes 112 and 113.

Figure 23B:
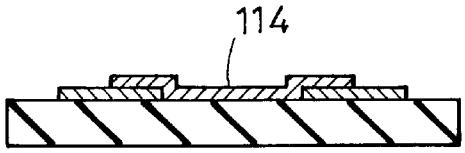

2) Then, as shown in FIG. 23B, the conductive thin film 114 is formed. In forming the conductive thin film 114, an organometallic solution is first coated on the substrate 101 subjected to the step shown in FIG. 23A, dried, and burned by heating to deposit a fine particle film which is then patterned by photolithography and etching. The organometallic solution means a solution of an organometallic compound composed of a fine particle material as a main component used for the conductive thin film. More specifically, this embodiment uses Pd as the main component. In this embodiment, a dipping method is used as a coating method, but other methods such as a spinner method, a spray method, and the like may be used.

Besides the method of coating the organometallic solution used in this embodiment, for example, a vacuum deposition method, a sputtering method, or a chemical vapor deposition method may be used as the method of depositing the conductive thin film 114 comprising the fine particle film.

Figure 23C:
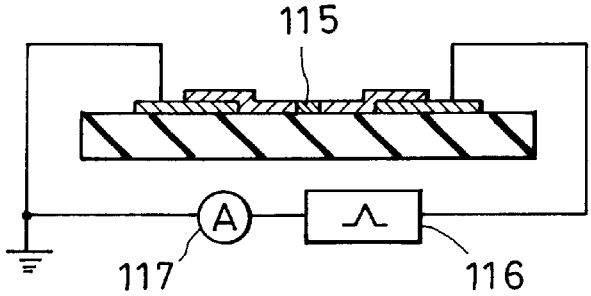

3) Next, as shown in FIG. 23C, an appropriate voltage is applied between the device electrodes 112 and 113 from a forming power supply 116 to perform electric forming, forming the electron emission portion 115. The electric forming process means a process for partially breaking, deforming or deteriorating the conductive thin film 114 comprising the fine particle film by supply a current thereto to form a portion having a structure suitable for electron emission. In the conductive thin film comprising the fine particle film, an appropriate crack is formed in the portion changed to a structure suitable for electron emission, i.e., in the electron emission portion 115.

In comparison with the state before the electron emission portion 115 is formed, the electric resistance measured between the device electrodes 112 and 113 is significantly increased after the electron emission portion 115 is formed.

Figure 24:
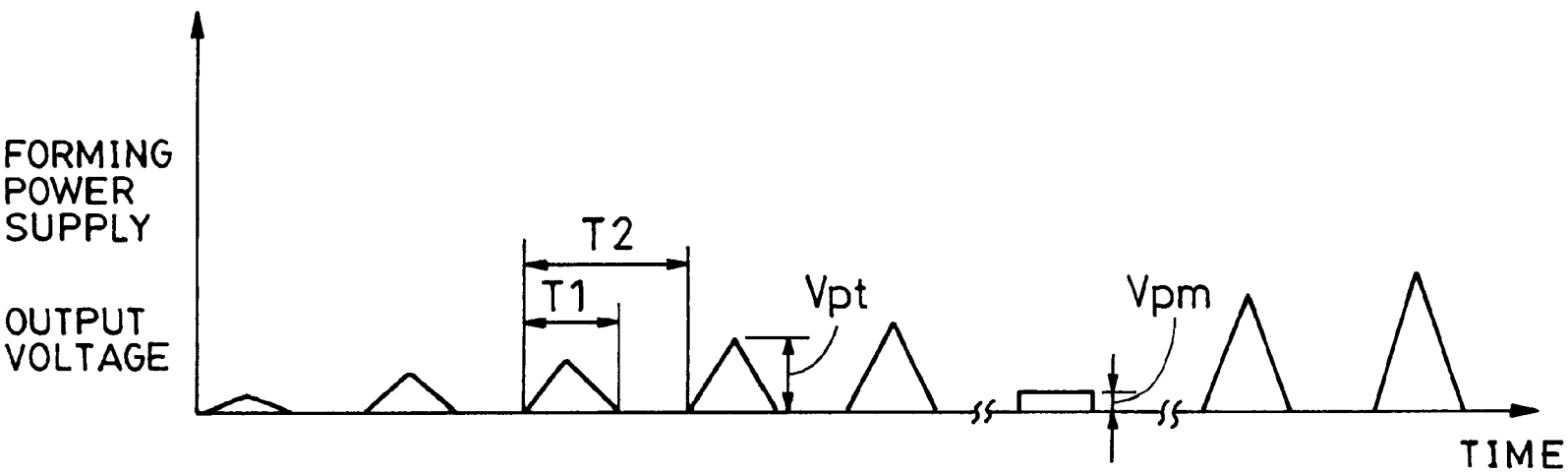
FIG. 24 is a chart showing the applied voltage waveform during electric forming in the production steps shown in FIG. 22.

In order to describe the electric method in detail, FIG. 24 shows an example of an appropriate voltage waveform applied from the forming power supply 116. In forming the conductive thin film 114 comprising the fine particle film, a pulsed voltage is preferably used. In this embodiment, a triangular wave pulse having pulse width Ti is continuously applied at intervals T2. In this process, the wave height Vpf of the triangular pulse is successively stepped up. In addition, a monitor pulse Pm is inserted between the triangular pulses at appropriate intervals, for monitoring the formation condition of the electron emission portion 115 so that the flowing current is measured by an amperometer 117.

In this embodiment, the wave height Vpf is stepped up by 0.1 V for each pulse, for example, with a pulse width T1 of 1 millisecond, and a pulse interval T2 of 10 milliseconds in a vacuum atmosphere, and one monitor pulse Pm is inserted at each time of application of five triangular pulses. In order to prevent an adverse effect on the forming process, the voltage Vpm of the monitor pulse is set to 0.1 V. The current supply for the forming process is ended when the electric resistance between the device electrodes 112 and 113 is $1\times10^6$ Ω, i.e., when the current measured by the amperometer 117 is $1\times10^{-7}$ A or less in application of the monitor pulse.

The above-described method is preferred for the surface conduction type emission device of this embodiment. For example, when the design of the surface conduction type emission device, such as the thickness of the material of the fine particle film, the electrode distance L, or the like is desired to be changed, the electrical condition is preferably appropriately changed according to the desired design.

Figure 23D:
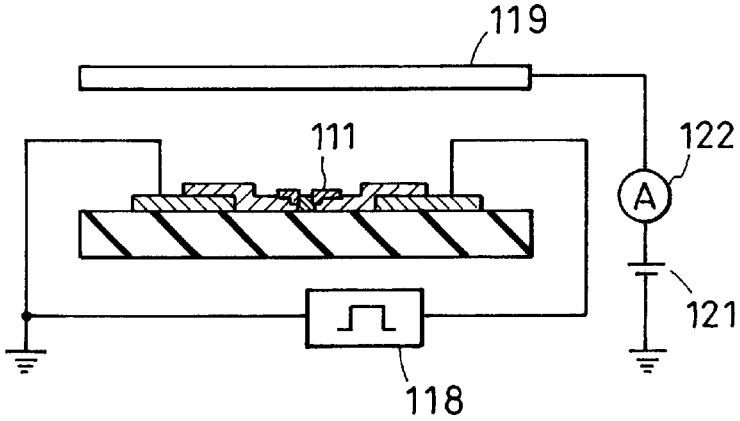

4) Next, as shown in FIG. 23D, an appropriate voltage is applied between the device electrodes 112 and 113 from an activation power supply 118 to perform electric activation for improving the electron emission properties. The electric activation means a process for supplying a current to the electron emission portion 115 formed by the above electric forming process under appropriate conditions to deposit carbon or a carbon compound near the electron emission portion 115. The drawing schematically shows a deposit of carbon or carbon compound as a member 111. By performing the electric activation, with the same applied voltage, the emission current can be increased by 100 times, as compared with the emission current before the electric activation.

Specifically, a voltage pulse is periodically applied between the device electrodes 112 and 113 from the activation power supply 118 in a vacuum atmosphere of $10^{-2}$ to $10^{-3}$ Pa to deposit carbon or a carbon compound derived from an organic compound present in the vacuum atmosphere. The deposit 111 comprises single crystal graphite, polycrystalline graphite, amorphous carbon, or a mixture thereof, and has a thickness of 500 angstroms or less, and more preferably 300 angstroms or less.

Figure 25A:
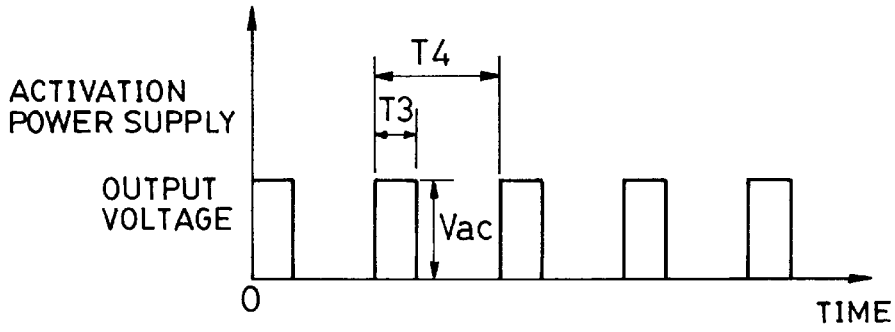
FIGS. 25A and 25B are charts showing the applied voltage waveform during electric activation and changes in emission current Ie, respectively.

In order to describe the electric method in detail, FIG. 25A shows an example of an appropriate voltage waveform applied from the activation power supply 118. In this embodiment, a constant rectangular wave voltage is periodically applied for perform electric activation. Specifically, the rectangular wave voltage Vac is 14 V, the pulse width T3 is 1 millisecond, and the pulse interval T4 is 10 milliseconds. The above-described electric conditions are preferred for the surface conduction type emission device of this embodiment. For example, when the design of the surface conduction type emission device is desired to be changed, the electric conditions are preferably appropriately changed according to the desired design.

In FIG. 23D, reference numeral 119 denotes an anode electrode for supplementing the emission current Ie emitted from the surface conduction type emission device, a DC high voltage power supply 121 and an amperometer 122 being connected to the anode electrode 119. When activation is performed after the substrate 101 is incorporated into the display panel 100, the fluorescent screen of the display panel 100 is used as the anode electrode 119. During application of the voltage from the activation power supply 118, the emission current Ie is measured by the amperometer 122 to monitor the progress condition of electric activation during application of the voltage from the activation power supply 118, thereby controlling the operation of the activation power supply 118.

Figure 25B:
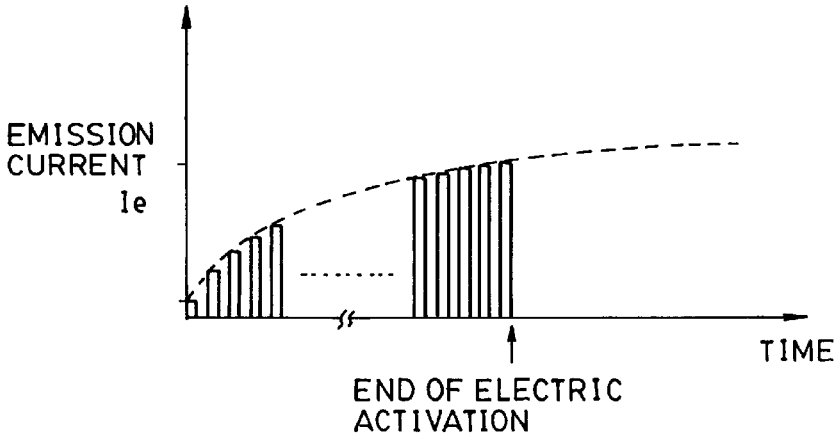

FIG. 25B shows an example of the emission current Ie measured by the amperometer 122. In this case, when the pulse voltage is applied from the activation power supply 118, the emission current Ie increases with the passage of time, but it is then saturated and less increases. Therefore, when the emission current Ie is substantially saturated, application of the voltage from the activation power supply 118 is stopped to end the electric activation.

The above-described electric conditions are preferred for the surface conduction type emission device of this embodiment. For example, when the design of the surface conduction type emission device is desired to be changed, the electric conditions are preferably appropriately changed according to the desired design.

Figure 23E:
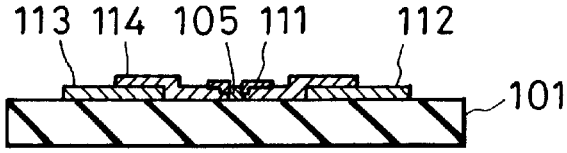

The planar surface conduction type emission device shown in FIG. 23E is manufactured as described above.

2) Vertical Surface Conduction Type Emission Device

Figure 26:
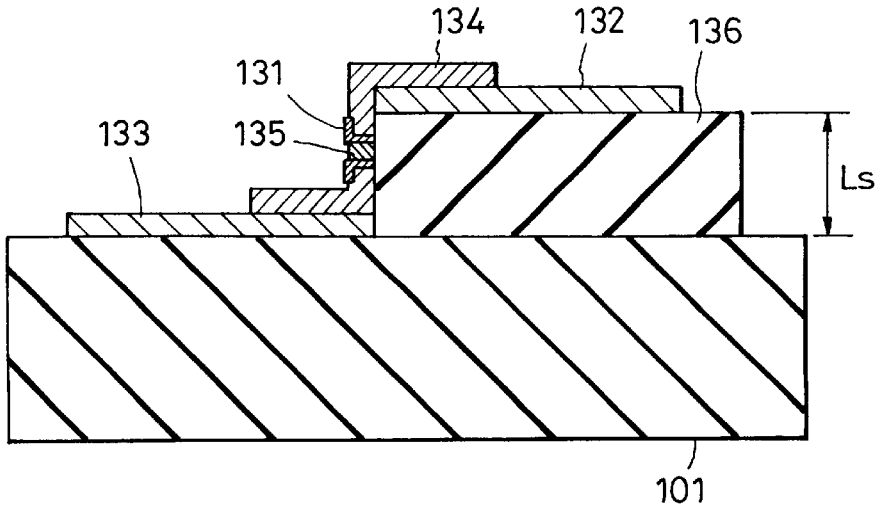
FIG. 26 is a sectional view of a vertical surface conduction type emission device used in an embodiment (image forming apparatus) of the present invention.

A description will now be made of the construction of another typical type, i.e., the construction of the vertical surface conduction type emission device, of the surface conduction type emission device comprising the fine particle film which constitutes the electron emission portion or the periphery thereof. FIG. 26 is a schematic sectional view illustrating the basic construction of the vertical type. In the drawing, reference numeral 101 denotes a substrate, reference numerals 132 and 133 each denote a device electrode, reference numeral 136 denotes a step forming member, reference numeral 134 denotes a conductive thin film comprising a fine particle film, reference numeral 135 denotes an electron emission portion formed by electric forming, and reference numeral 131 denotes a thin film formed by electric activation.

The vertical type is different from the planar type in that one (132) of the device electrodes is formed on the step forming member 136, and the conductive thin film 134 is formed to cover the side surfaces of the step forming member 136. Therefore, the device electrode distance L of the planar type shown in FIG. 22 is set as the step height Ls of the step forming member 136 of the vertical type. The substrate 101, the device electrodes 132 and 133, and the conductive thin film 134 comprising the fine particle film can be formed by using the same materials as the planar type. For the step forming member 136, for example, an electrically insulating material such as $SiO_2$ or the like is used.

Next, the method of manufacturing the vertical surface conduction type emission device is described below. FIGS. 27A to F are sectional views respectively illustrating the manufacturing steps, in which the members are denoted by the same reference numerals as FIG. 26.

Figure 27A:
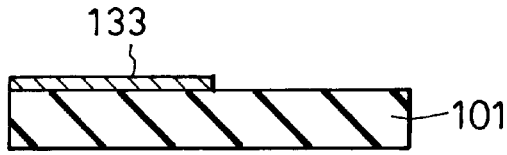
FIGS. 27A through 27F are sectional views respectively showing the steps of producing the surface conduction type emission device shown in FIG. 26.

1. As shown in FIG. 27A, the device electrode 133 is first formed on the substrate 101.

Figure 27B:
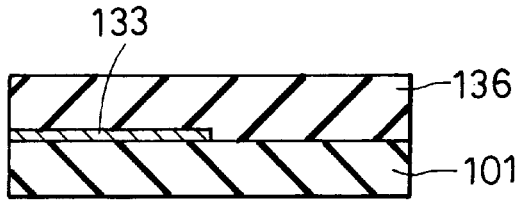

2. Next, as shown in FIG. 27B, an insulating layer is deposited for forming the step forming member 136. The insulating layer may be laminated by, for example, sputtering $SiO_2$, but other deposition methods such as vacuum deposition, printing, and the like may be used.

Figure 27C:
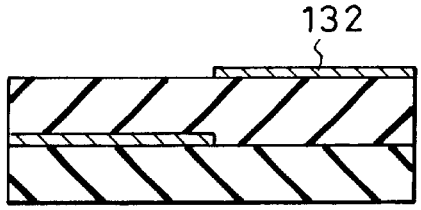

3. Next, as shown in FIG. 27C, the device electrode 132 is formed on the insulating layer.

Figure 27D:
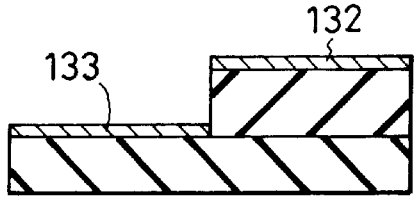

4. Next, as shown in FIG. 27D, a portion of the insulating layer is removed by, for example, etching to expose the device electrode 133.

Figure 27E:
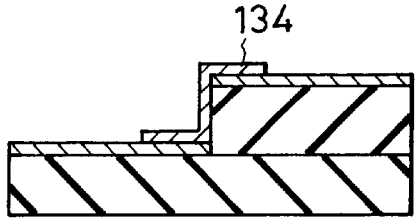

5. As shown in FIG. 27E, the conductive thin film 134 comprising the fine particle film is formed. In forming the thin film, for example, the same deposition technique as the planar type, such as coating or the like, may be used.

6. Next, the electron emission portion is formed by same electric forming process as the planar type. The same electric forming process as the planar type described above with reference to FIG. 23C may be performed.

Figure 27F:
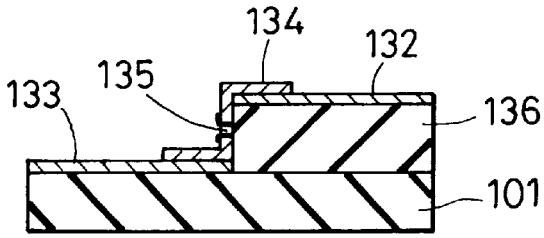

7. Next, carbon or a carbon compound is deposited in the vicinity of the electron emission portion by the same electric activation as the planar type. The same electric activation as the planar type described above with reference to FIG. 23D may be performed. The vertical surface conduction type emission device shown in FIG. 27F is manufactured as described above.

Figure 28:
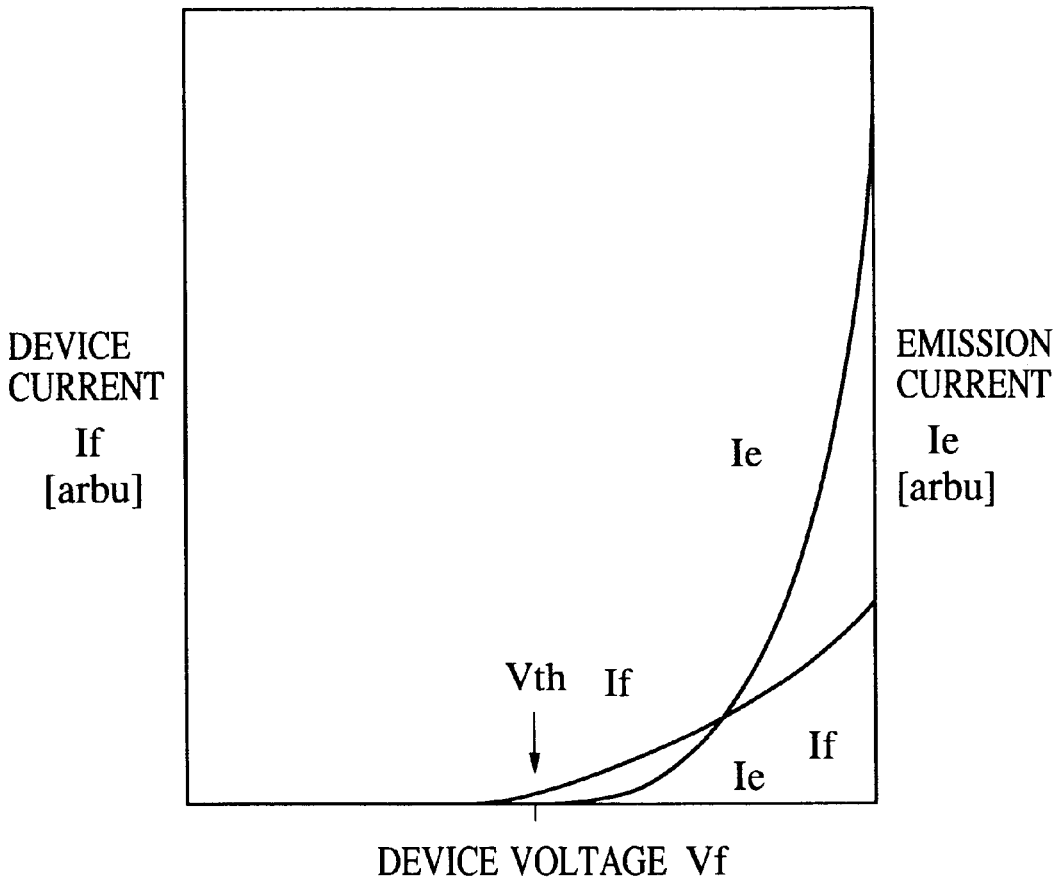
FIG. 28 is a graph showing the representative characteristics of the surface conduction type emission device shown in FIG. 26.

3) Characteristics of Surface Conduction Type Emission Device Used in Display Device Although the constructions and the manufacturing methods of the planar and vertical surface conduction type emission devices are described above, the characteristics of the device used in the display device are described below. FIG. 28 is a drawing showing typical examples of the characteristics of the emission current Ie and the device current If versus the device applied voltage Vf of the surface conduction type emission device used in the display device of this embodiment. The emission current Ie is significantly smaller than the device current If, and is shown on the same scale as the device current If with difficulty. Also, these characteristics change with changes in the design parameters such as the size and shape of the device, and are thus respectively shown in arbitrary units by two graphs.

The surface conduction type emission device used in the display device has the following three characteristics with respect to the emission current Ie. The first characteristics is that with the applied voltage higher than a predetermined voltage (threshold voltage Vth), the emission current Ie abruptly increases, while with the applied voltage less than the threshold voltage Vth, less emission current Ie is detected. Namely, the surface conduction type emission device is a nonlinear device having the defined threshold voltage Vth for the emission current Ie.

The second characteristic is that the emission current Ie changes depending upon the voltage Vf applied to the device, and thus the magnitude of the emission current Ie can be controlled by the voltage Vf.

Third characteristic is that the current Ie emitted from the device has a high speed of response to the voltage Vf applied to the device, and thus the amount of charge emitted from the device can be controlled by controlling the application time of the voltage Vf.

Since the surface conduction type emission device of this embodiment has the above-described characteristics, the device can be preferably used for the image display device. For example, in the image display device in which many devices are provided in correspondence with the pixels of the display screen, by utilizing the first characteristic, the display screen can be successively scanned to perform display. Namely, a voltage higher than the threshold voltage Vth is appropriately applied to the driven device according to the desired emission luminance, and a voltage less than the threshold voltage Vth is applied to the unselected devices. In this way, the device to be driven can be successively changed to scan the display screen, performing display.

By utilizing the above-described second or third characteristic, the emission luminance can be controlled to permit gray-scale display.

The structure of the multiple electron source in which the surface conduction type emission device are arranged on the substrate and wired in a simple matrix is as shown in FIGS. 18 and 19.

Figure 29:
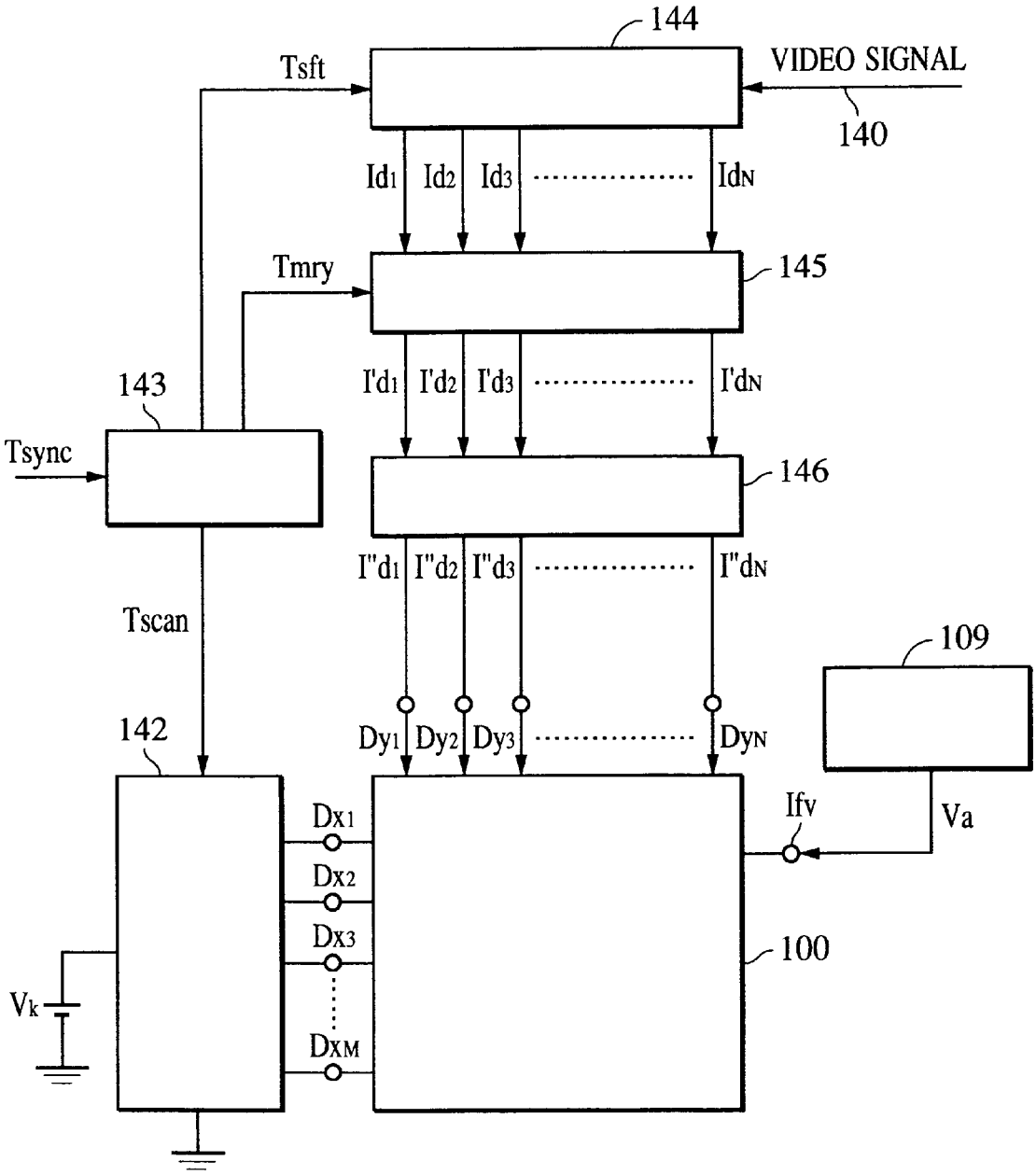
FIG. 29 is a block diagram showing the configuration of driving circuits of an image display device in accordance with the present invention.

A description will now be made of the construction of the image display device comprising the display panel 100 in which the surface conduction type emission device of this embodiment are arranged with reference to FIG. 29. In FIG. 29, the display panel 100 is connected to external driving circuits through the line wiring terminals Dx1 to DxM connected to the line wiring electrodes in the display panel 100, and the column wiring terminals Dy1 to DyN connected to the column wiring electrodes in the display panel. A scanning signal is input to the line wiring terminals Dx1 to DxM from a scanning circuit 142, for successively selecting and driving the surface conduction type emission devices for each line, which are arranged in the M×N matrix in the multiple electron source provided in the display panel 100. On the other hand, a modulation signal is applied to the column wiring terminals Dy1 to DyN, for controlling the electrons emitted from each of the surface conduction type emission devices in one line selected by the scanning signal, which is applied to the line wiring terminals from the scanning circuit 142, according to the input video signal.

A control circuit 143 has the function to match the operation timing of each of the portions so as to perform appropriate display based on the video signal 140 input from the outside. The video signal 140 input from the outside comprises image data and a synchronizing signal which are combined as a NTSC signal, or which are previously separated. In this embodiment, both signals are previously separated.

For the video signal in which image data and the synchronizing signal Tsync are combined, a well-known synchronizing separator circuit is provided for separating the image data and the synchronizing signal Tsync which are input to a shift register 144 and a control circuit 143, respectively, so that the video signal can be handled in the same manner as this embodiment.

The control circuit 143 produces control signals such as a horizontal synchronizing signal Tscan, a latch signal Tmry, a shift signal Tsft, etc. for the respective portions based on the synchronizing signal Tsync input from the outside. The image data (luminance data) contained in the video signal input from the outside is input to the shift register 144. The shift register 144 performs serial/parallel conversion of the image data input in a time-series manner for one image line, and holds the serial input image data synchronously with the control signal (shift signal) Tsft input from the control circuit 143. The image data of one line (corresponding to drive data for the N electron emitting devices) converted into a parallel signal by the shift register 144 is output as parallel signals ld1 to ldN to the latch circuit 145.

The latch circuit 145 is a storage circuit for storing and holding the image data of one line for a necessary time, i.e., storing the parallel signals ld1 to ldN according to the control signal Tmry input from the control circuit 143. The image data stored in the latch circuit 145 is output as parallel signals l'd1 to l'dN to a pulse width modulator circuit 146. The pulse width modulator circuit 146 outputs voltage signals 1&#34*d*1 to 1&#34*d*N having a modulated pulse width with a predetermined amplitude (voltage value) according to the parallel signals l'd1 to l'dN.

More specifically, the pulse width modulator circuit 146 outputs a voltage pulse having a pulse width which increases as the luminance level of the image data increases. For example, the pulse width is 30 microseconds and is 0.12 microsecond with the maximum luminance and the minimum luminance, respectively, and a voltage pulse with an amplitude of 7.5V is output. The output signals 1&#34*d*1 to 1&#34*d*N are applied to the line wiring terminals Dy1 to DyN of the display panel 100.

Furthermore, for example, a DC voltage Va of 5 kV is applied to the high-voltage terminal Hv of the display panel 100 from an accelerated voltage source 109.

Next, the scanning circuit 142 is described below. The circuit 142 contains M switching devices which are electrically connected to the terminals Dx1 to DxM of the display panel 100 by selecting either of the output voltage of a DC voltage source Vx and 0 V (ground level). The switching devices are switched based on the control signal Tscan output from the control signal 143. In fact, this configuration can be easily formed by combining switching devices such as FRTs or the like.

The DC voltage source Vx is set to output a predetermined voltage so that the driving voltage applied to the devices not scanned based on the characteristics of the electron emitting device shown in FIG. 28 is the electron emission threshold voltage Vth or less. The control circuit 143 also has the function to match the operations of the respective portions so that an appropriate display is performed based on the image signal input from the outside.

As the shift register 144 and the line memory (latch circuit) 145, either a digital signal type or an analog signal type may be used. This is because any type can be used as long as serial/parallel conversion and storage of the image signal are performed at a predetermined speed.

In the image display device of this embodiment having the above-described construction, a voltage is applied to the electron emitting devices through the external terminals Dx1 to DxM and Dy1 to DyN to emit electrons. Also, a high voltage is applied to the metal back 109 or the transparent electrode (not shown) through the high-voltage terminal Hv to accelerate electron beams. The accelerated electrons collide with the fluorescent film 108 to emit light, thereby forming an image.

The above-described construction of the image display device is an example of the constructions of image forming apparatus to which the present invention can be applied, and various modifications can be made based on the idea of the present invention. Although the NYSC system input signal is described above, the input signal is not limited to this, and other system signals such as PAL system and SECAM system signals, and a TV signal (high-definition TV signals including a MUSE system) using more scanning lines can also be used.

EXAMPLE

The present invention is described in further detail below with reference to examples. Each of the examples uses, as the above-described multiple electron source, the surface conduction type emission devices N×M (N=3072, M=1024) each comprising an electron emission portion, which is provided in a conductive fine particle film between electrodes, are wired in a matrix form by M line-direction wiring electrodes and N column-line wiring electrodes (refer to FIG. 17).

Example 1

The spacer 20 used in example 1 was formed as described below. The procedure for the substrate shaping step, the mask layer forming step, the bundling step, the mask layer patterning step, low-resistance film forming step and the mask layer removing step was the same as show in FIG. 2B. FIG. 30 schematically shows spacer base materials and substrates in each of the steps in this procedure.

A soda lime glass plate comprising the same material as the faceplate and rear plate was used as a spacer base material, and subjected to the heat drawing process shown in FIG. 13 to obtain the spacer base member 21 having the sectional shape shown in FIGS. 9B and 10B. FIG. 10 is an enlarged sectional view of one of the ends near the contact portions shown in FIG. 9.

The thus-obtained spacer base member 21 was used as the spacer 20. The spacer base member 21 formed in this example had a height H of 3 mm, a thickness D of 0.2 mm, a length L of 650 mm, as shown in FIG. 1. The glass base material 91 used in this example comprised a soda line glass plate having a height H of 150 mm, a thickness D of 10 mm, as shown in FIG. 13. The delivery speed Vs and the drawing speed V2 of the transfer means 93 and 94 were set to 4 $\mu$/min and 10 mm/min, respectively, so that the section ratio of the spacer base material 91 to the finally obtained spacer base member 21 was 1:1/2500. In this step, the heating temperature of the heater 92 was 600° C., and the base material was cut to a length L of 650 mm after the drawing process. This step corresponds to the first step shown in FIGS. 2A and 3A. In the drawings, the irregularity of the side surfaces is not shown.

The spacer base member 21 obtained by the heat drawing process had the ends (contact surfaces) having the edges (corners) with a radium curvature r of 0.02 mm. The height H, the thickness D and the length L are based on the same definition as described above with reference to FIG. 1.

Then, a mask layer was coated on the spacer base member 21 according to the following procedure. This step corresponds to the second step shown in FIG. 2B. As the material of the mask layer, OFPR-800 produced by Tokyo Ohka Kagaku Co., Ltd. was used. The mask layer was coated by dipping and then pre-baked by an oven at 90° C. for 10 minutes. Next, the mask layer was post-baked by a hot plate at 140° C. for 15 minutes. Finally, the mask layer was removed by using resist strip N321 produced by Nagese Sangyo Co., Ltd. as a stripping solution, and then spacer base member 21 was rinsed with pure water and dried.

Figure 5A:
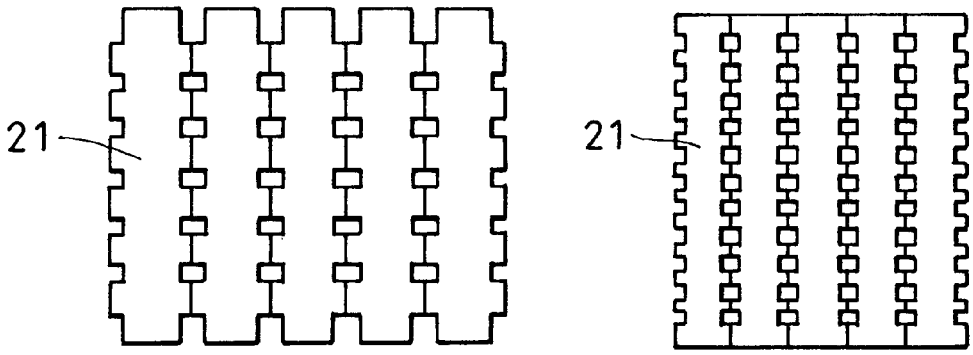
FIGS. 5A and 5B are drawings respectively illustrating the bundle states of spacer base members in accordance with the present invention.
Figure 5B:
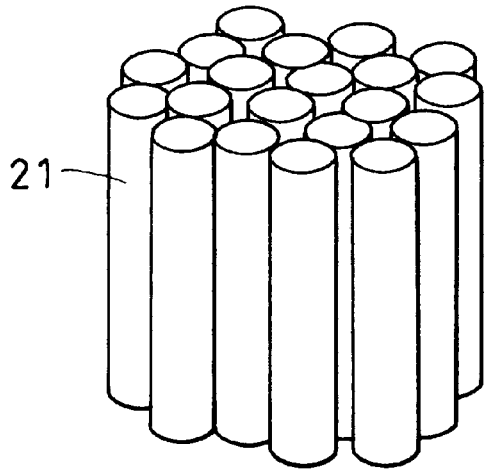

Next, a smoothed stainless substrate was prepared as a positioning member, and 100 spacers each comprising the mask layer formed thereon were bundled. Although a jig (not shown) comprising a spring for pressing the side surfaces was used for bundling, the jig was also used as a substrate holder for handling the spacers in the course of bundling. The bundle state was as shown in FIG. 5A showing no mask layer. The spring jig was maintained in the bundle state until the subsequent pattering step (the step S4 shown in FIG. 2B) and the low-resistance film forming step (the Step S5 shown in FIG. 2B) were completed.

In the next patterning step (the step S4 shown in FIG. 2B), #4000 sand paper was fixed to the smoothed stainless substrate, and the bundled spacers were brought into contact with the sand paper so that the contact surfaces were parallel to the sand paper. Then, the spacers were rubbed with the sand paper in the length direction thereof until the mask layers 25 on the contact surfaces 24 were separated. After partial separation, dry nitrogen was blown on the spacers, followed by rinsing with pure water. Then, after washing with an IPA solvent, the substrate was dried at 100C. The opposite side surfaces were processed by the same method as the above.

In the next low-resistance film forming step (the step S6 shown in FIG. 2B), the low-resistance film (electrode) 25 was formed by the dipping process according to the procedure shown in FIG. 7. First, a thick glass plate 41 of 750×750×5 was prepared, in which a recessed portion 42 having a depth of 3 microns was formed in the range of 620 mm×200 mm. The thick glass plate 41 was washed with pure water, chemically washed with IPA and acetone, and then washed with UV ozone. Then, melted Pt paste (viscosity; 30 kcP) of an organometallic salt produced by N. E Chemcat Co., Ltd. was spread to a thin film by using a stainless doctor blade, as shown in FIG. 7B. In this step, the spread solution 43 had a thickness of 6 microns. Then, the spacer base members 21 were positioned on the spread film so that a non-formation region of 15 mm was formed on either side of each end surface (contact surface) of 650 mm×0.2 mm of each of the spacer base members 21, as shown in FIGS. 7C to 7E. Then, the spacer base members 21 were moved downward in the vertical direction so that the end surfaces were parallel to the spread film, brought into contact with the spread film, and then pulled up vertically to transfer the film to the end surfaces.

The series of operations comprising spread, dipping and transfer was repeated once for the opposite end surfaces (contact surfaces). Then, the spacer base members 21 were dried at 120° C. for 10 minutes, and baked at 600° C. for 10 minutes to form the low-resistance film (electrode) 25 on the upper and lower end surfaces (contact surfaces) of the spacer base members 21.

Figure 30A:
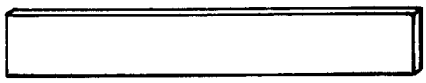
FIGS. 30A through 30G are drawings schematically showing the steps of producing a spacer of the present invention.
Figure 30B:
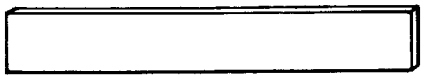
Figure 30C:
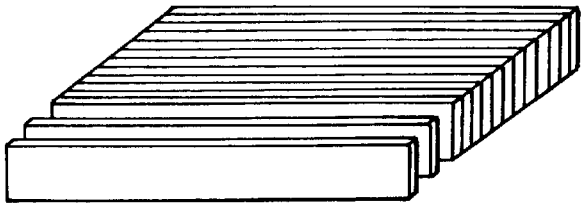
Figure 30C:
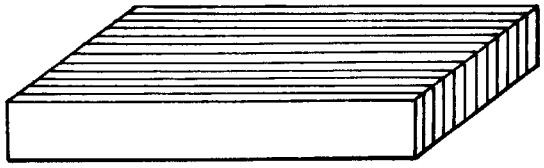
Figure 30D:
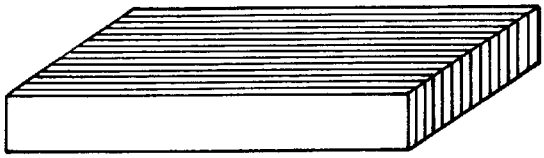
Figure 30E:
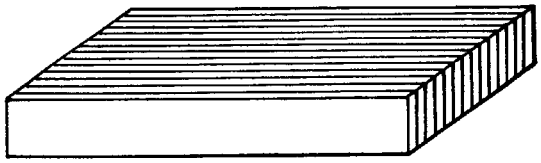
Figure 30F:
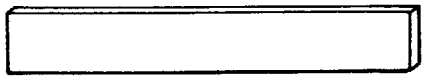
Figure 30G:
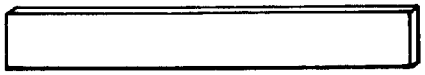
Figure 31A:
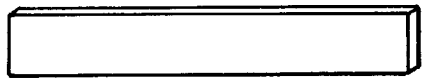
FIGS. 31A through 31G are drawings schematically showing the steps of producing a spacer of the present invention according to another procedure.
Figure 31B:
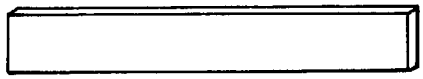
Figure 31C:
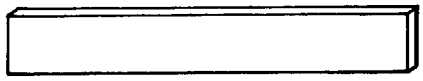
Figure 31D:
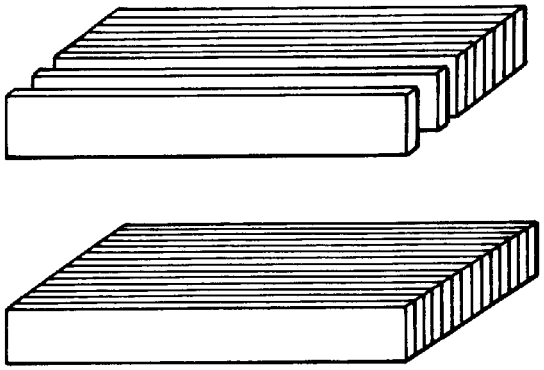
Figure 31E:
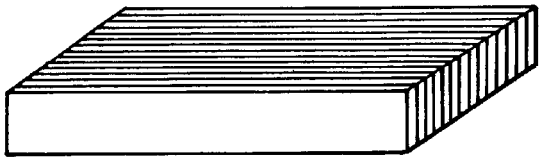
Figure 31F:
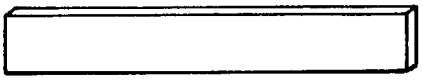
Figure 31G:
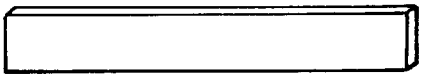

Then, bundling was released (refer to FIG. 30F. Next, the mask layer removing step (refer to FIG. 30G) was performed as described below. The mask layer was removed by using resist strip N321 produced by Nagase Sangyo Co., Ltd., and the spacer base members 21 were rinsed with pure water and the dried. In each of the thus-obtained spacers each having the low-resistance film formed thereon, each of the end surfaces each had such a sectional shape as shown in an enlarge sectional view of FIG. 11B.

In this step, the surface resistance of the low-resistance film (electrode) 25 was 1 Ω/□. Then, a Cr—Al alloy nitride film was deposited to a thickness of 200 nm on the surface of each of the spacer base members 21 by simultaneously sputtering Cr and Al targets with a radio-frequency power supply to form the high-resistance film 22. The sputtering gas comprised mixed gases of Ar and $N_2$ at a ratio of 1:2 under a total pressure of 0.13 Pa. The surface resistance R of the high-resistance film formed by simultaneous deposition was $3\times10^9$ Ω/□. The high-resistance film 22 is not limited to this, and in this example, various materials and production methods can be used for the high-resistance film 22. In this way, the spacers 20 were formed.

In each of the thus-obtained spacers 20, the low-resistance film (electrode) 25 had light reflection, the shape with good linearity, and neither projection to the side surfaces nor swell in a portion or the entire of the low-resistance film. Therefore, the low-resistance film (electrode) 25 exhibited good coatability.

The method of manufacturing the display panel 100 is describe below. First, the substrate 101 was fixed to the rear plate 105, the substrate 101 comprising the line-direction wiring electrodes 103, the column-direction wiring electrodes 104, the electrode insulating layers (not shown), the device electrodes 112 and 113 of the surface conduction type emission devices, and the conductive thin film 114, which were previously formed on the substrate 101.

Then, the spacers 20 formed as described above were fixed on the line-direction wiring electrodes 10 of the substrate 101 at equal intervals in parallel with the line-direction wiring electrodes 103. Then, the faceplate 107 comprising the fluorescent film 108 and the metal back 109 provided on the inner surface thereof was arranged about 3 mm above the substrate 101 with the side wall 106 provided therebetween. Then, the joints between the rear plate 105, the faceplate 107, the side wall 106 and the spacers 20 were fixed.

In this step, glass frit (not shown) was coated on the joint between the substrate 101 and the rear plate 105, the joint between the rear plate 105 and the side wall 106, and the joint between the faceplate 107 and the side wall 106, and then baked in the air at 400 to 500° C. for 10 minutes or more to seal the joints. In this example, in the display panel shown in FIG. 17, the spacers 20 were arranged on the wiring electrodes 103 on the electron source substrate 101, and arranged on the metal back 109 on the faceplate 107 to manufacture the display panel 100. During fixing, positioning and fixing were performed by using the auxiliary members 29 provided outside the image region, as shown in FIG. 6. FIG. 7 is an enlarged sectional view of the vicinity of the fixed portion of the spacer base member shown in FIG. 6 taken along line I–I', as viewed from the signal electrode side.

In sealing of the airtight container, the joints were bonded and electrically connected by baking at 400° C. to 500° C. for 10 minutes or more in the air. In this example, the fluorescent film 108 comprised the stripe-shaped fluorescent materials of each color, which were extended in the column direction (Y direction), the black conductor 1010 being arranged so as to separate not only the respective fluorescent materials (R, G, B) but also the respective pixels in the Y direction. The spacers 20 were arranged in the black conductor 101 (line width: about 300 μm) parallel to the line direction (X direction) through the metal back 109. During sealing, the rear plate 105, the faceplate 107 and the spacers 20 were sufficiently aligned with each other so as to cause the fluorescent materials of each color to respectively correspond to the devices arranged on the substrate 101.

The thus-completed airtight container was evacuated by a vacuum pump (not shown) through an exhaust tube (not shown) to attain a sufficient degree of vacuum. Then, electric power was supplied to each of the devices through the line-direction wiring electrodes 103 and the column-direction wiring electrodes 104 and the external terminals Dx1 to DxM and Dy1 to DyN of the container to perform the electric forming and electric activation, to produce the multiple electron source. Next, the exhaust tube (not shown) was sealed with a degree of vacuum of about $10^{-4}$ Ps by heating with a gas burner to seal the package (airtight container). Finally, in order to maintain the degree of vacuum after sealing, gettering was performed.

In the image display device using the display panel 100 shown in FIG. 17, which was completed as described above, a scanning signal and modulation signal were applied to each of the cold-cathode devices (the surface conduction type emission devices) 112 through the external terminals Dx1 to DxM and Dy1 to DyN of the container to emit electrons, and a high voltage was applied to the metal back 209 through tee high-voltage terminal Hv to accelerate the emitted electron beams. As a result, the emitted electrons were caused to collide with the fluorescent film 108 to excite the fluorescent materials of each color (R, F, and B shown in FIG. 20) and emit light, thereby displaying an image. In this example, the voltage Va was applied to the high-voltage terminal Hv up to the limit voltage in the range of 3 kV to 12 kV, with which discharge was produced, and the voltage Vf applied between the wiring electrodes 103 and 104 was 14 V. As a result, the voltage resistance was good in continuous driving with the voltage of 8 kV or more applied to the high-voltage terminal Hv.

In this case, no discharge occurred near the spacers until driving was started with a voltage of 10 kV. Furthermore, emission spot lines including the emission spots by the electrons emitted from the cold-cathode devices positioned near the spacers 20 were formed in a two-dimensional form at equal intervals, thereby permitting a clear color image display having good color reproducibility. This indicated that the spacers 20 caused no disturbance of the electric field without an influence on the electron orbit.

Example 2

The spacer 20 used in this example was produced as described above. The method of patterning the low-resistance film of the spacer base member 21 was performed according to the procedure for the substrate shaping step, the mask layer forming step, the bundling step, the mask layer patterning step, the low-resistance film forming step, and the mask layer removing step shown in FIG. 3B. FIGS. 31A to G show the appearance of a substrate in the respective forming steps. The same substrate shaping step and the same forming method as Example 1 were repeated except that the bundling step was performed after the mask layer pattering step to form the low-resistance film (electrode) 25 on the end surfaces (contact surfaces) of the spacer base member 21.

Furthermore, the high-resistance film 22 was formed by the same sputtering method as Example 1 to form the spacer 20.

In each of the thus-obtained spacers 20, the low-resistance film (electrode) 25 had light reflection, the shape with good linearity, and neither projection to the side surfaces nor swell in a portion or the entire of the low-resistance film. Therefore, the low-resistance film (electrode) 25 exhibited good coatability.

Furthermore, the display panel 100 was formed together with the rear plate comprising electron emitting devices by the same method as Example 1, and application of a high voltage and device driving were performed under the same conditions as Example 1. In this example, no discharge occurred near the spacers 20 until driving was started with a voltage of 10 kV. Furthermore, emission spot lines including the emission spots by the electrons emitted from the cold-cathode devices 112 positioned near the spacers 20 were formed in a two-dimensional form at equal intervals, thereby permitting a clear color image display having good color reproducibility. This indicated that the spacers 20 caused no disturbance of the electric field without an influence on the electron orbit.

Example 3

The spacer 20 used in this example was produced as described below. The low-resistance film (electrode) 25 was formed by the same method as Example 1 except that a plate-shaped spacer base member 21 having contact portions each having the shape shown in FIGS. 9 and 10, and an uneven stripe structure in the longitudinal direction was used in place of the spacer base member 21 formed in Example 1. Also, the bundling step was performed by the same method as Example 1 before the mask layer pattering step after the formation of the mask layer. In this step, the bundle state is shown on the left side of FIG. 5A (not showing the coated mask layer). In this state, spaces occurred near the contact portions. Then, the high-resistance film 22 was formed by sputtering in the same manner as Example 1 to produce the spacer 20.

In each of the thus-obtained spacers 20, the low-resistance film (electrode) 25 had light reflection, the shape with good linearity, and neither projection to the side surfaces nor swell in a portion or the entire of the low-resistance film. Therefore, the low-resistance film (electrode) 25 exhibited good coatability.

Furthermore, the display panel 100 was formed together with the rear plate comprising electron emitting devices by the same method as Example 1, and application of a high voltage and device driving were performed under the same conditions as Example 1. In this example, no discharge occurred near the spacers 20 until driving was started with a voltage of 9 kV. Furthermore, emission spot lines including the emission spots by the electrons emitted from the cold-cathode devices 112 positioned near the spacers 20 were formed in a two-dimensional form at equal intervals, thereby permitting a clear color image display having good color reproducibility. This indicated that the spacers 20 caused no disturbance of the electric field without an influence on the electron orbit.

Example 4

The spacer 20 used in this example was produced as described below. The low-resistance film (electrode) 25 was formed by the same method as Example 1 except that the spacer base member 21 was obtained by forming a soda lime glass base plate, and polishing the all six surfaces of the glass base plate so that the surfaces were arranged at right angles with each other, and used in place of the spacer base member 21 formed in Example 1. The soda lime glass base plate had a defined size and was obtained by cutting a rectangular spacer base member, as shown in FIG. 12. The size of the spacer base member 21 had a height H of 3 mm, a thickness D of 0.2 mm and a length L of 40 mm. Then, the high-resistance film 22 was formed on the contact portions of the spacer base member 21 by the same sputtering process as Example 1 to produce the spacer 20.

In each of the thus-obtained spacers 20, the low-resistance film (electrode) 25 had light reflection, the shape with good linearity, and neither projection to the side surfaces nor swell in a portion or the entire of the low-resistance film. Therefore, the low-resistance film (electrode) 25 exhibited good coatability.

In this example, the display panel 100 shown in FIG. 17 was manufactured, in which the spacers 20 were arranged. The method of manufacturing the display panel 100 is described in detail below. First, the substrate 101 was fixed to the rear plate 105, the line-direction wiring electrodes 103, the column-direction wiring electrodes 104, the electrode insulating layers (not shown), the device electrodes 112 and 113 of the surface conduction type emission devices, and the conductive thin film 114 being previously formed on the substrate 101. Then, the spacers 20 formed as described above were fixed on the line-direction wiring electrodes 103 of the substrate 101 at equal intervals in parallel with the line-direction wiring electrodes 103. Then, the faceplate 107 comprising the fluorescent film 108 and the metal back 109 provided on the inner surface thereof was arranged about 3 mm above the substrate 101 with the side wall 106 provided therebetween. Then, the joints between the rear plate 105, the faceplate 107, the side wall 106 and the spacers 20 were fixed. In this step, glass frit (not shown) was coated on the joint between the substrate 101 and the rear plate 105, the joint between the rear plate 105 and the side wall 106, and the joint between the faceplate 107 and the side wall 106, and then baked in the air at 400 to 500° C. for 10 minutes or more to seal the joints. In this example, the spacers 20 were arranged on the wiring electrodes 103 (line width: about 300 $\mu$m) on the substrate 101, and arranged on the metal back 109 on the faceplate 107 through conductive frit glass (not shown) containing a conductive filler or a metal conductor. In sealing of the airtight container, the joints were bonded and electrically connected by baking at 400° C. to 500° C. for 10 minutes or more in the air.

The thus-formed spacers 20 were arranged in the panel to form the display panel 100 together with the rear plate comprising electron emitting devices, and application of a high voltage and device driving were performed under the same conditions as Example 1. In this example, no discharge occurred near the spacers 20 until driving was started with a voltage of 9 kV. Furthermore, emission spot lines including the emission spots by the electrons emitted from the cold-cathode devices 112 positioned near the spacers 20 were formed in a two-dimensional form at equal intervals, thereby permitting a clear color image display having good color reproducibility. This indicated that the spacers 20 caused no disturbance of the electric field without an influence on the electron orbit.

Example 5

The spacer 20 used in this example was produced as described below. As the spacer base member 21, a fiber-type cylindrical glass material formed by the heat drawing method was used in place of the spacer base member 21 used in Example 4. The size of the spacer base member 21 had a diameter of 300 $\mu$m and a height of 3 mm, and the bottom and the side surfaces was at a right angle with the height direction. In this way, the low-resistance film (electrode) 25 was formed by the same formation method as Example 4 except that the cylindrical spacer base member 21 was used, and the mask layer was patterned by filing after bundling.

The bundling step was performed by the same method as Example 4 before the mask layer patterning step after the formation of the mask layer. In this step, the bundle state is shown on the left side of FIG. 5B (not showing the coated mask layer and the bundling jig). In this state, spaces occurred near the contact portions. Then, the high-resistance film 22 was formed by the same sputtering process as Example 4 to produce the spacer 20.

Figure 32:
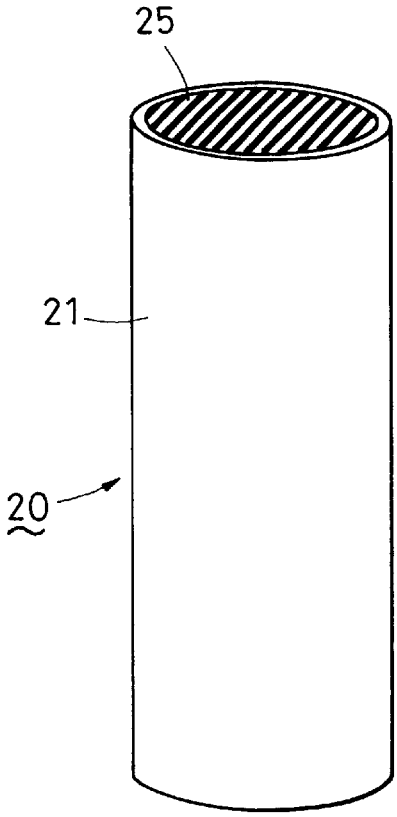
FIG. 32 is a perspective view showing the structure of a columnar spacer in accordance with an embodiment of the present invention.
Figure 33:
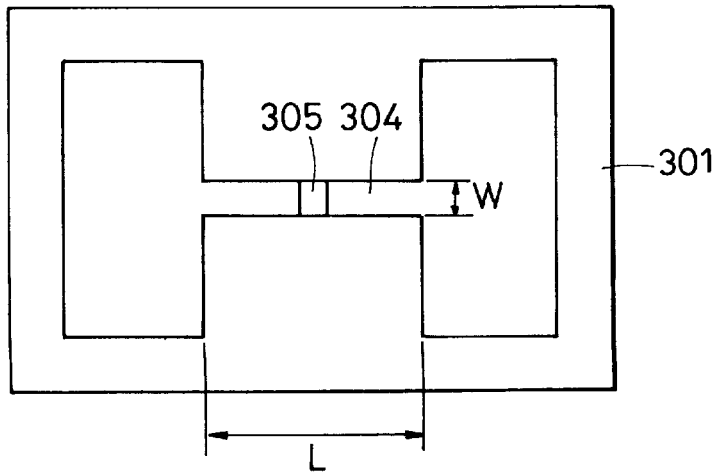
FIG. 33 is a drawing showing an example of conventional known surface conduction-type emission devices.
Figure 34:
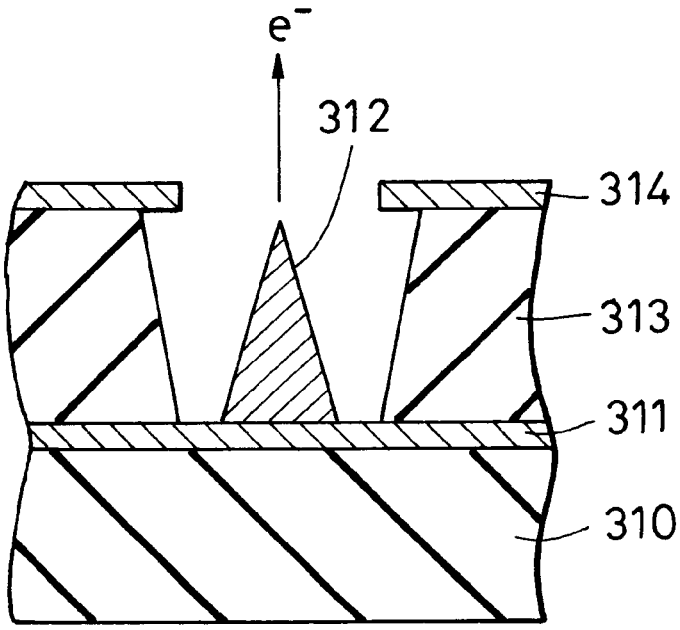
FIG. 34 is a drawing showing an example of conventional known FE devices.
Figure 35:
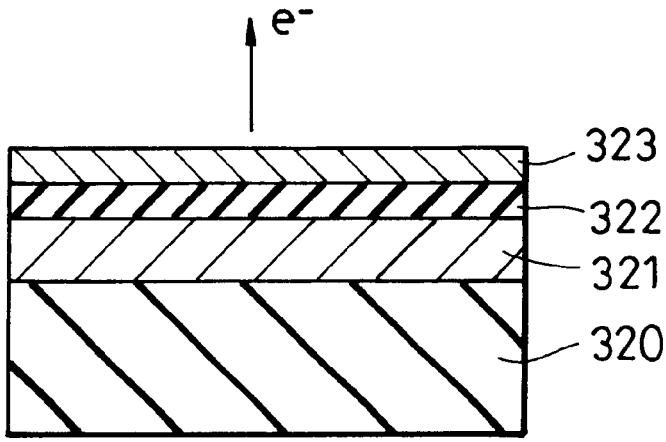
FIG. 35 is a drawing showing an example of conventional known MIM devices.

FIG. 32 shows the state of the end surfaces after the low-resistance film was formed in this example. In each of the thus-obtained spacers 20, the low-resistance film (electrode) 25 had light reflection, the shape with good linearity, and neither projection to the side surfaces nor swell in a portion or the entire of the low-resistance film. Therefore, the low-resistance film (electrode) 25 exhibited good coatability.

Furthermore, the display panel 100 was formed together with the rear plate comprising electron emitting devices by the same method as Example 4, and application of a high voltage and device driving were performed under the same conditions as Example 4. In this example, no discharge occurred near the spacers 20 until driving was started with a voltage of 9 kV. Furthermore, emission spot lines including the emission spots by the electrons emitted from the cold-cathode devices 112 positioned near the spacers 20 were formed in a two-dimensional form at equal intervals, thereby permitting a clear color image display having good color reproducibility. This indicated that the spacers 20 caused no disturbance of the electric field without an influence on the electron orbit.

As described above, the low-resistance film (electrode) 25 formed in each of the embodiments can be easily formed by a simple process, and exhibits good electrical contact and good discharge breakdown voltage, thereby improving electron beam display quality. Also, the present invention is particularly effective to a manufacturing process required to have mass productivity and low cost, and an electron source formed by the same.

The method of forming the low-resistance film (electrode) 25 of each of the embodiments of the present invention comprises forming the low-resistance film after a mask layer is patterned. Therefore, the function to ensure the formation precision of the low-resistance film can be performed not only by control of the substrate for the low-resistance film and the low-resistance film coating material, but also by the mask layer patterning step, thereby ensuring the good formation precision. The present invention has also the effect of finally removing defects in the formed portion even when a coating solution rises due to a meniscus or rises in the spaces between the spacers. Therefore, the present invention can be applied to spacer base members such as cylindrical spacers, uneven spacers, or the like, which easily produce spaces between the respective spacers in a bundle state.

Furthermore, the mask layer is patterned by using physical removal means such as filing or the like, thereby permitting simple and effective removal of the mask layer. Since the spacers are bundled before the low-resistance film is formed, particularly, before the mask layer is patterned, the non-formation surfaces of the spacer base members are masked with each other, and the contact surfaces (i.e., low-resistance film formation surfaces) are concentrated in the exposed surface, thereby eliminating the need for alignment and decreasing the number of the steps.

Therefore, the low-resistance film (electrode) 25 can be formed on many types of spacer base members without being divided by the end surfaces and the side surfaces of the spacer base members 21 to obtain good electrical contact between both surfaces. When the spacers were incorporated into an electron source, the charge of the surfaces of the spacers can be effectively escaped to the substrate surface of each of the faceplate and the rear plate, and the potential near the contact portions 24 can be stably defined over the entire region of each of the spacers 20 in the longitudinal direction thereof.

Since the liquid phase forming method is used to eliminate the need for a vacuum step, thereby decreasing the apparatus cost and tact time. Furthermore, in some cases, the low-resistance film (electrode) 25 is in a stable state after evacuation, pressure reduction, deposition, and air leakage, and thus a film is deposited on other members in an unstable transient state, thereby causing the problem of peeling the low-resistance film (electrode) 25. Therefore, the low-resistance film 25 must be moderated to a stable state. This is possibly related to the structure of the low-resistance film (electrode) 25 and surface activation thereof, and is particularly related to stabilization of water desorption and adsorption. However, in the present invention, the passage through the unstable state can be inhibited by using heating and baking without using the vacuum step. Furthermore, the dipping process is used as the liquid phase method to obtain the effect of increasing the utilization efficiency of raw materials.

As described above, the present invention has the effect of obtaining a simple and low-cost production process. Therefore, the production cost of spacers and an electron source can be further decreased to provide an image display device having high display quality and less displacement of a light emission portion due to charge at low cost.

As described in detail above, the present invention can realize a suitable spacer and a production method therefor.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method of producing a spacer provided between a first substrate and a second substrate on which an electron emitting device is arranged, the method comprising:

a step of forming a film on at least a portion of at least one surface of the spacer;

wherein the step of forming the film comprises a step of preparing a bundle of a plurality of spacer base members, and a step of providing a film material on the bundle, and wherein the bundle on which the film material is provided has a mask for covering at least a film non-formation portion near a film formation portion of each of the plurality of spacer base members of the bundle.

2. A method of producing a spacer according to claim 1, wherein the mask is provided on a surface of the spacer base member, wherein the surface of the spacer base member will be supposed to face a surface of an adjacent spacer base member when the plurality of the spacer base members are bundled.

3. A method of producing a spacer according to claim 1, wherein the film formation portion is located in a contact surface of the spacer in contact with the first substrate or a contact member provided nearer to the first substrate than the spacer, or in contact with the second substrate or a contact member provided nearer to the second substrate than the spacer.

4. A method of producing a spacer according to claim 1, wherein the film is a low-resistance film.

5. A method of producing a spacer according to claim 1, wherein the film has a sheet resistance value of $1\times10^{7}\Omega/\square$ or less.

6. A method of producing a spacer according to claim 1, further comprising the step of removing the mask after the step of providing the film material.

7. A method of producing a spacer according to claim 1, further comprising a step of forming the mask on at least one spacer base member before the step of providing the film material.

8. A method of producing a spacer according to claim 1, further comprising a step of removing the mask formed in the film formation portion before the step of providing the film material, wherein the mask is formed on the film formation portion of the spacer base member before the step of removing the mask.

9. A method of producing a spacer according to claim 8, wherein the step of removing the mask before the step of providing the film material is performed for each of the plurality of the spacer base members before bundling.

10. A method of producing a spacer according to claim 1, wherein the step of removing the mask before the step of providing the film material is performed after the step of preparing a bundle of a plurality of spacer base members.

11. A method of producing a spacer according to claim 1, further comprising a step of removing the mask formed in the film formation portion before the step of providing the film material, wherein the step of removing the mask before the step of providing the film material is performed by physical removal.

12. A method of producing a spacer according to claim 11, wherein the step of removing the mask before the step of providing the film material is performed by filing or blasting.

13. A method of producing a spacer according to claim 1, wherein the step of preparing the bundle is performed so that film formation portions of the plurality of the spacer base members of the bundle are positioned in substantially the same plane.

14. A method of producing a spacer according to claim 1, further comprising a step of heating the film material provided in the providing.

15. A method of producing a spacer according to claim 1, wherein the film material is provided in a liquid state.

16. A method of producing a spacer according to claim 15, wherein the film material is provided by a dipping process.

17. A method of producing a spacer according to claim 1, wherein at least one spacer base member has an uneven surface.

18. A method of producing a spacer according to claim 1, wherein at least one spacer base member has a columnar structure.

19. A method of manufacturing an image forming apparatus comprising a first substrate on which an image forming member for forming an image by electron irradiation is provided, a second substrate on which an electron emitting device is provided, and a spacer provided between the first and second substrates;

wherein the spacer is produced by a method of producing a spacer according to claim 1.

20. A method of producing a spacer according to claim 1, wherein the mask is a mask layer.

* * * * *

UNITED STATES PATENT AND TRADEMARK OFFICE

CERTIFICATE OF CORRECTION

PATENT NO. : 6,761,606 B2
DATED : July 13, 2004
INVENTOR(S) : Nobuhiro Ito et al.

It is certified that error appears in the above-identified patent and that said Letters Patent is hereby corrected as shown below:

Title page,
Item [56], References Cited, FOREIGN PATENT DOCUMENTS,
"WO 9802899" should read -- WO 98/02899 --.
Drawings,
Sheet 2, Fig. 2B, "DPPING" should read -- DIPPING --.
Sheet 3, Fig. 3B, "DPPING" should read -- DIPPING --.

Column 6,
Lines 58 and 64, "each other" should be deleted.

Column 7,
Line 67, "fist" should read -- first --.

Column 11,
Line 58, "describe" should read -- described --.

Column 16,
Line 62, "permit" should read -- permits --.

Column 17,
Line 60, "radium" should read -- radius --.

Column 22,
Line 36, "diving" should read -- dividing --.

Column 23,
Line 36, "less" should read -- fewer --.

UNITED STATES PATENT AND TRADEMARK OFFICE

CERTIFICATE OF CORRECTION

PATENT NO. : 6,761,606 B2
DATED : July 13, 2004
INVENTOR(S) : Nobuhiro Ito et al.

It is certified that error appears in the above-identified patent and that said Letters Patent is hereby corrected as shown below:

Column 34,
Line 1, "radium" should read -- radius of --.

Signed and Sealed this

Eleventh Day of April, 2006

JON W. DUDAS
*Director of the United States Patent and Trademark Office*